US007481033B2

(12) United States Patent
Ouellette et al.

(10) Patent No.: US 7,481,033 B2
(45) Date of Patent: Jan. 27, 2009

(54) OBJECT CONVEYOR AND BAGGER WITH SONIC WELDED BAG SEAMS

(75) Inventors: Joseph F. Ouellette, Glendale, MO (US); Richard J. Ouellette, Glendale, MO (US)

(73) Assignee: Ouellette Machinery Systems, Inc., Fenton, MO (US)

( * ) Notice: Subject to any disclaimer, the term of this patent is extended or adjusted under 35 U.S.C. 154(b) by 400 days.

(21) Appl. No.: 10/298,456

(22) Filed: Nov. 18, 2002

(65) Prior Publication Data

US 2004/0093836 A1 May 20, 2004

(51) Int. Cl.
*B65B 9/02* (2006.01)

(52) U.S. Cl. ..... 53/553; 53/209

(58) Field of Classification Search ..... 53/206, 53/209, 553, 528, 377.2, 378.3
See application file for complete search history.

(56) References Cited

U.S. PATENT DOCUMENTS 2,252,435 A * 8/1941 Lust ..... 53/377.2
2,974,461 A * 3/1961 Demler ..... 53/209
3,354,606 A * 11/1967 Miller et al. ..... 53/377.2
3,357,151 A * 12/1967 Monaghan ..... 53/553
3,406,494 A * 10/1968 Beck ..... 53/553
3,503,175 A * 3/1970 Rademacher et al. ..... 53/553
3,739,547 A * 6/1973 Brevko et al. ..... 53/553
3,837,138 A * 9/1974 Terry ..... 53/553
3,848,398 A * 11/1974 Suhr ..... 53/553
3,971,524 A * 7/1976 Nudinger et al. ..... 242/417.3
4,060,959 A * 12/1977 Fiedler et al. ..... 53/375.9
4,351,692 A 9/1982 Ouellette
4,467,589 A * 8/1984 van Maanen ..... 53/450
4,858,416 A * 8/1989 Monaghan ..... 53/553

FOREIGN PATENT DOCUMENTS

JP 52-24792 * 2/1977 ..... 53/553

* cited by examiner

*Primary Examiner*—Stephen F Gerrity
(74) *Attorney, Agent, or Firm*—Thompson Coburn LLP

(57) ABSTRACT

A bagging conveyor quickly positions two-dimensional arrayed layers of objects inside a sealed, flexible bag prior to the layers of objects being delivered by the bagging conveyor to a palletizer. The bagging conveyor receives continuous films of packaging material from below and above the conveying surface of the bagging conveyor and positions the films of packaging material below and above the layer of objects being conveyed by the conveyor. The bagging conveyor then forms seams along the laterally opposite side edges of the packing material films at the sides of the conveyed layer of objects and forms seams laterally across the upper and lower films of packaging material in front of and behind the conveyed layer of objects, thereby quickly enclosing the conveyed layer of objects in a sealed bag as they are conveyed through the bagging conveyor.

8 Claims, 44 Drawing Sheets

OBJECT CONVEYOR AND BAGGER WITH SONIC WELDED BAG SEAMS

BACKGROUND OF THE INVENTION (1) Field of the Invention

The present invention pertains to an apparatus that is one part of a conveyor system that transfers objects, for example plastic blow molded bottles, where the apparatus arranges the objects in layers on a pallet. In particular, the present invention pertains to an apparatus that is employed to quickly position two dimensional array layers of objects inside sealed, flexible bags while forming the sealed bags encapsulating each layer of objects prior to the layers of objects being delivered by the conveyor system to a palletizer.

(2) Description of the Related Art

Many product containers such as bottles, cans, jars, etc. are packaged in pallet load lots to facilitate their transportation from a manufacturer of the objects to a user of the objects. The pallet loads typically include large stacks of layers of the objects that are stacked on top of a supporting pallet. The layers of objects are secured to the top surface of the pallet by banding, plastic sheet wrap, or by other equivalent methods. The pallet and the layers of objects stacked on it can be moved as a unit from the manufacturer of the objects, through distribution and ultimately to the end user of the objects. Examples of conveyor systems that palletize layers of objects are disclosed in the U.S. Patents of Ouellette U.S. Pat. Nos. 6,106,220 and 6,371,720 B1, each of which are assigned to the assignee of the present invention and are incorporated herein by reference. In many conveyor systems in which objects are arranged in layers and are loaded onto pallets in stacks of the layers, the faster the conveyor system can operate to load pallets increases the overall cost efficiency of the system.

In palletizing conveyor systems such as those discussed above it is at times desirable to enclose each layer of objects to be palletized in packaging material to prevent the objects from being contaminated by dirt, dust or other foreign materials as the objects are transported from the manufacturer to the end user. This is particularly true in the manufacture of plastic blow molded bottles that are to be used as containers for various different types of food products. Conveyor systems have been designed that include a bagger apparatus that positions each layer of objects conveyed by the conveyor system in a bag and seals the bag closed prior to the layer of objects being stacked on a pallet by a palletizer. A typical prior art bagger apparatus includes a packaging material dispenser that dispenses packaging material in a tubular form to the conveyor system. A free end of the tubular packaging material is held open while a layer of objects is positioned inside the tubular packaging material by the conveyor system. Once the layer of objects is positioned inside a portion of the tubular packaging material, the open end of the tubular packaging material is closed and the tubular packaging material at the opposite end of the layer of objects is closed on itself to enclose the layer of objects inside the packaging material. The layer of objects enclosed inside the tubular packaging material is then separated from the remainder of the tubular packaging material which then encloses the next sequential layer of conveyed objects. The enclosed layer is then conveyed by the conveyor system to the palletizer that positions the layer of objects enclosed in the tubular packing material on a pallet.

The prior art method also included sequentially enclosing layers of objects in individual preformed bags through openings at the ends of the bags and then sealing the bags closed before palletizing the bagged layers. This method was at least as slow as the previously described method.

Bagging each layer of objects to be stacked on a pallet adds considerably to the time required to stack a pallet full with the layer of objects which detracts from the efficiency of the conveyor system The positioning of the tubular packaging material relative to the conveyor system where a layer of objects can be positioned by the conveyor system inside a portion of the tubular packaging material, and the subsequent closing of the tubular packaging material at opposite ends of the layer of objects prior to the enclosed layer of objects being palletized significantly adds to the time needed by the conveyor system to stack layers of objects on a pallet. What is needed to improve the cost efficiency of operating a conveyor system that arranges layers of objects inside a bag of packaging material prior to the layer of objects being stacked on a pallet is a more time efficient apparatus that positions layers of objects in enclosed bags of packaging material prior to their being stacked by a palletizer.

SUMMARY OF THE INVENTION

The present invention overcomes the disadvantages associated with prior art conveying systems that arrange layers of objects in a bag of packaging material prior to the layers of objects being palletized by providing a more time efficient apparatus that encloses layers of objects in simultaneously formed sealed bags. The apparatus of the invention is basically comprised of a bagging conveyor that is positioned between an infeed conveyor and an outfeed conveyor where the infeed conveyor provides two dimensional arrays of objects to the bagging conveyor of the invention that forms a bag of packaging material around the layer of objects prior to the layer of objects being taken by the outfeed conveyor to a palletizer.

The bagging conveyor is comprised of a longitudinally extending bottom conveying surface and a vertically opposite, longitudinally extending top conveying surface. The bottom and top conveying surfaces receive two dimensional arrayed layers of objects from the infeed conveyor between the two conveying surfaces and convey the layers of objects in a downstream direction to the outfeed conveyor.

A bottom film roll dispenser supplies an elongate film of packaging material from a roll of this film to the bottom conveying surface. A top film roll dispenser supplies an elongate film of the packaging material from a roll of the film to the top conveying surface. The bottom film of packaging material is conveyed beneath the layer of objects by the bottom conveying surface and the top film of packaging material is conveyed above the layer of objects by the top conveying surface.

Film side edge forming and sealing devices are positioned along the laterally opposite sides of the bottom conveying surface and the top conveying surface. The edge sealing devices are positioned to receive the laterally opposite edges of the bottom film of packaging material and the laterally opposite edges of the top film of packaging material as the two films of packaging material are conveyed in the downstream direction between the bottom conveying surface and the top conveying surface. The edge sealing devices bring the laterally opposite side edges of the bottom film of packaging material and the laterally opposite side edges of the top film of packaging material together as the bottom film and top film and the layer of objects there between are conveyed in a longitudinal downstream direction. A sealing device, in the preferred embodiment a sonic welder, is positioned on laterally opposite sides of the bottom and top conveying surfaces at their outlet ends. The sonic welders heat seal the laterally opposite side edges of the bottom film to the laterally opposite side edges of the top film as they are conveyed past the sonic welders, thereby enclosing the layer of objects in a tube of packaging material formed by the bottom film and top film of packaging material.

In addition, a lateral film end sealing device is positioned adjacent the downstream ends of the bottom conveying surface and the top conveying surface. The lateral film end sealing device is comprised of a pair of vertically spaced heat seal/cut/seal bars that extend across the bagging conveyor and are operable to move vertically toward each other and away from each other. The bottom film and top film of packaging material are conveyed by the bagging conveyor between the pair of bars. The heat seal/cut/seal bars move toward each other to secure the bottom film and top film of packaging material together between each two dimensional arrayed layer of objects being conveyed by the bagging conveyor, thereby enclosing the layer of objects inside a sealed bag formed by the bottom film and top film of packaging material. The opposed bars of the lateral heat seal/cut/seal device also cut across the packaging material as they join the bottom film to the top film, thus separating the formed bag of packaging material from the bottom and top films of packaging material being conveyed through the bagging conveyor. The layer of objects now enclosed in a bag formed of the bottom film and top film of packaging material is delivered to a palletizer where the bagged layer of objects is arranged on a pallet with only a single bagged layer on each layer on the pallet or two or more bagged layers on each layer of the pallet.

In the preferred embodiment of the invention both the bottom conveying surface and the top conveying surface are comprised of a plurality of chain conveyors that are known as table top chain conveyors in the industry. The chain conveyors form a plurality of longitudinally extending bottom conveying surfaces that are arranged laterally side by side and a plurality of longitudinally extending top conveying surfaces that are arranged laterally side by side. The vertical spacing between the plurality of bottom conveying surfaces and the plurality of top conveying surfaces can be adjusted to accommodate objects of different heights in the bagging conveyor. The lateral spacing between the pluralities of bottom conveying surfaces and top conveying surfaces can also be adjusted to accommodate the bagging conveyor to form bags of packaging material around layers of objects having different width dimensions. Still further, each of the laterally outer pair of the conveying surfaces of the pluralities of bottom conveying surfaces and top conveying surfaces can be operated at different speeds to enable continuous alignment of the bottom film of packaging material and the top film of packaging material conveyed through the bagging conveyor.

Also in the preferred embodiment of the invention, both the bottom packaging material film dispenser and the top packaging material film dispenser include splicing apparatus. The elongate film of packaging material is provided on a roll of the material in each of the bottom film dispenser and the top film dispenser. Each splicing apparatus can splice the end of a roll of packaging material to a beginning of a new roll of packaging material in order to reduce downtime of the conveyor system to replace rolls of packaging material used by the bagging conveyor.

Because the bagging conveyor of the invention forms bags of packaging material around layers of objects conveyed by the conveyor, it can operate substantially continuously as it receives layers of objects from an infeed conveyor, bags the layers of objects and then supplies the bagged layers of objects to an outfeed conveyor that supplies the bagged layers of objects to a palletizer, thus significantly increasing the efficiency of supplying bagged layers of objects to a palletizer than that achievable by prior art bagging conveyors.

BRIEF DESCRIPTIONS OF THE DRAWING FIGURES

Further features of the invention will be revealed in the following detailed description of the preferred embodiment of the invention and in the drawing figures wherein.

Figure 3:
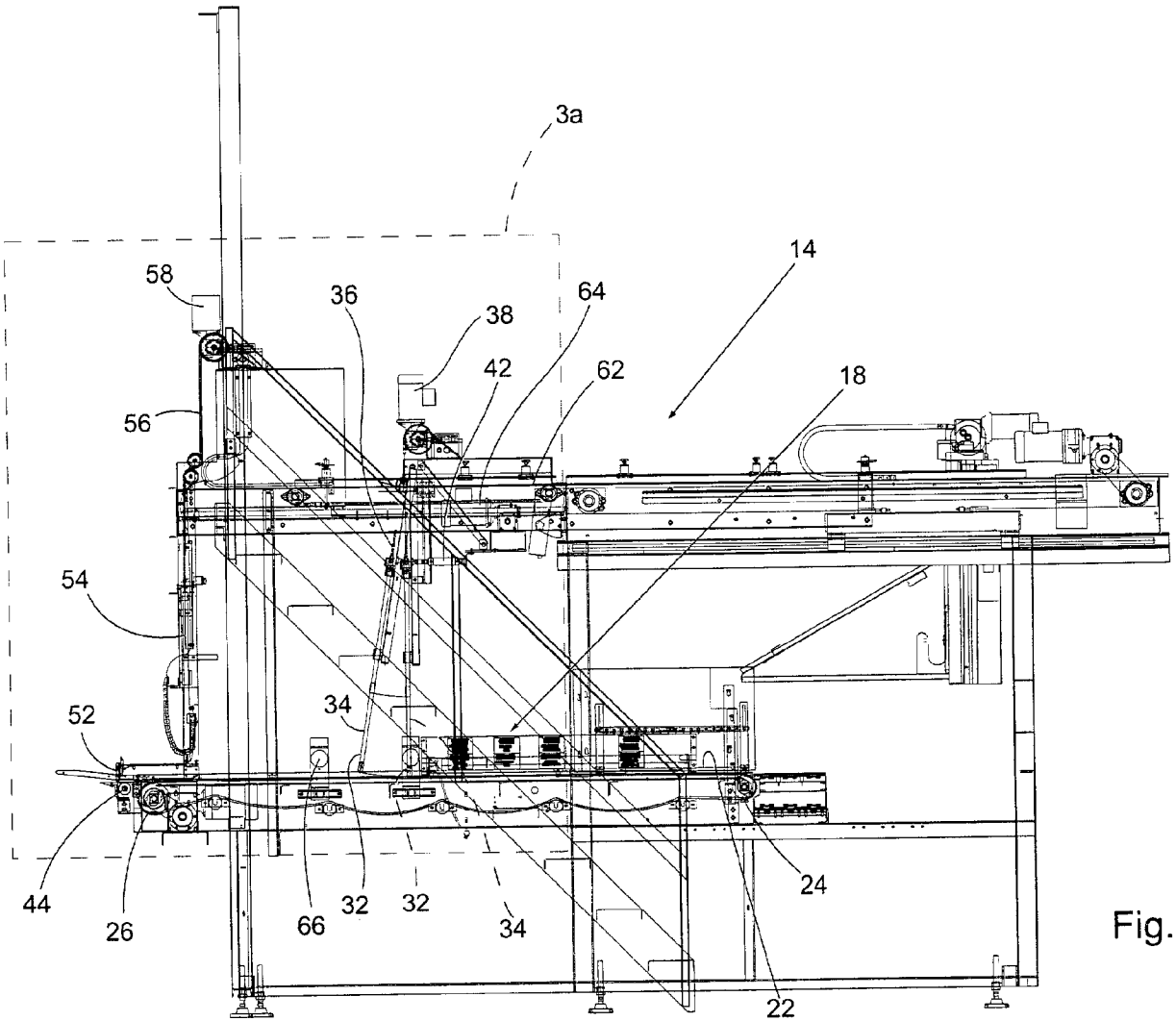
FIG. 3 is a side elevation view of the infeed conveyor section of the conveyor system of FIG. 1.
Figure 3A:
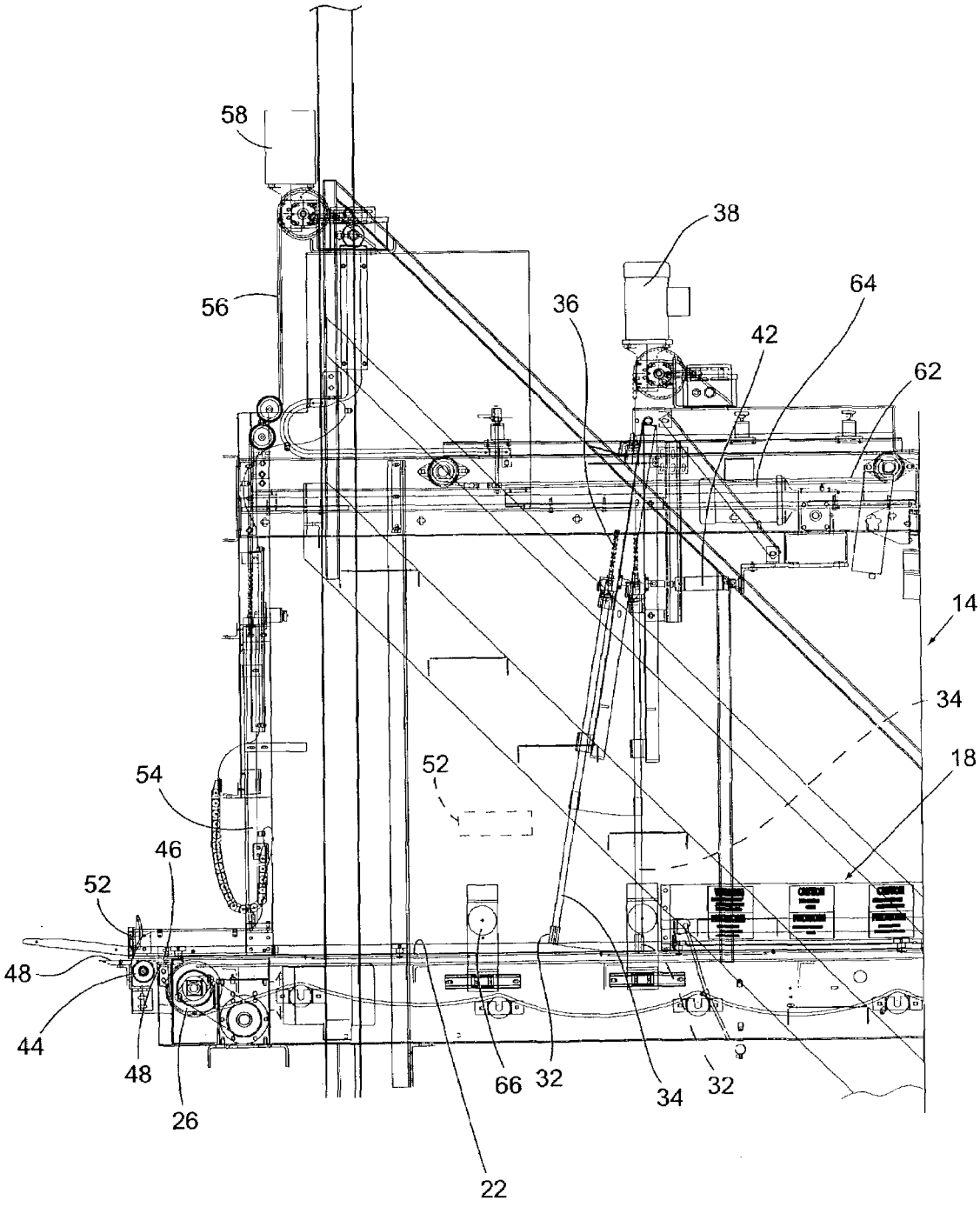
Figure 4:
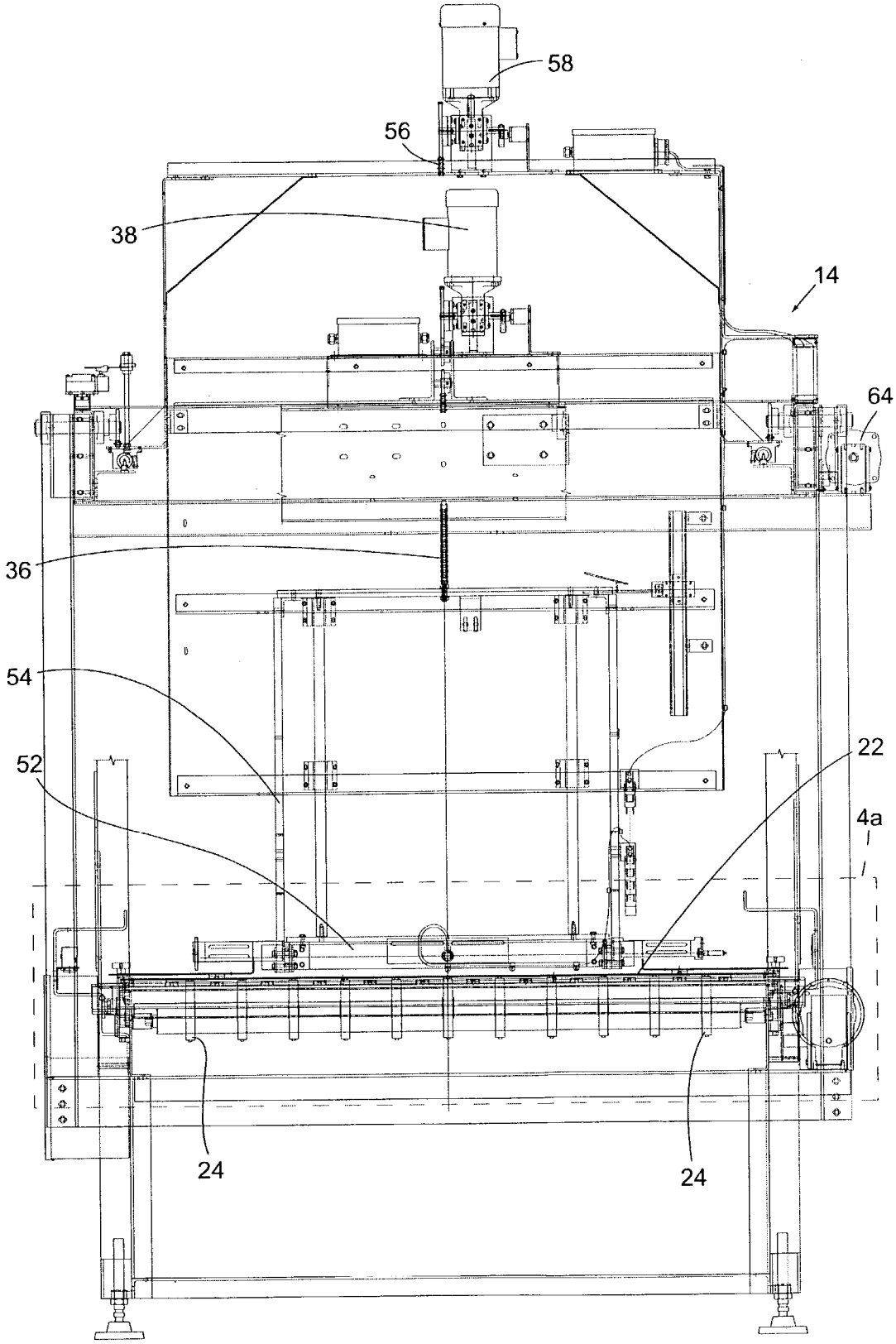
Figure 4A:
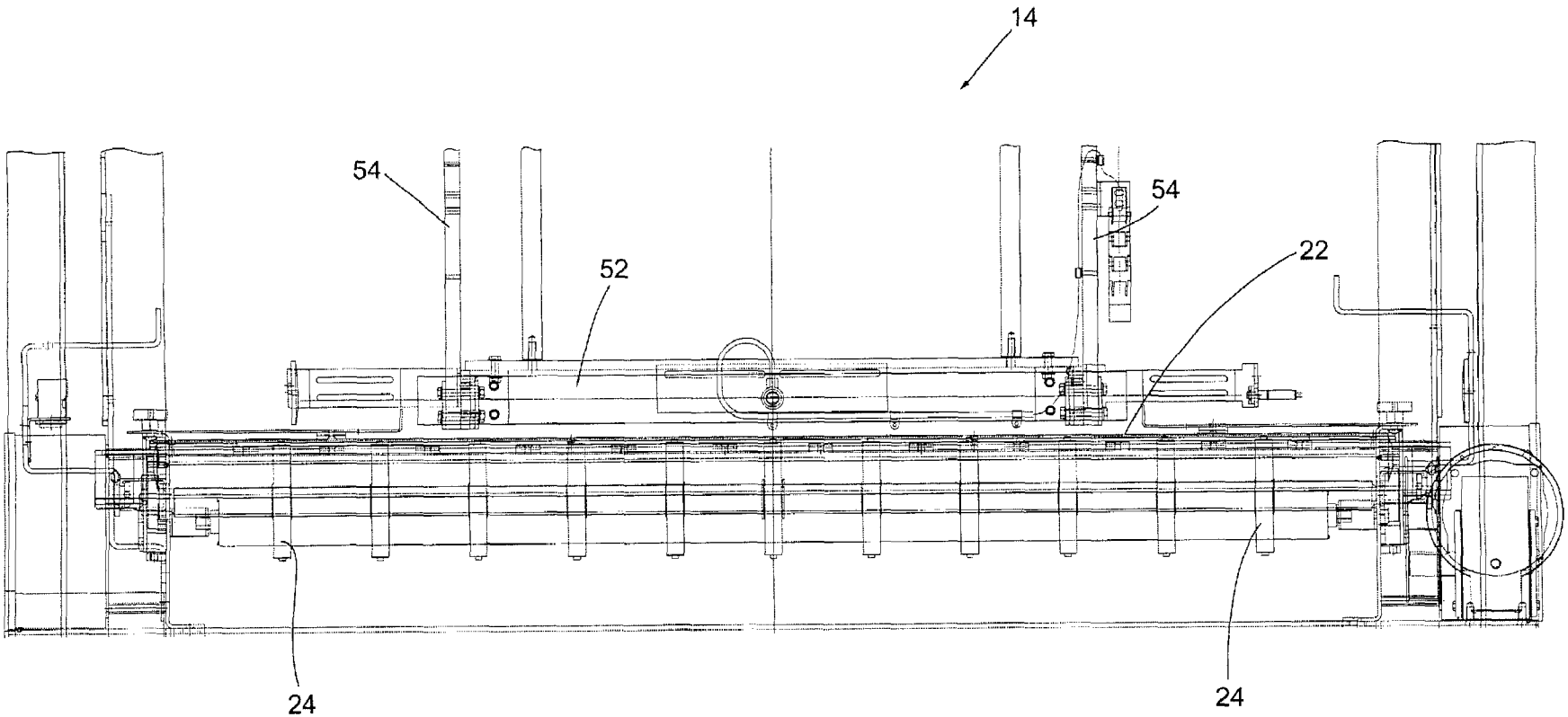
Figure 5:
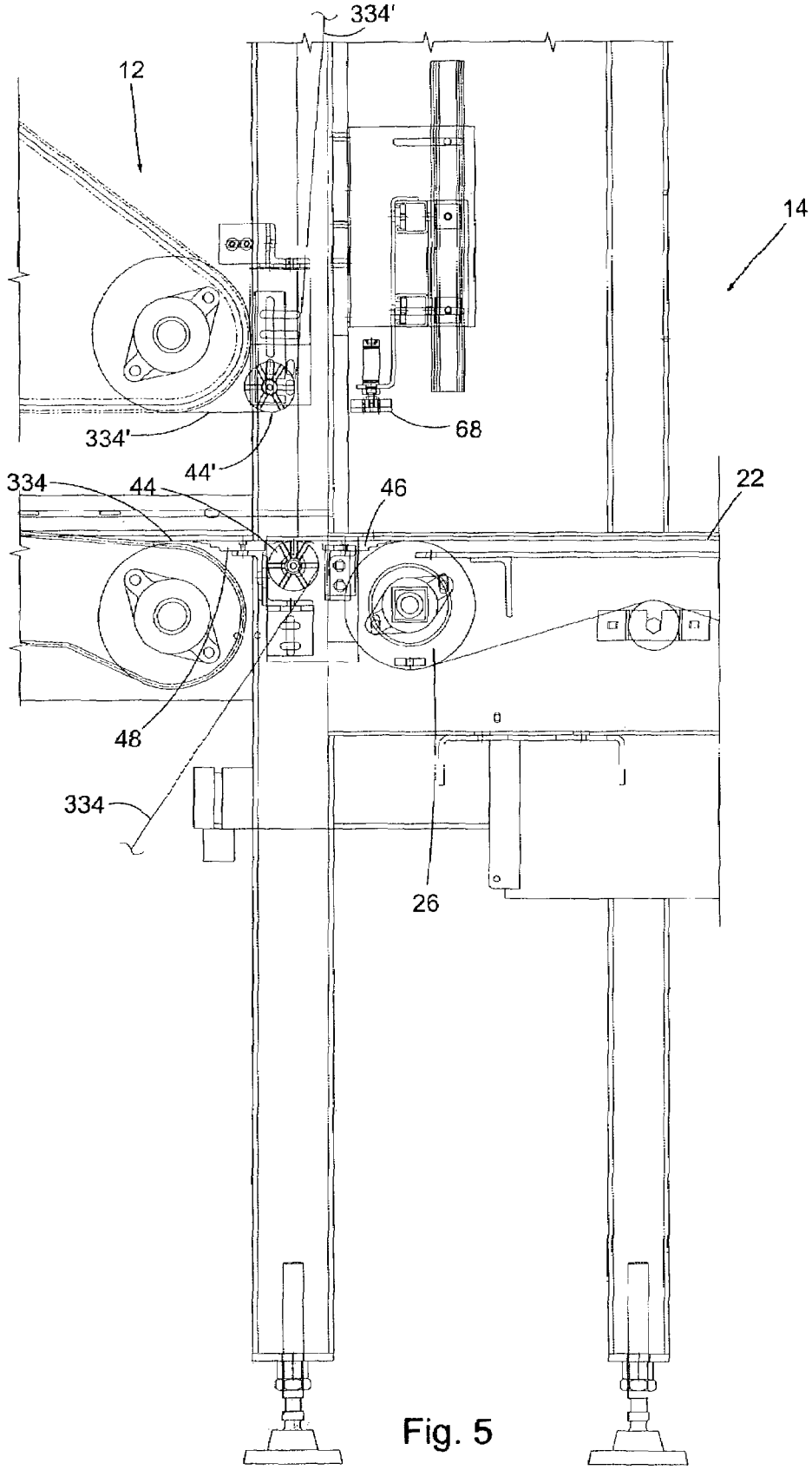
Figure 6:
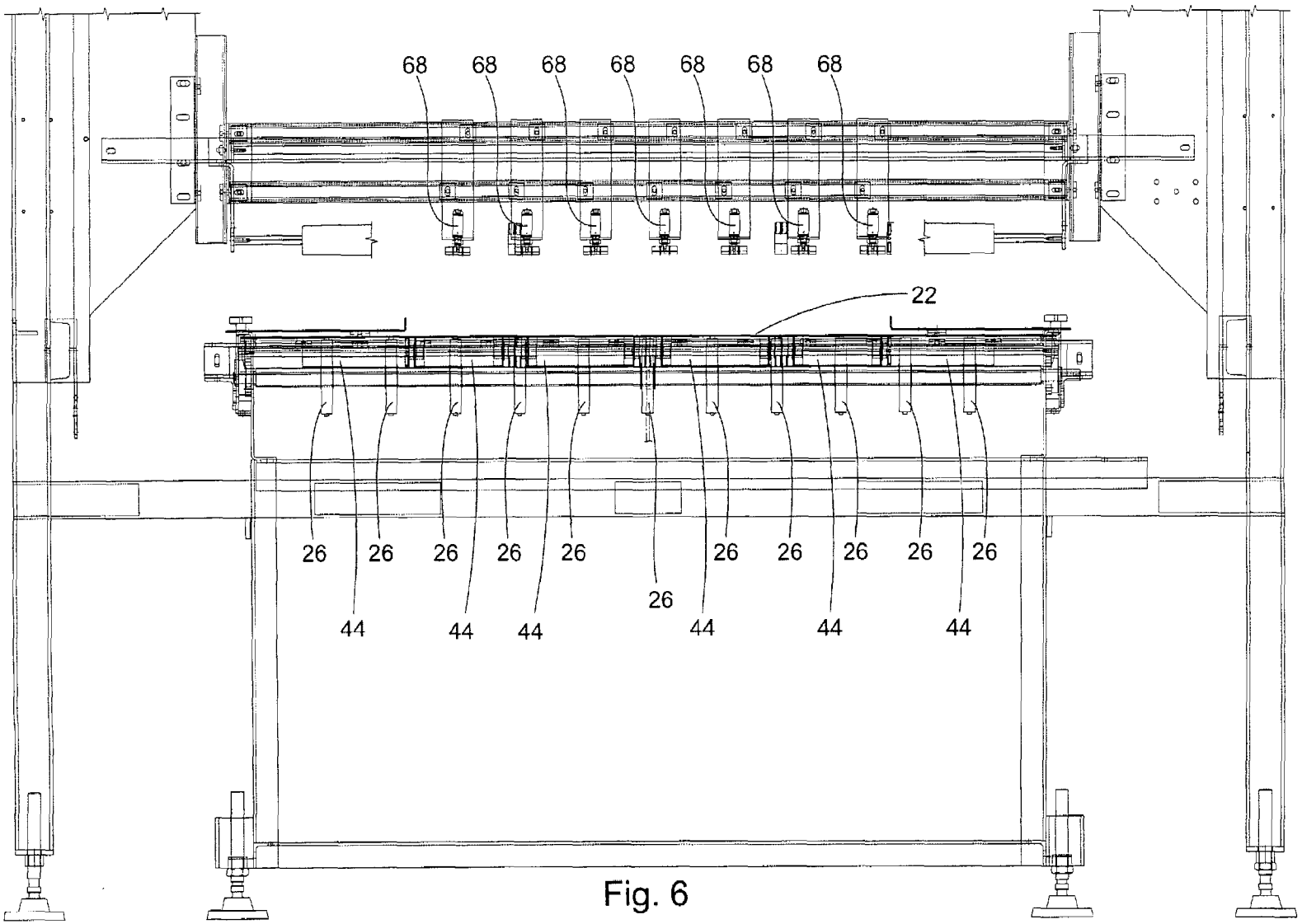
Figure 7:
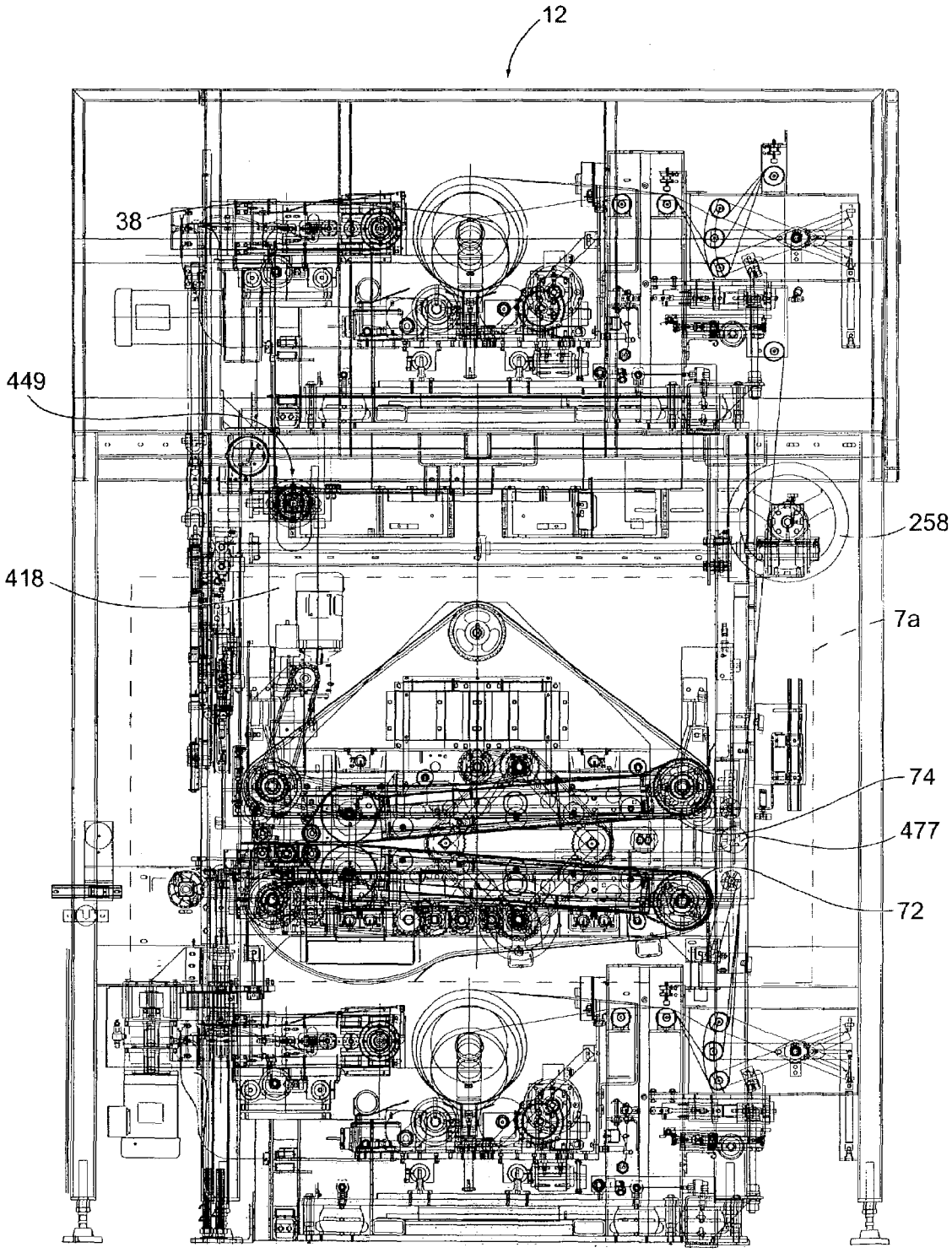
Figure 7A:
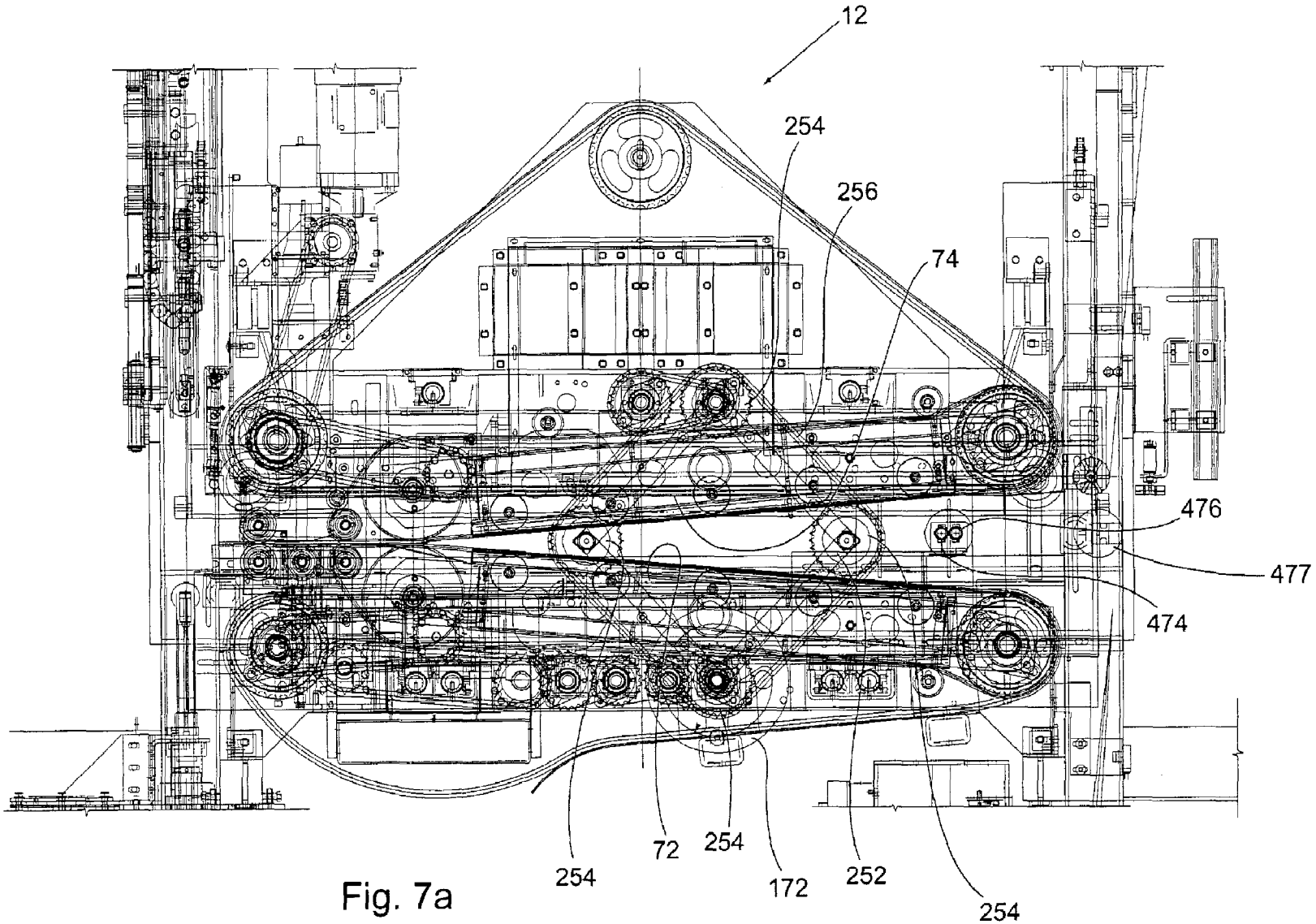
Figure 8:
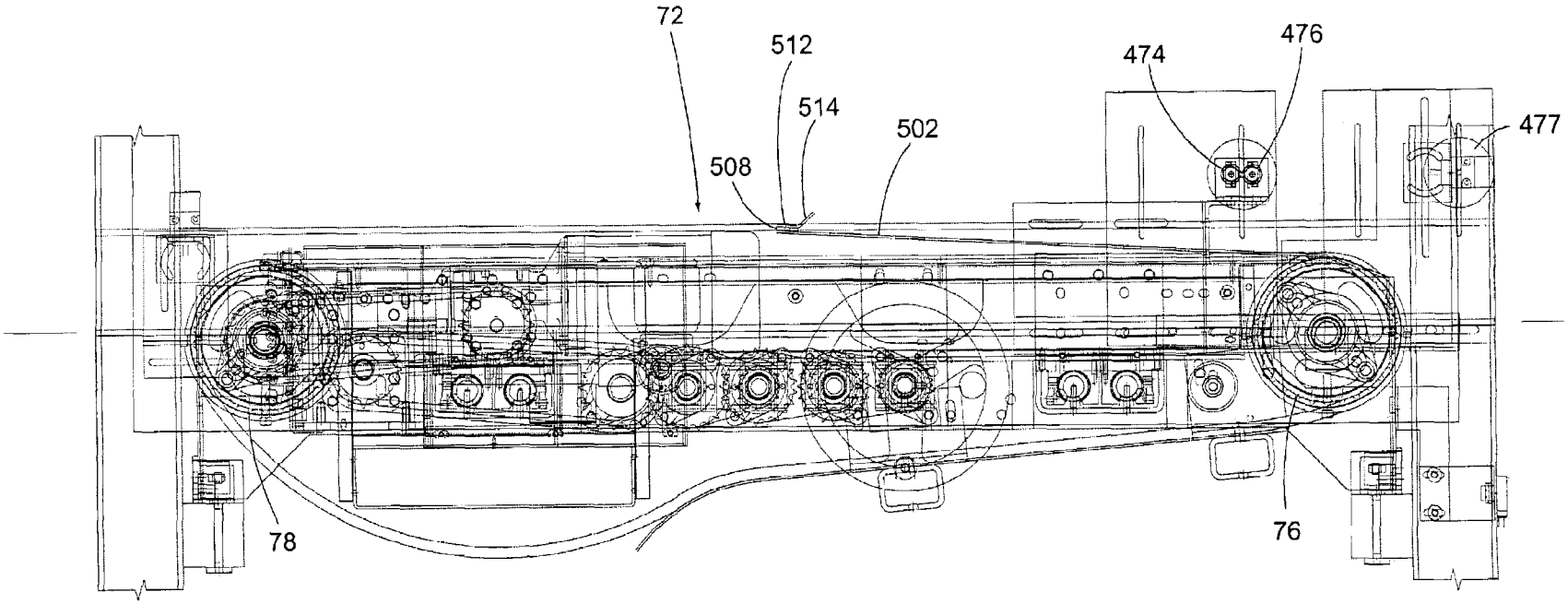
Figure 9:
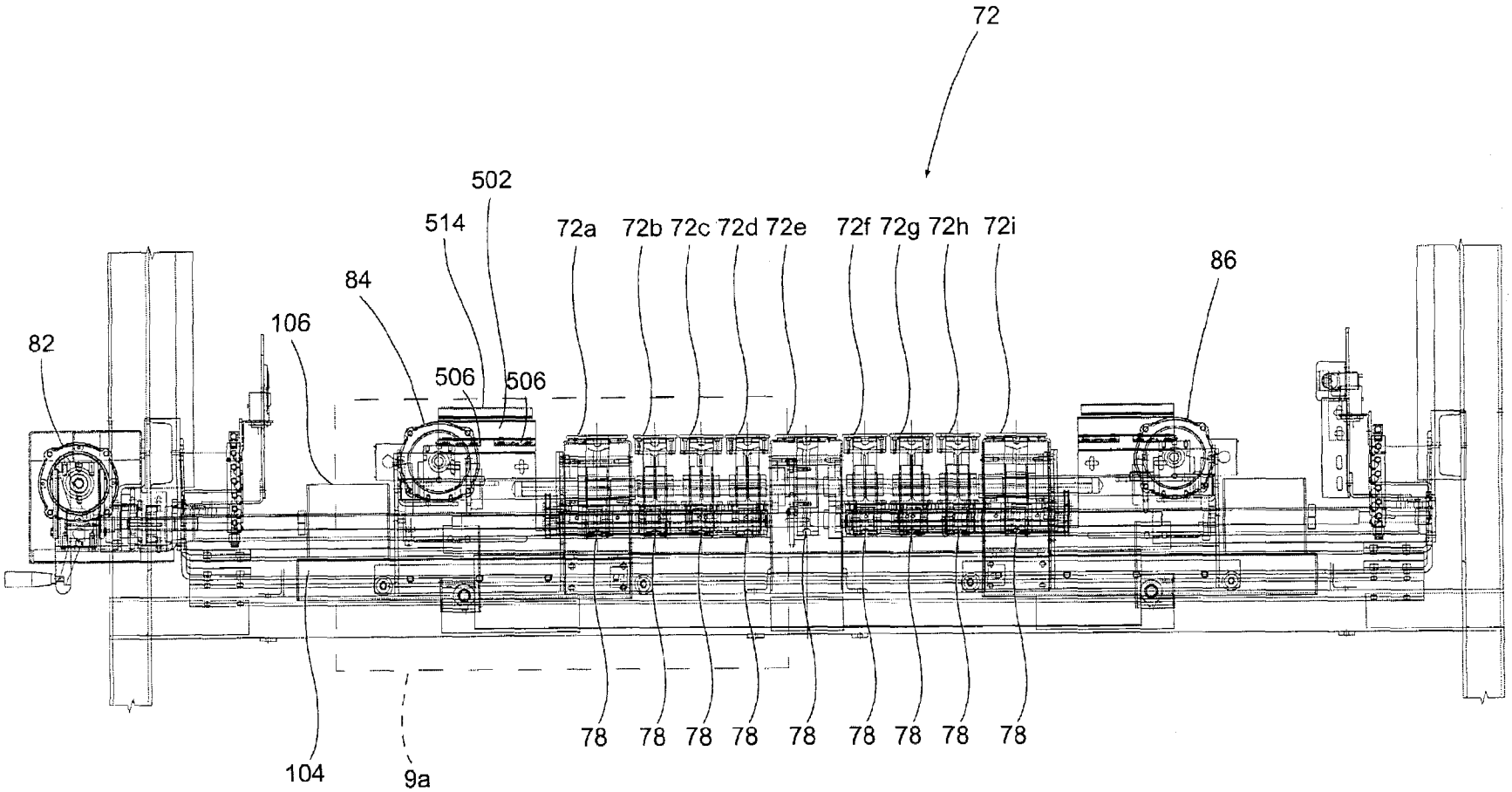
Figure 9A:
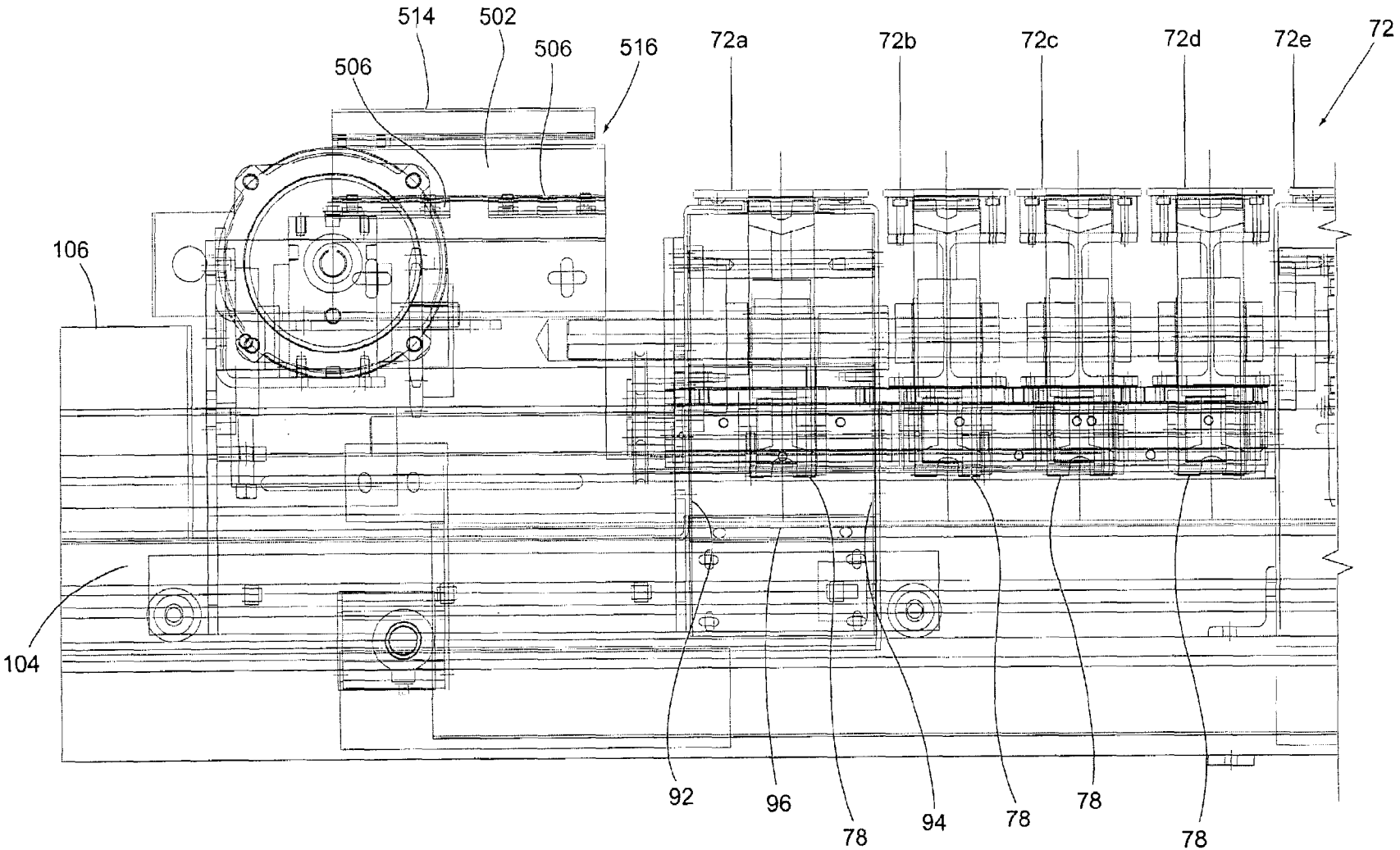
Figure 10:
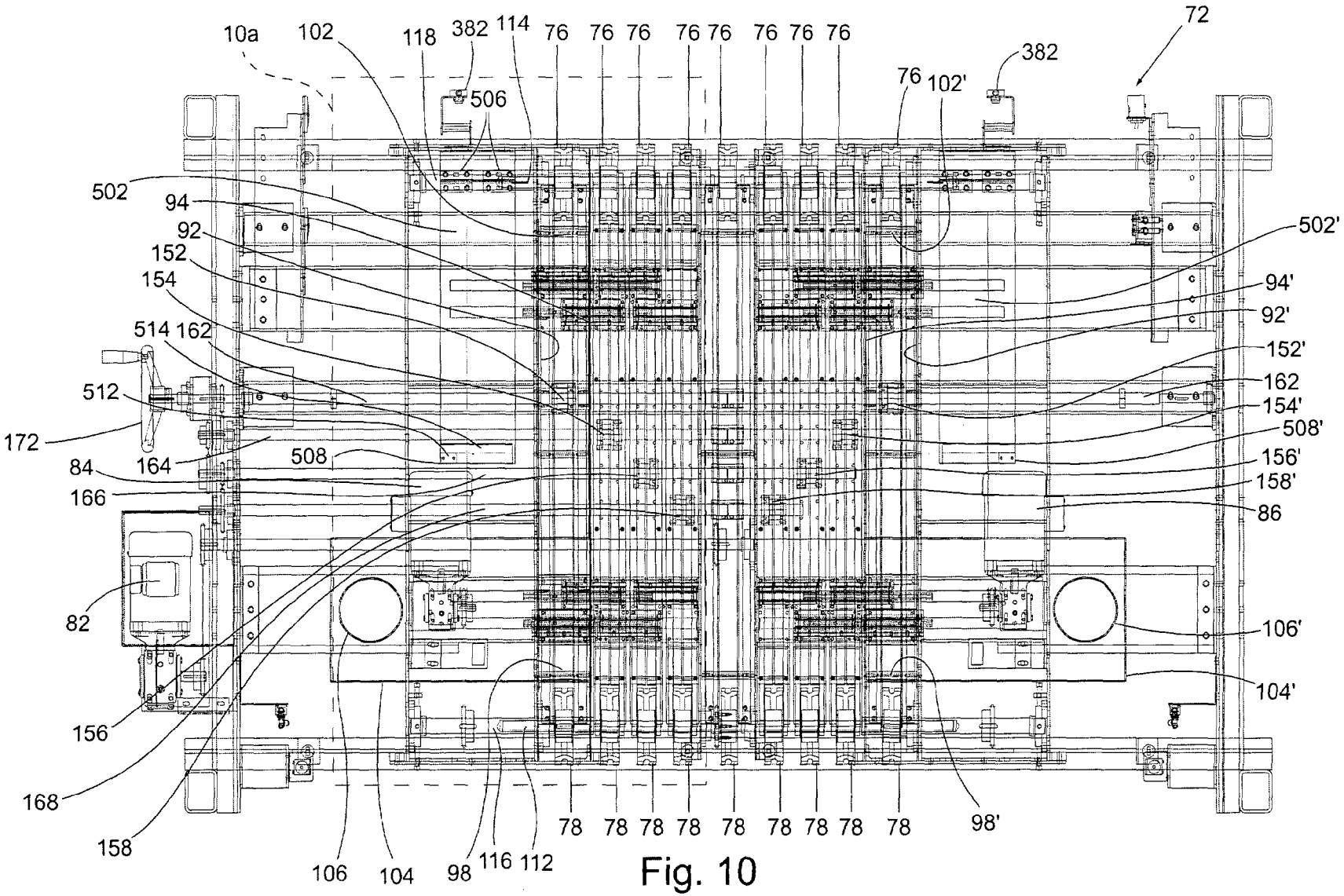
Figure 10A:
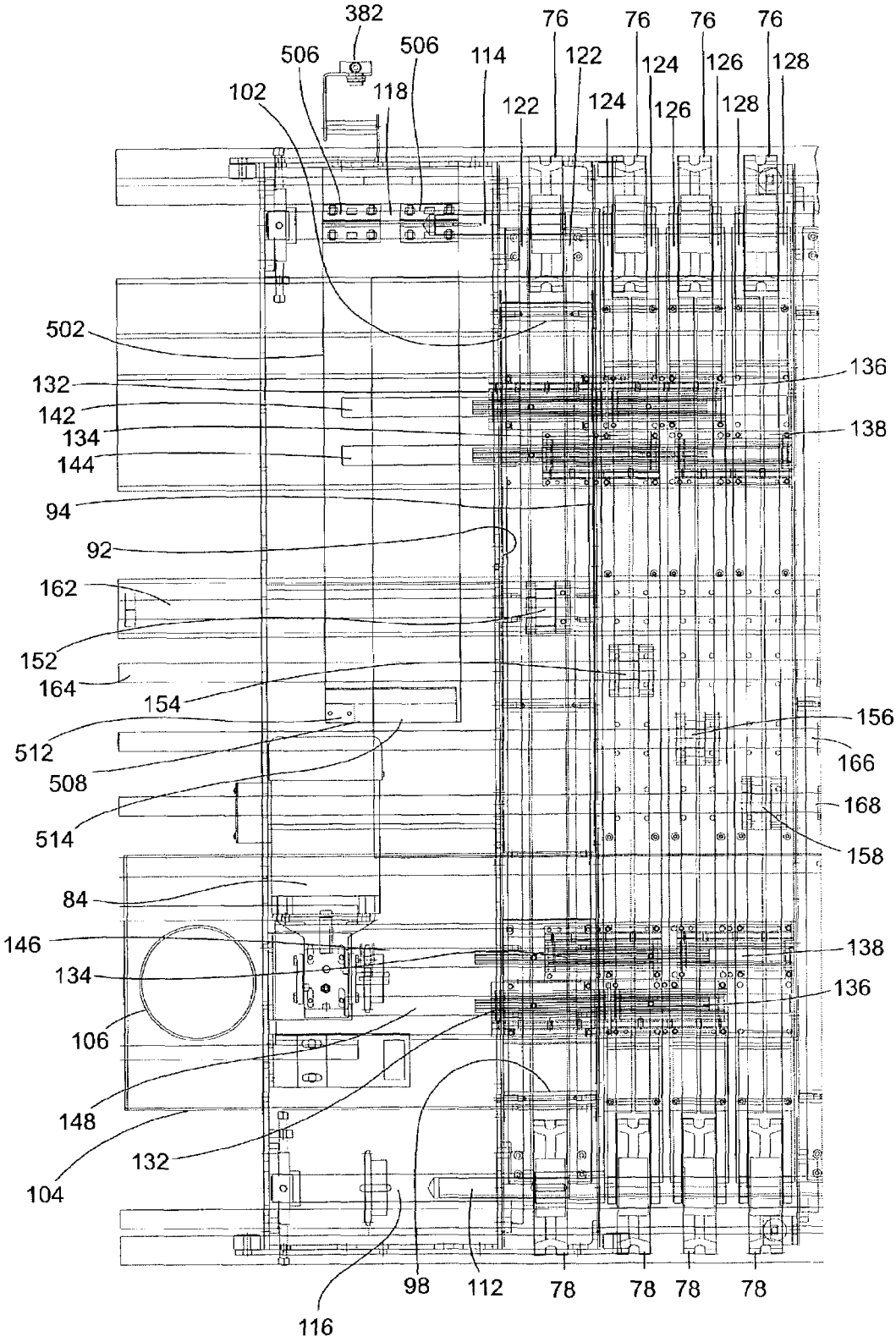
Figure 11:
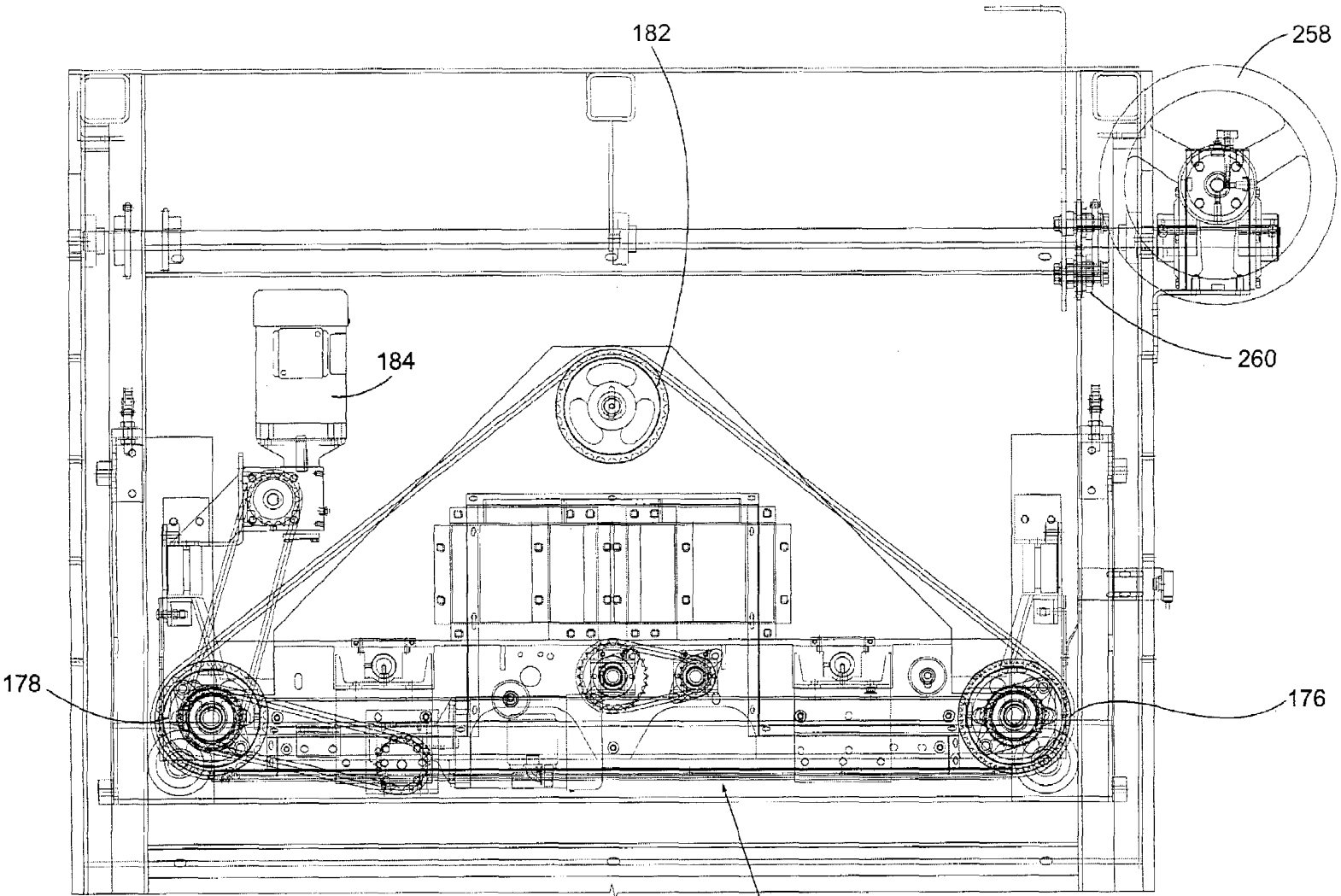
Figure 12:
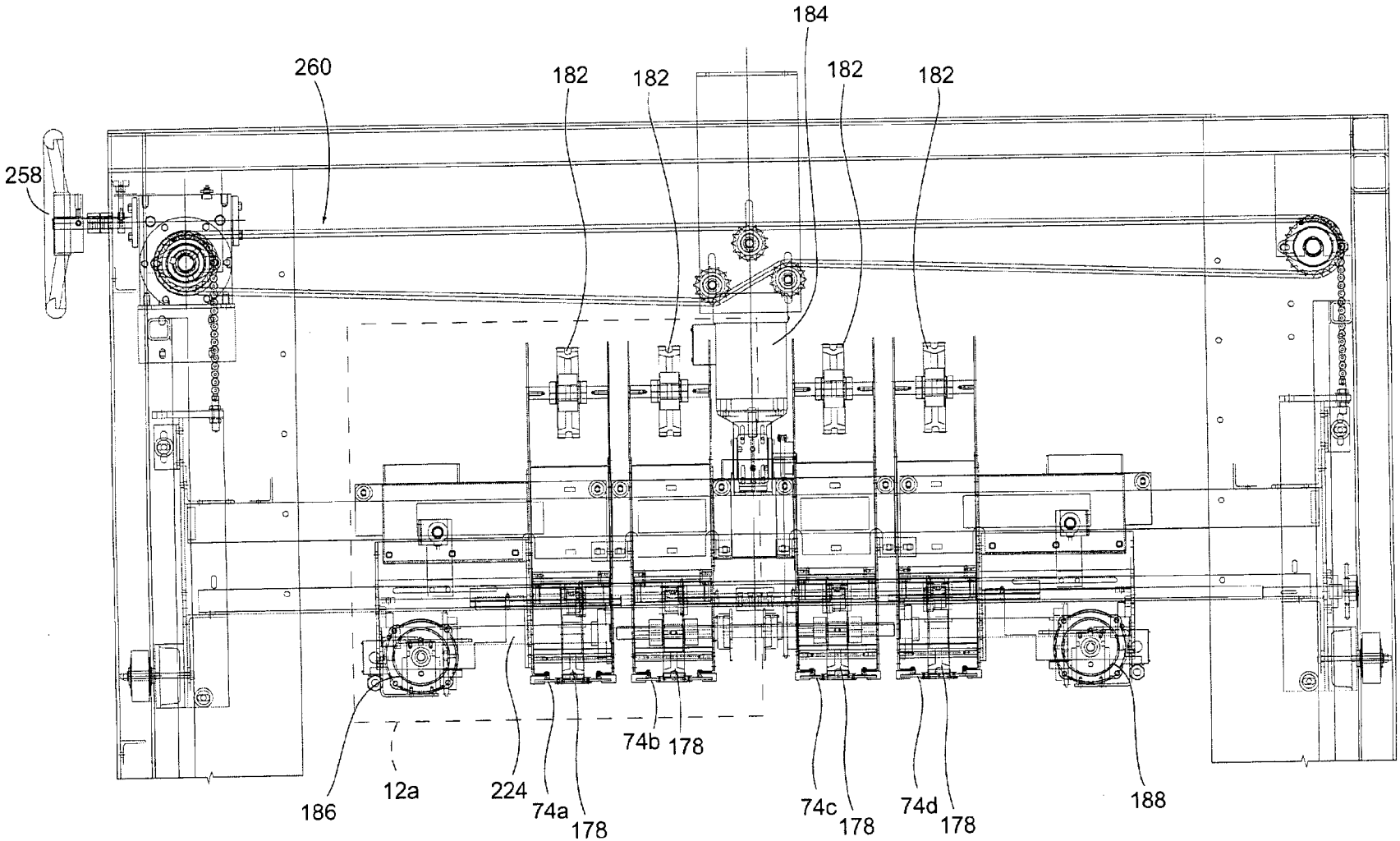
Figure 12A:
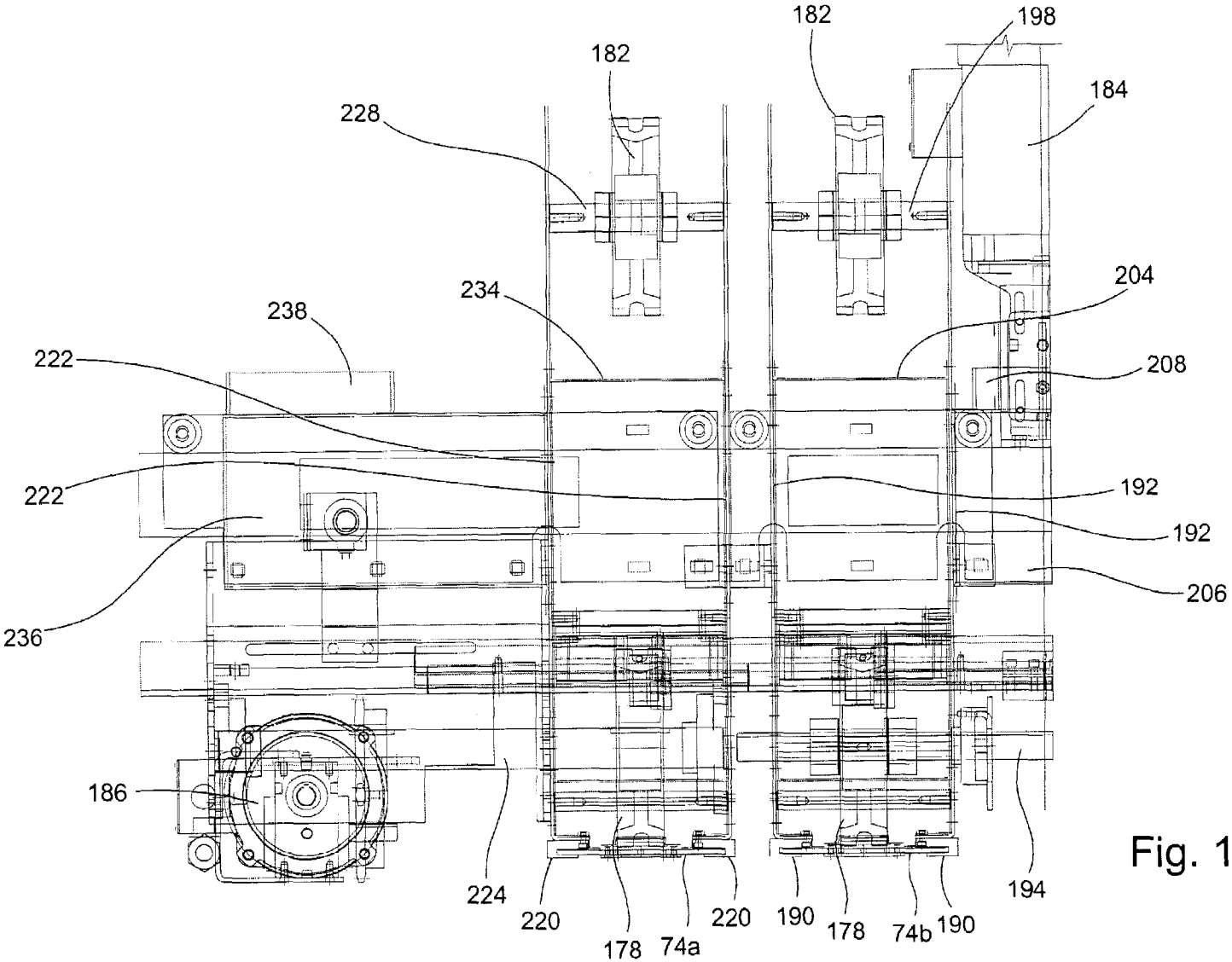
Figure 13:
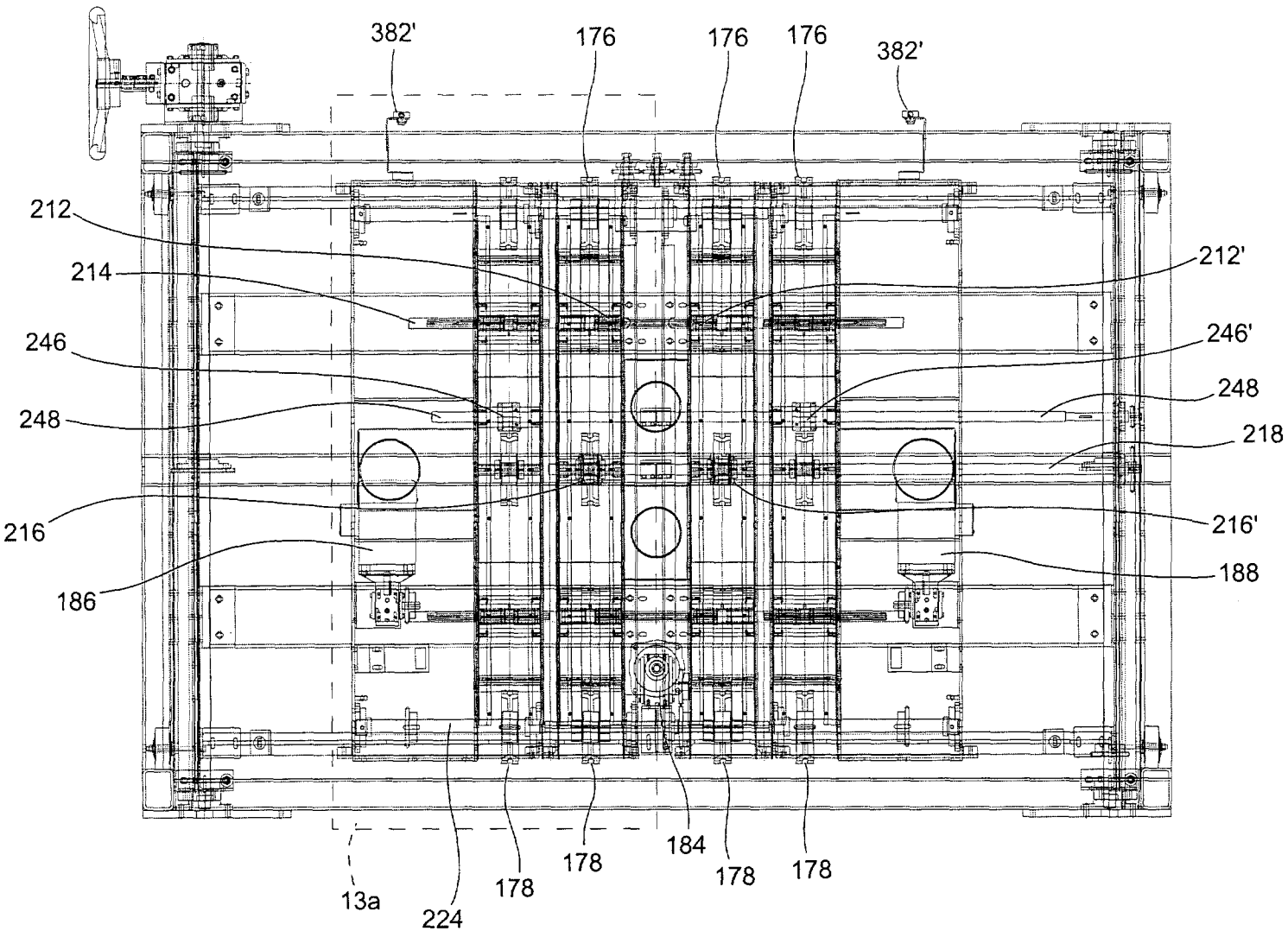
Figure 13A:
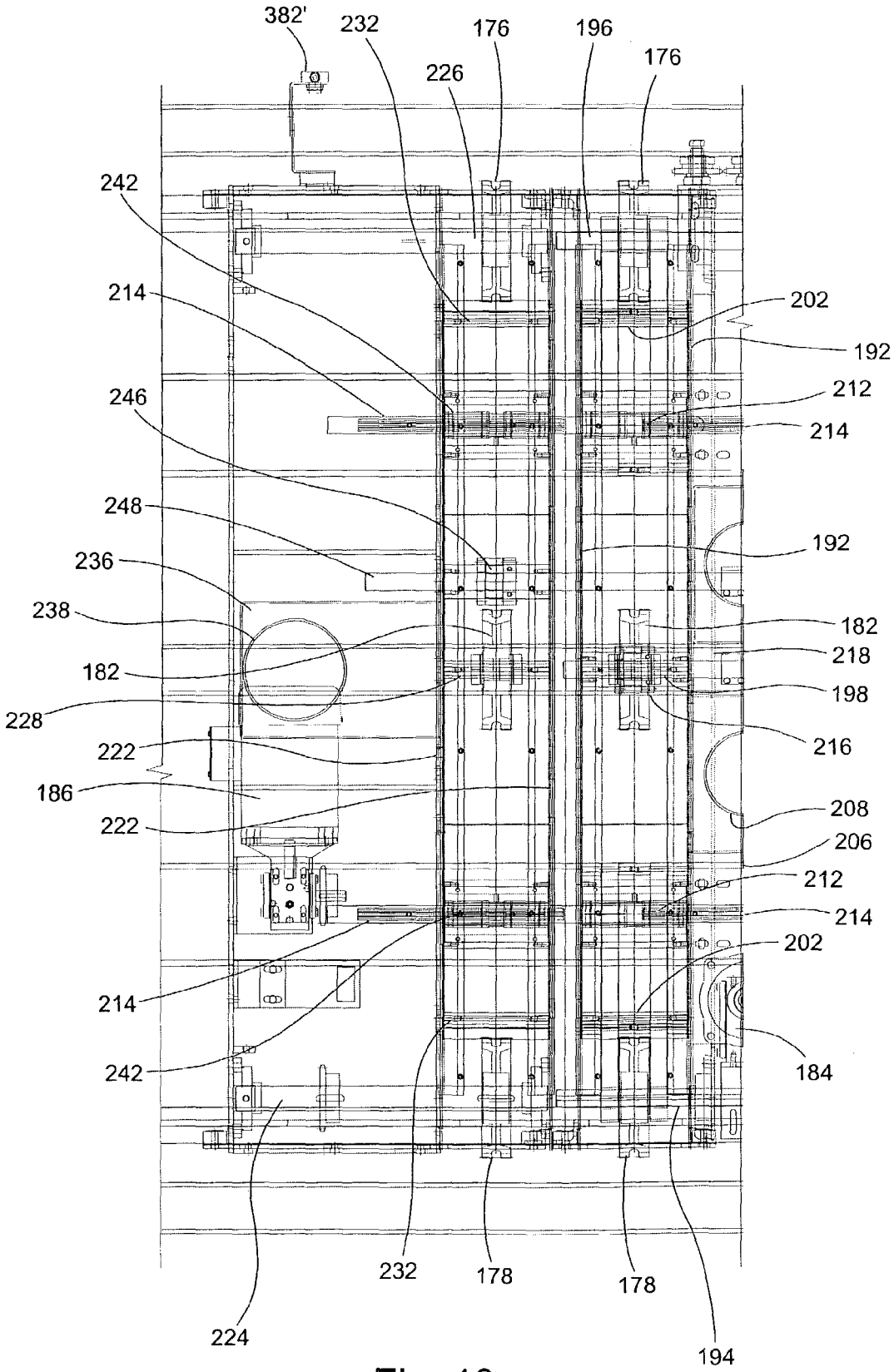
Figure 14:
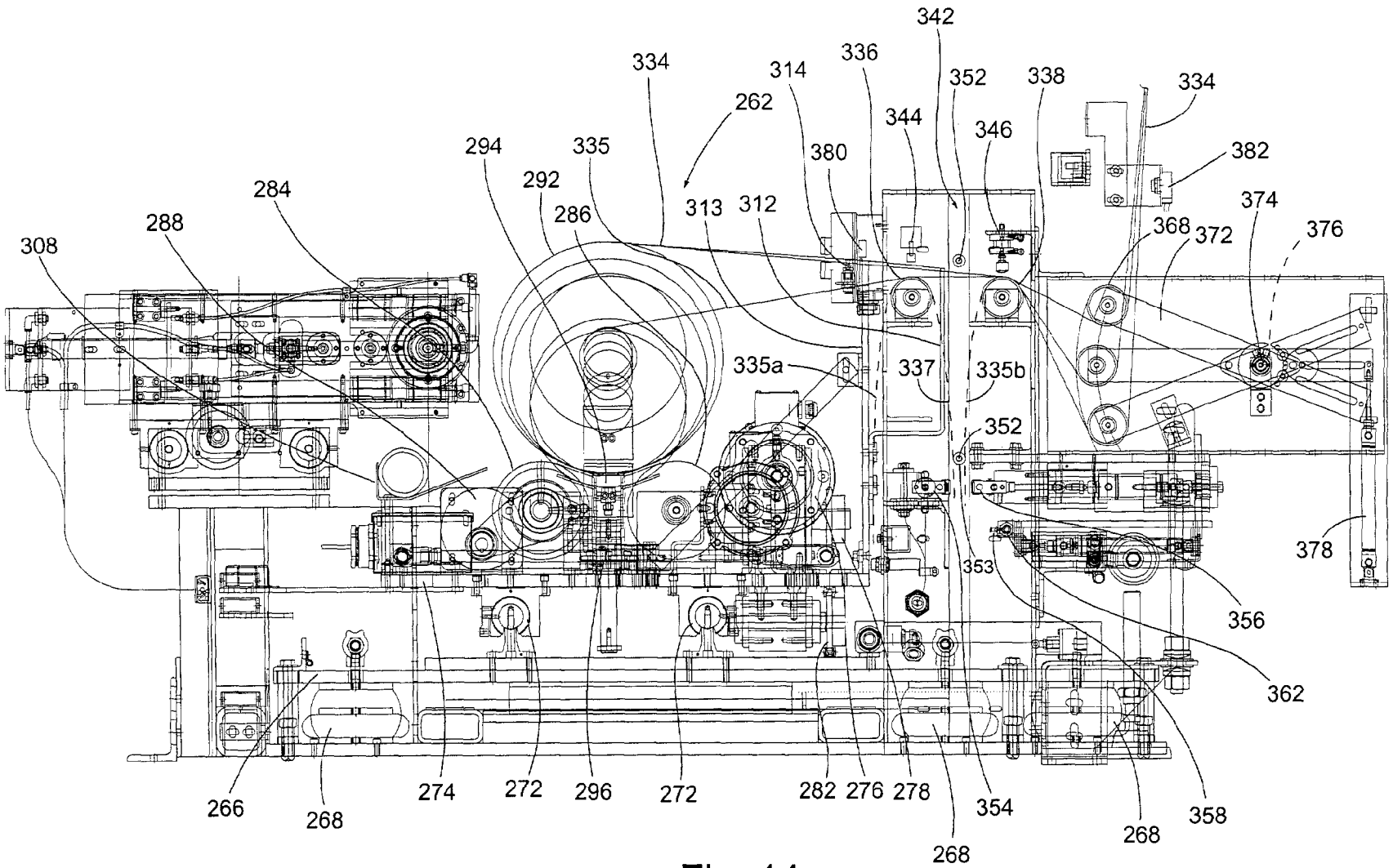
Figure 14A:
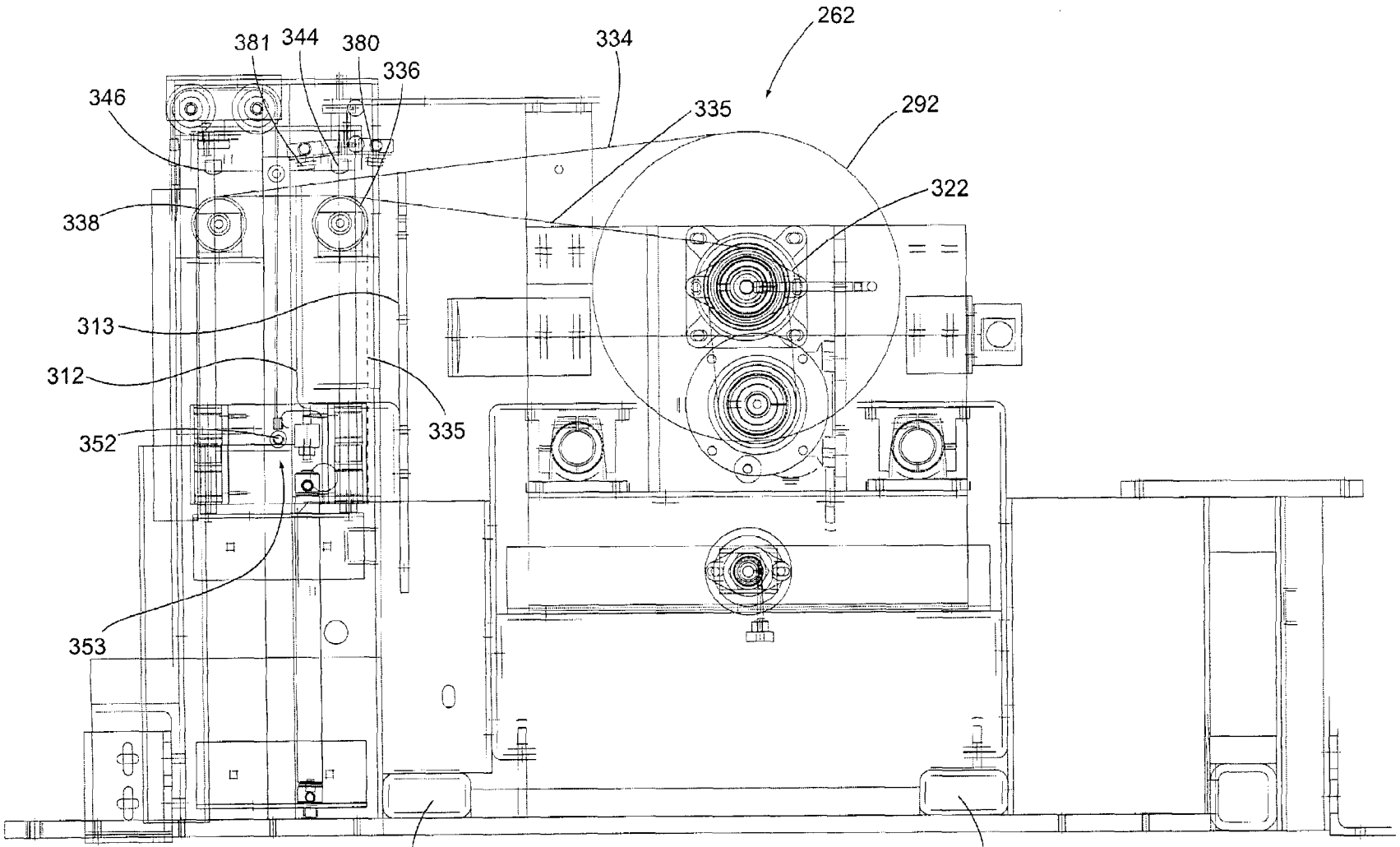

FIG. 3*a* is an enlarged partial view of the segment of the infeed conveyor shown in the dashed line rectangle of FIG. 3;

FIG. 4 is an end elevation view of the infeed conveyor of FIG. 3;

FIG. 4*a* is an enlarged partial view of the portion of the infeed conveyor shown in the dashed line rectangle of FIG. 4;

FIG. 5 is a partial side elevation view of the output end of the infeed conveyor and the in-put end of the bagging conveyor;

FIG. 6 is a partial end elevation view of the output end of the infeed conveyor;

FIG. 7 is a side elevation view of the bagging conveyor section of the conveyor system;

FIG. 7*a* is an enlarged partial view of the portion of the bagging conveyor shown in the dashed line rectangle of FIG. 7;

FIG. 8 is a partial side elevation view of the bottom conveyor of the bagging conveyor of FIG. 7;

FIG. 9 is a partial end elevation view of the bottom conveyor of FIG. 8;

FIG. 9*a* is a partial enlarged view of the portion of the bottom conveyor shown in the dashed line rectangle of FIG. 9;

FIG. 10 is a plan view of the bottom conveyor of FIG. 8;

FIG. 10*a* is a partial enlarged view of the section of the bottom conveyor shown in the dashed line rectangle of FIG. 10;

FIG. 11 is a partial side elevation view of the top conveyor of the bagging conveyor;

FIG. 12 is a partial end elevation view of the top conveyor of FIG. 11;

FIG. 12*a* is partial enlarged view of the portion of the top conveyor shown in the dashed line rectangle of FIG. 12;

FIG. 13 is a planned view of the top conveyor of the bagging conveyor;

FIG. 13*a* is a partial enlarged view of the portion of the top conveyor shown in the dashed line rectangle of FIG. 13;

FIG. 14 is a side elevation view of the bottom packaging film roll dispenser;

FIG. 14*a* is a partial side evaluation view of the bottom packaging film dispenser showing several details of FIG. 14 from the opposite side of the film dispenser.

Figure 15:
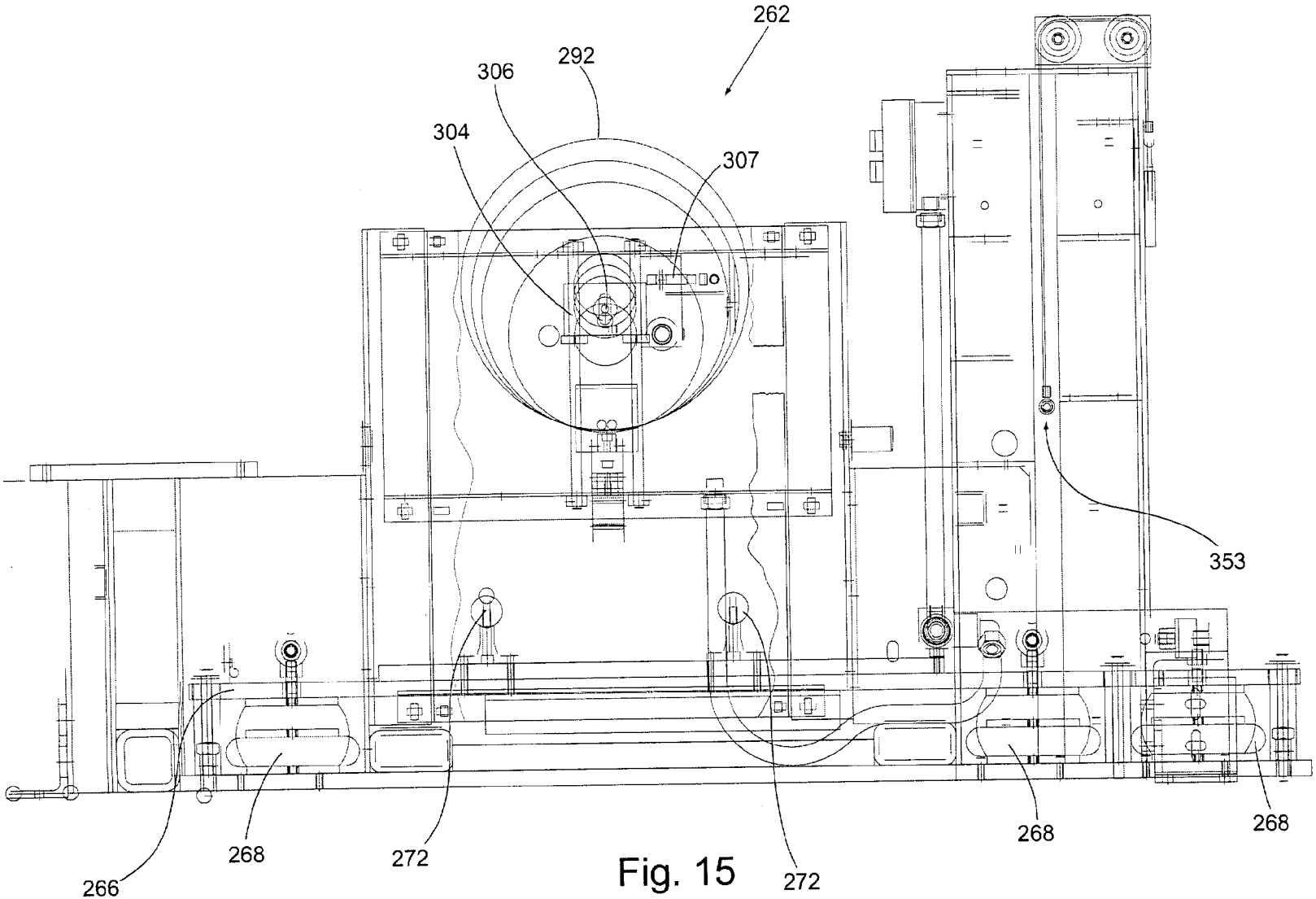
Figure 16:
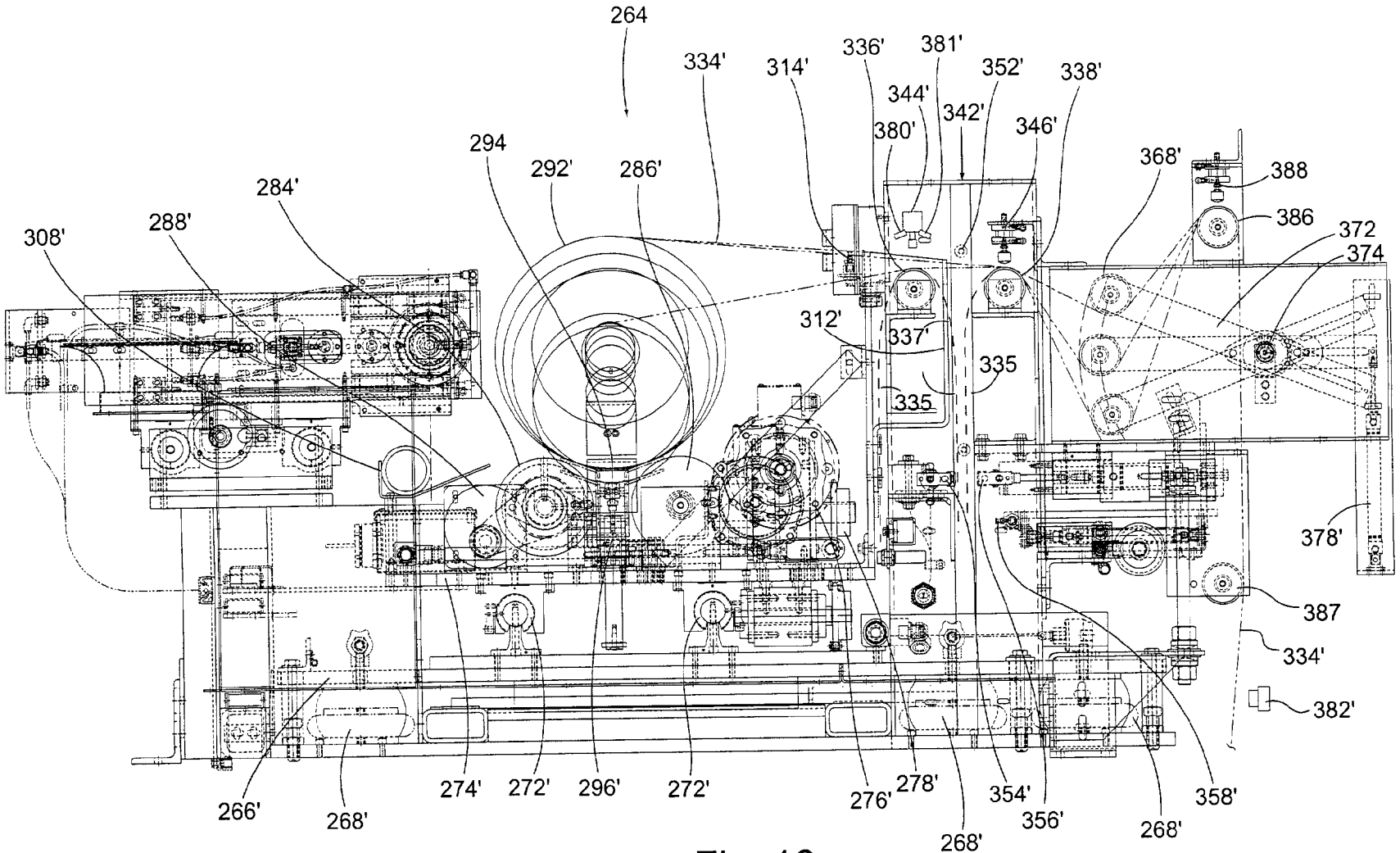
Figure 17:
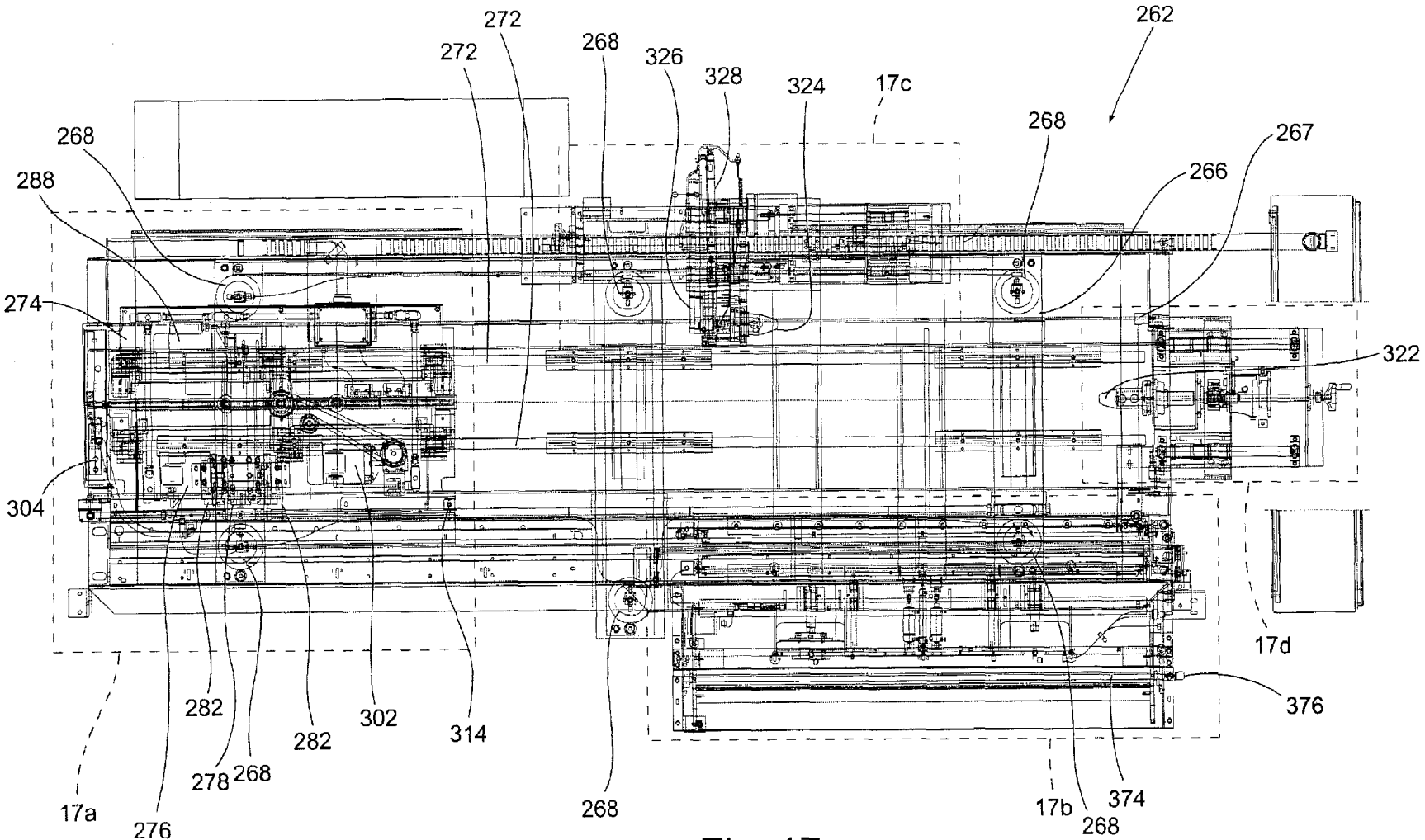
Figure 17A:
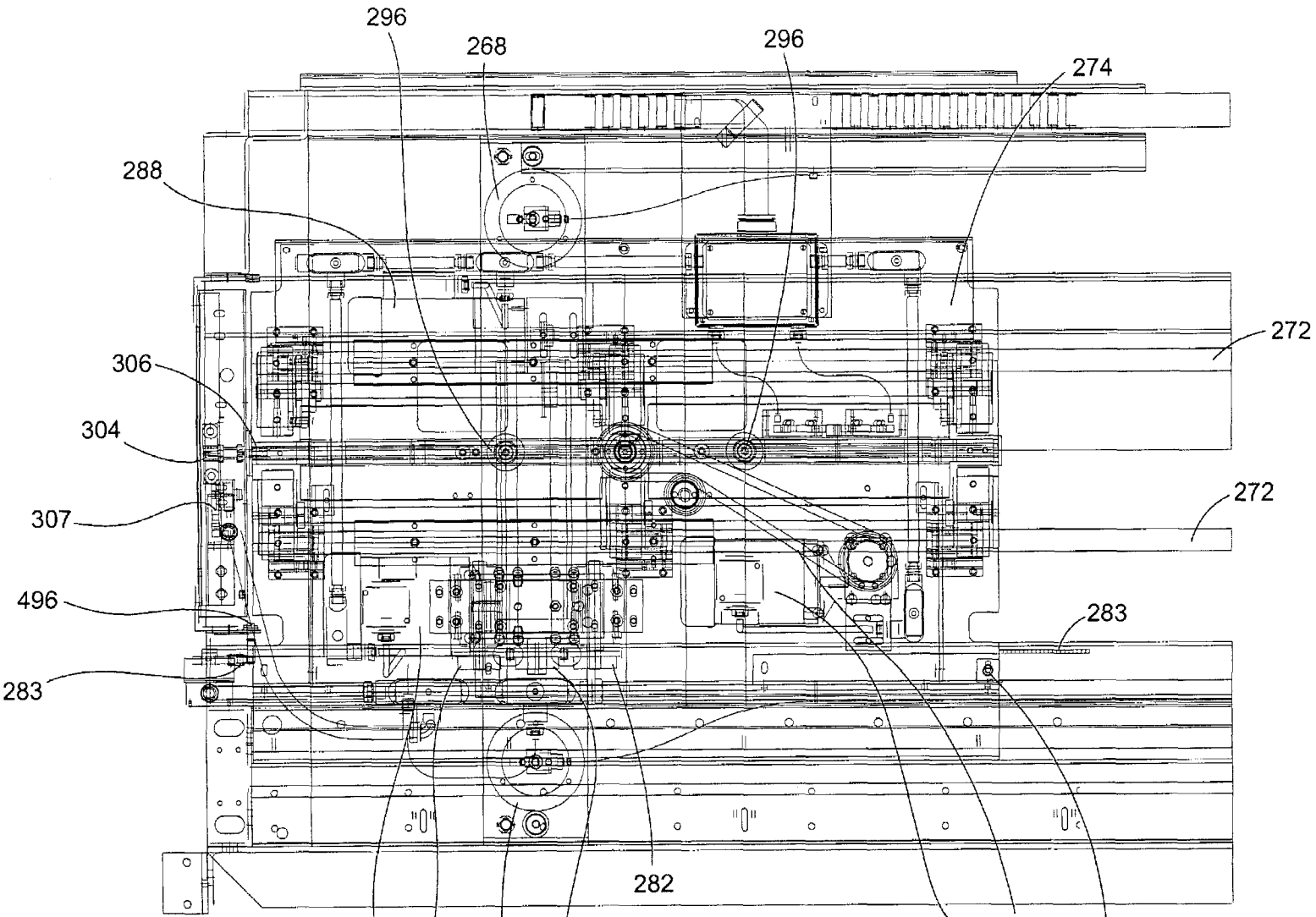
Figure 17B:
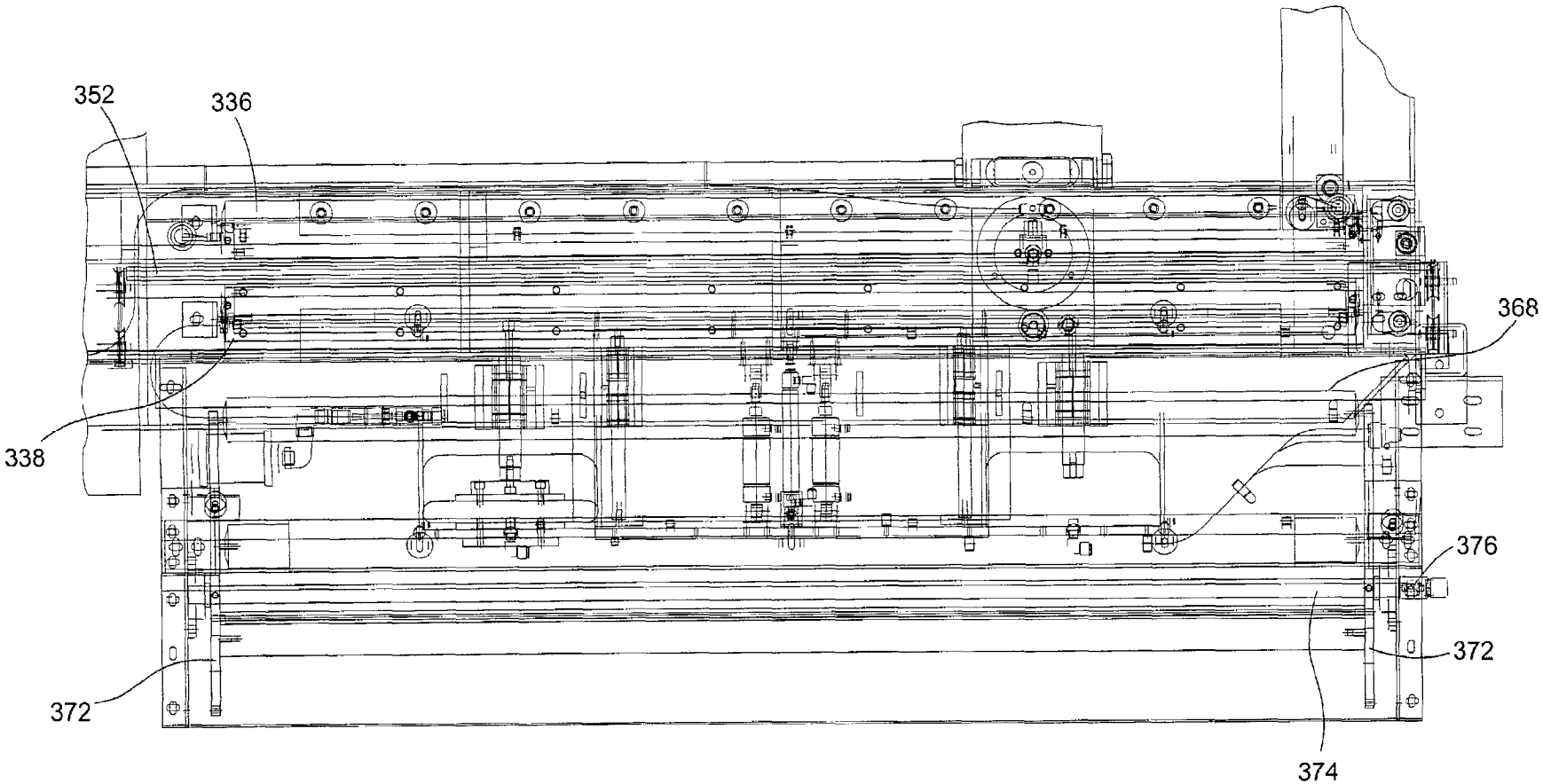
Figure 17C:
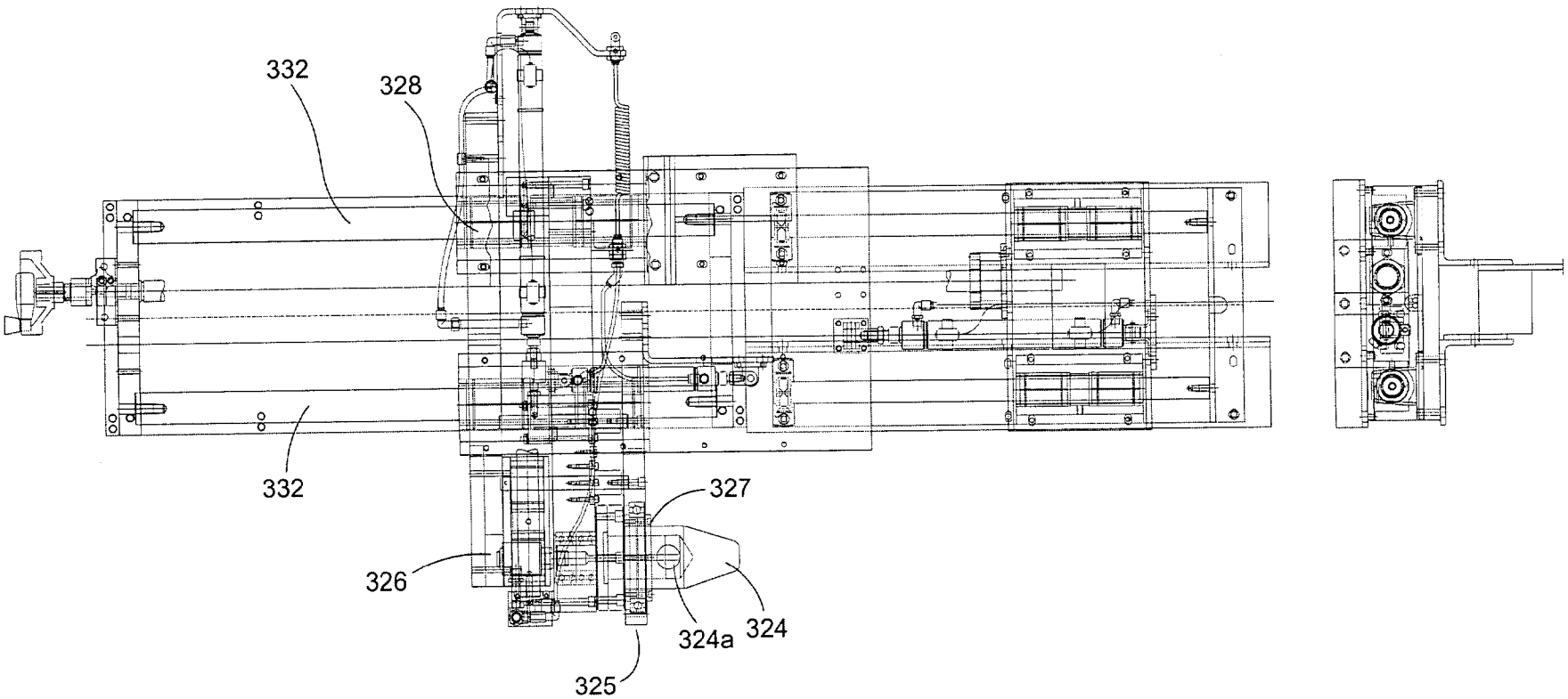
Figure 17D:
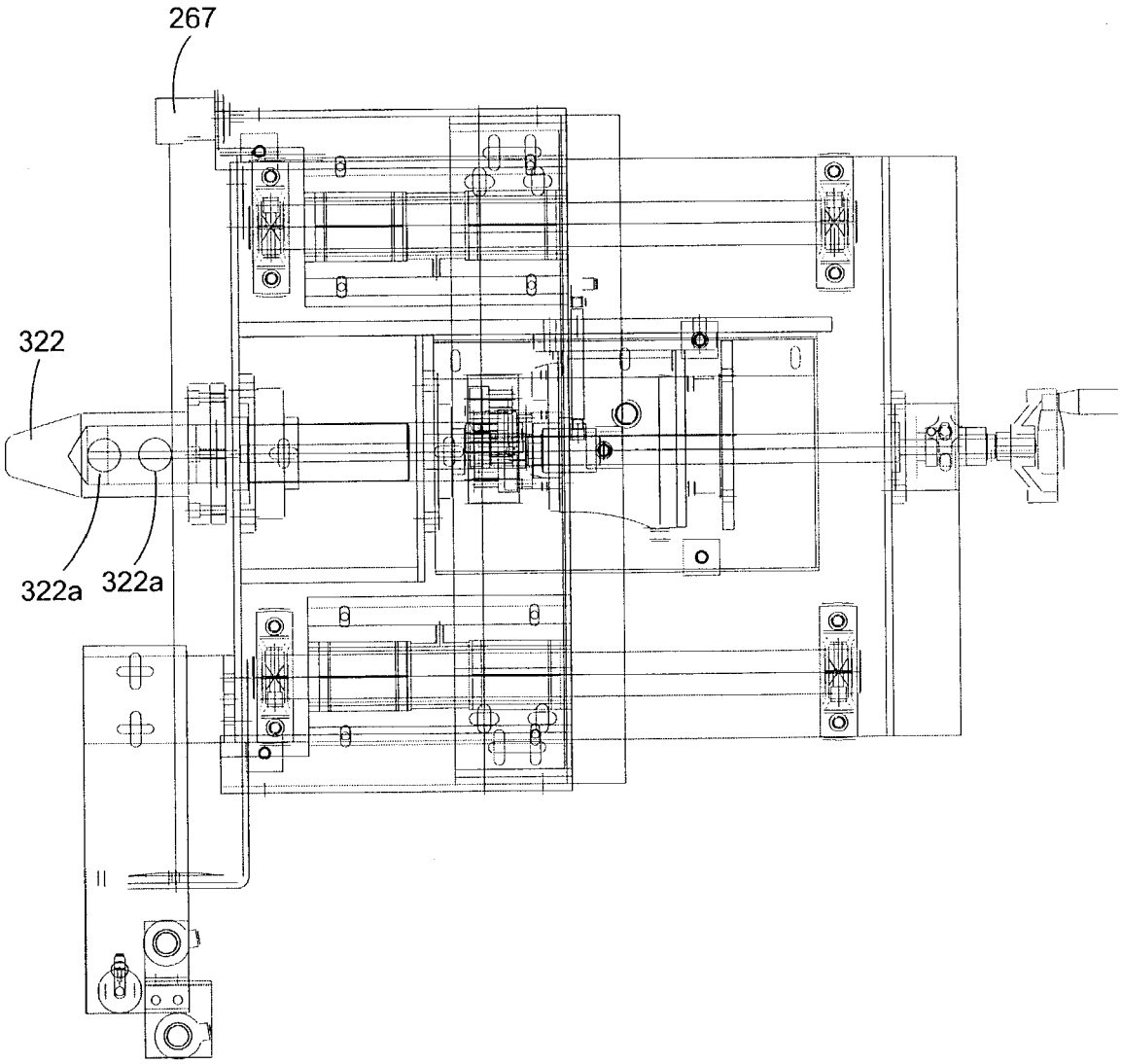
Figure 18:
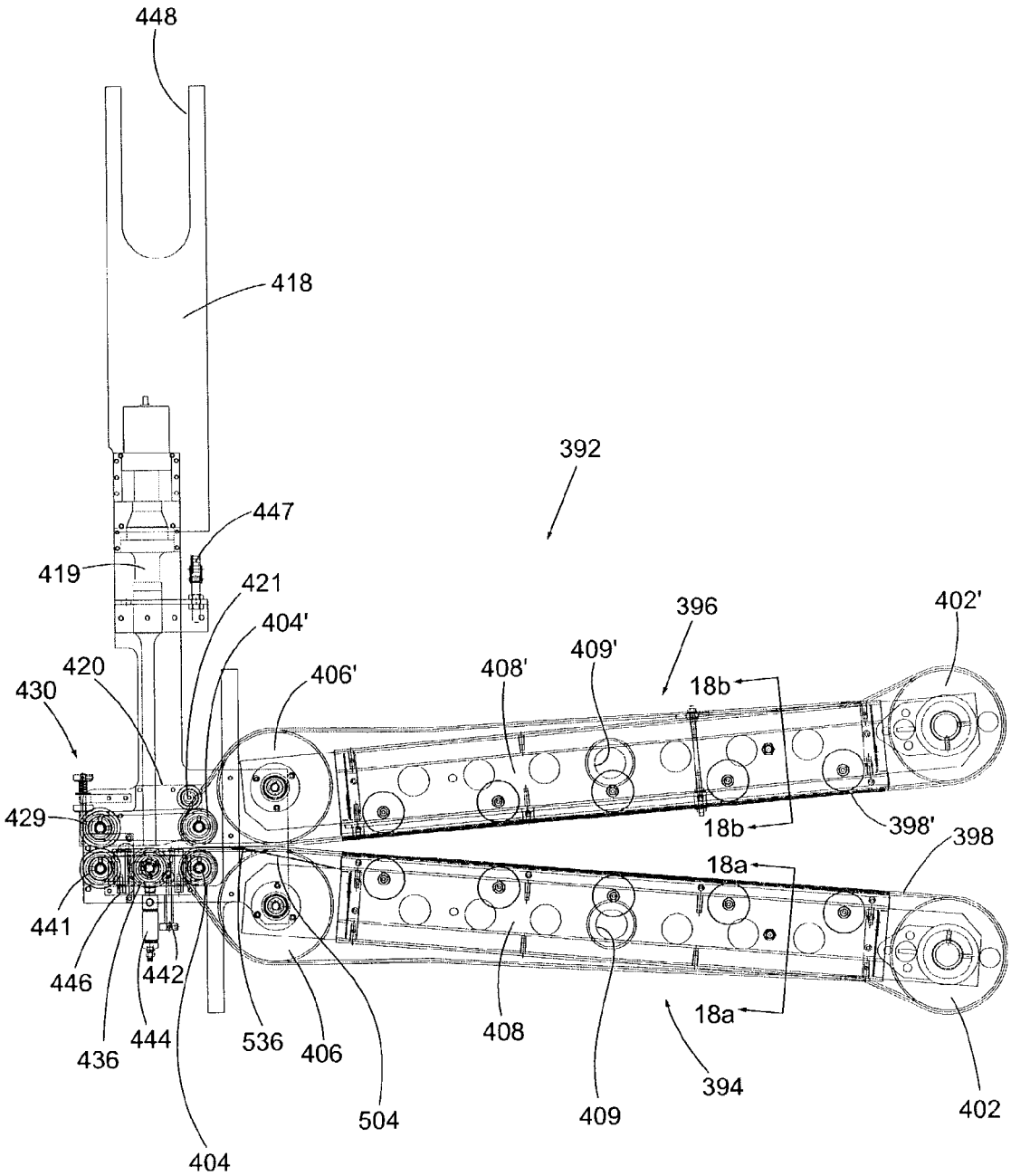
Figure 18B:
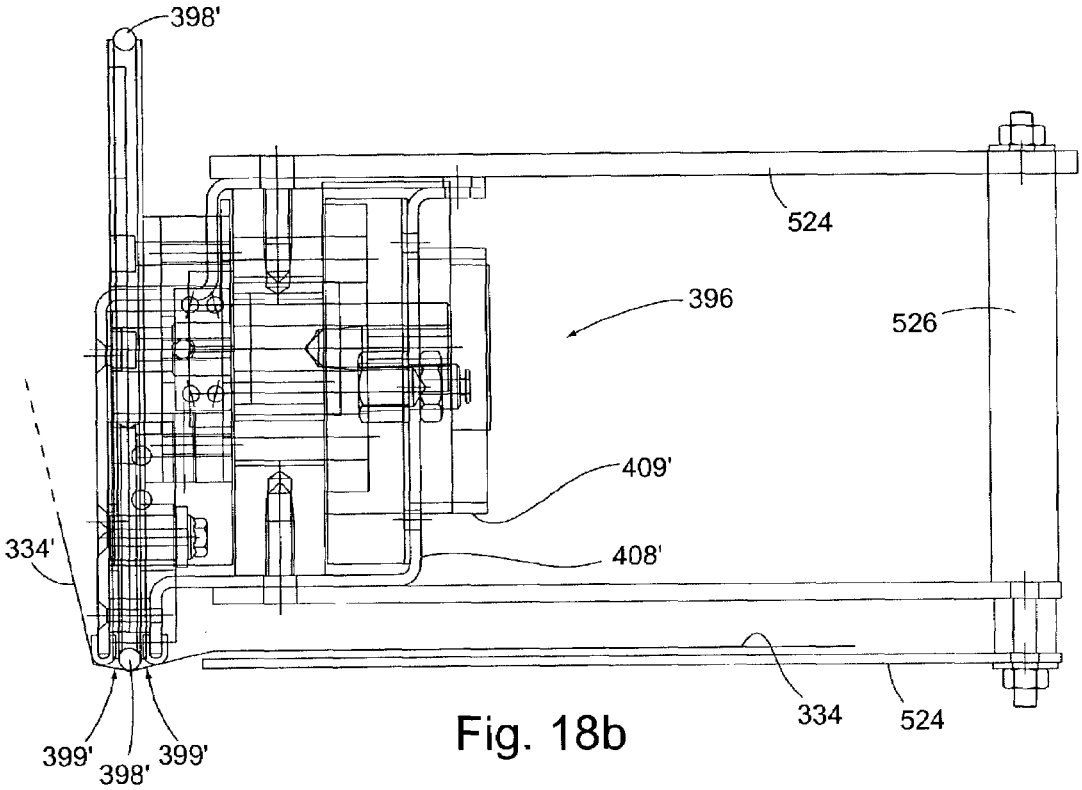
Figure 18A:
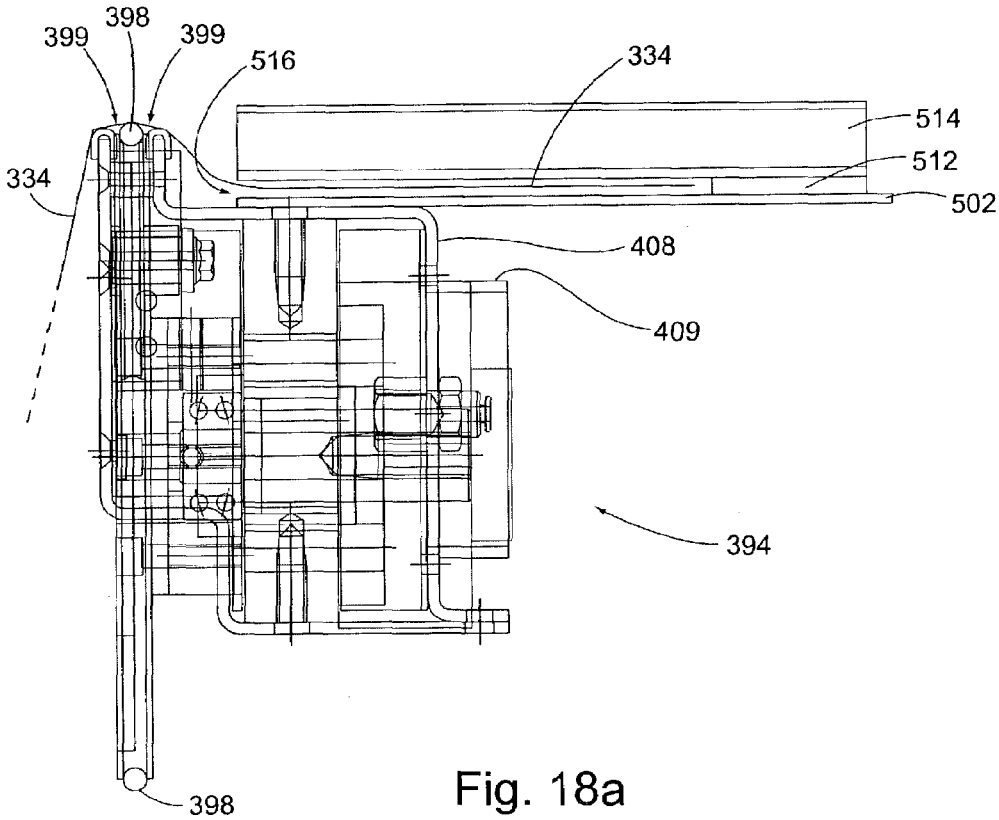
Figure 19:
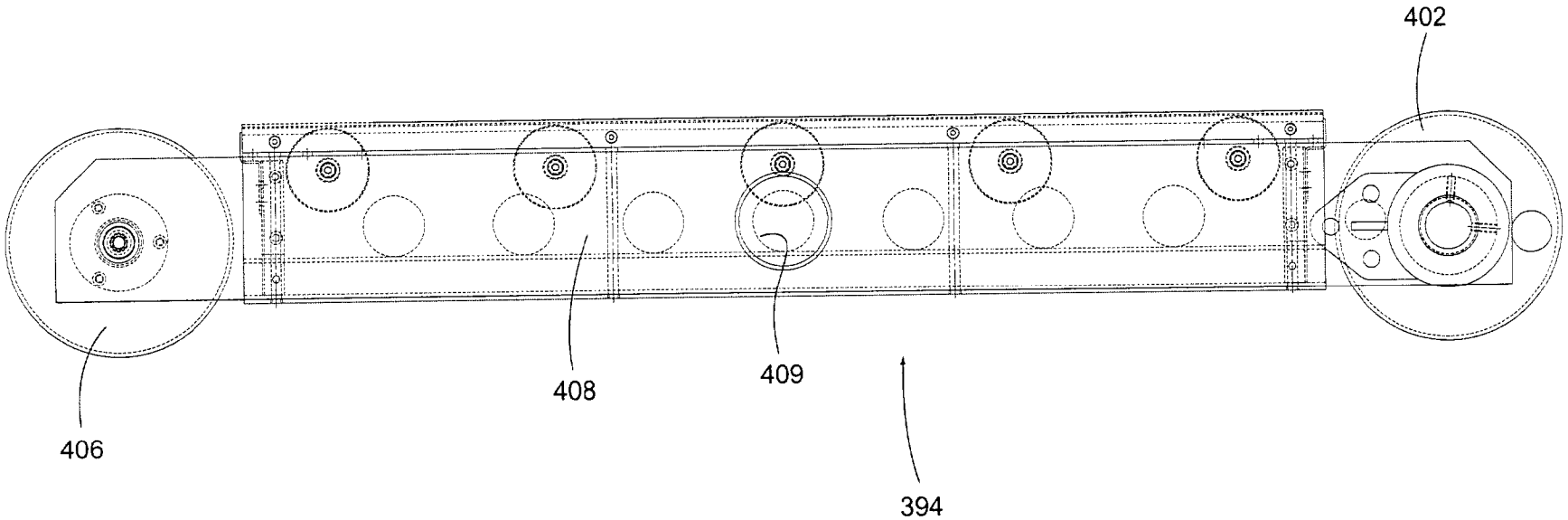
Figure 20:
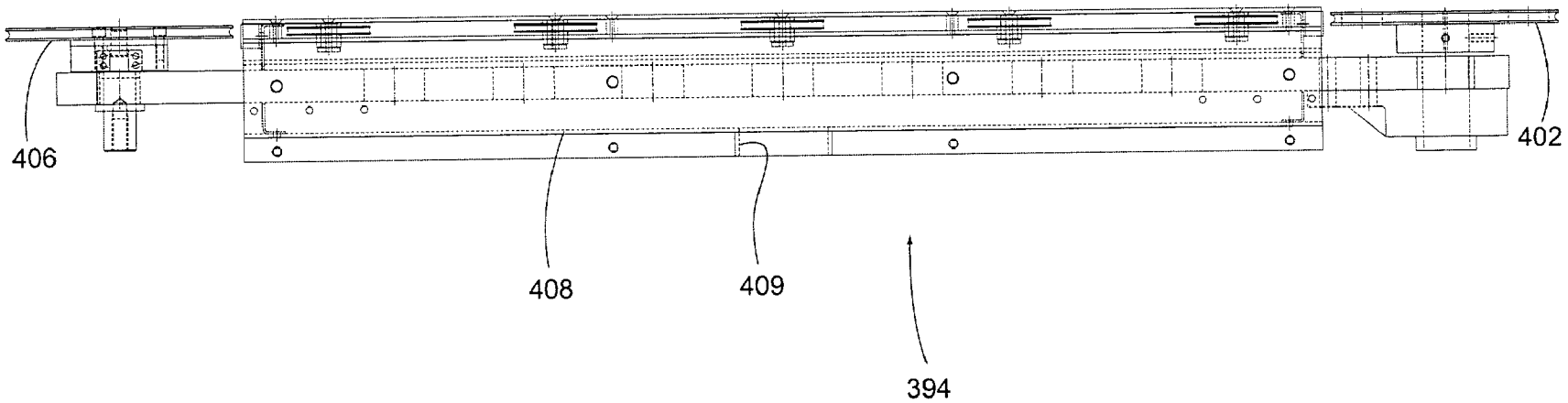
Figure 22:
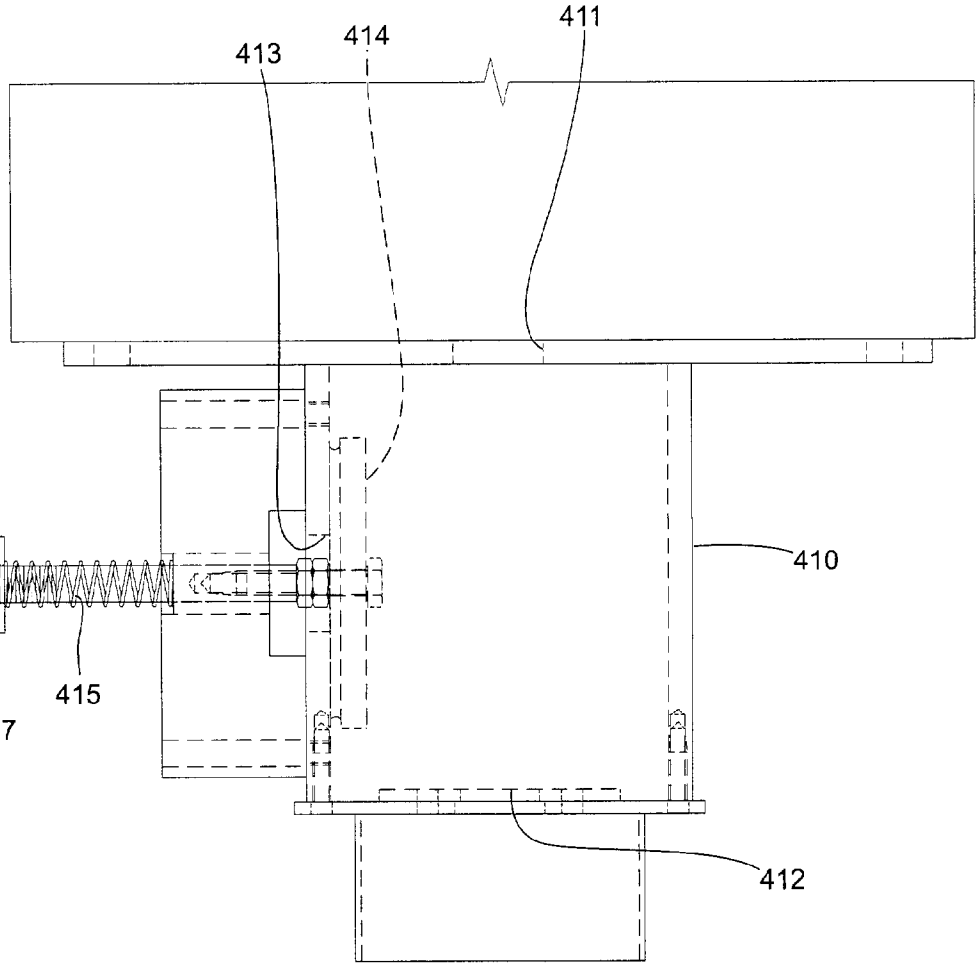
Figure 21:
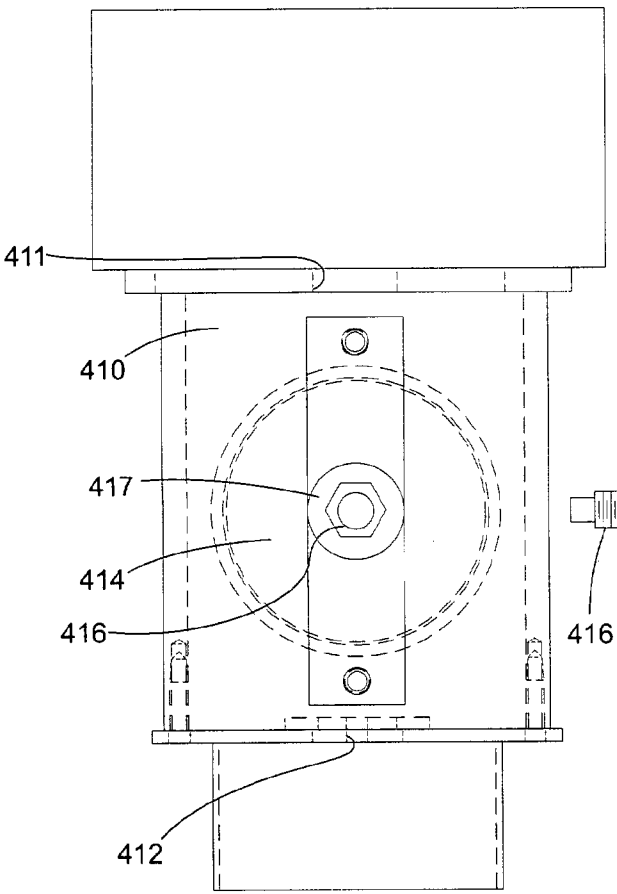
Figure 23:
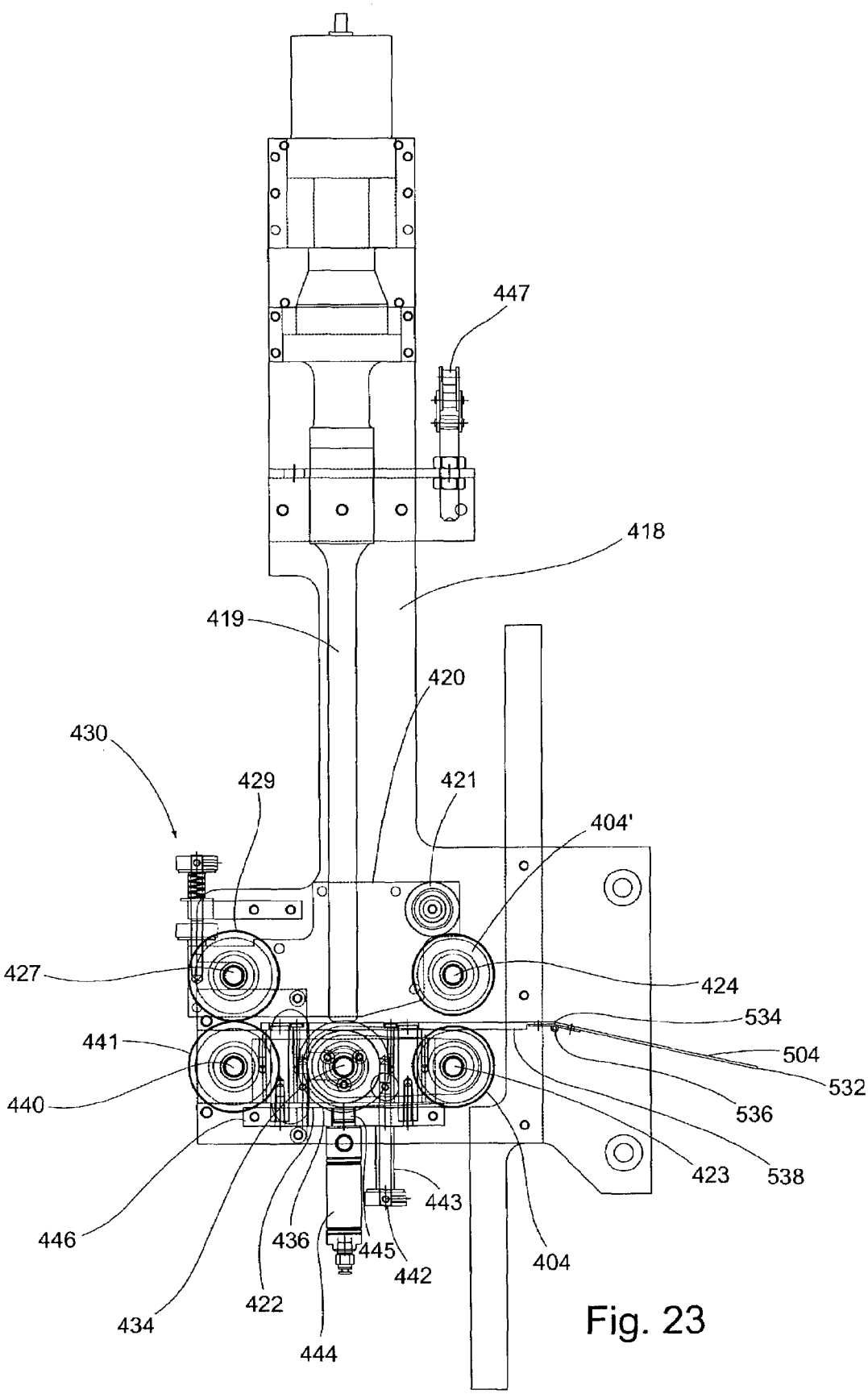
Figure 24:
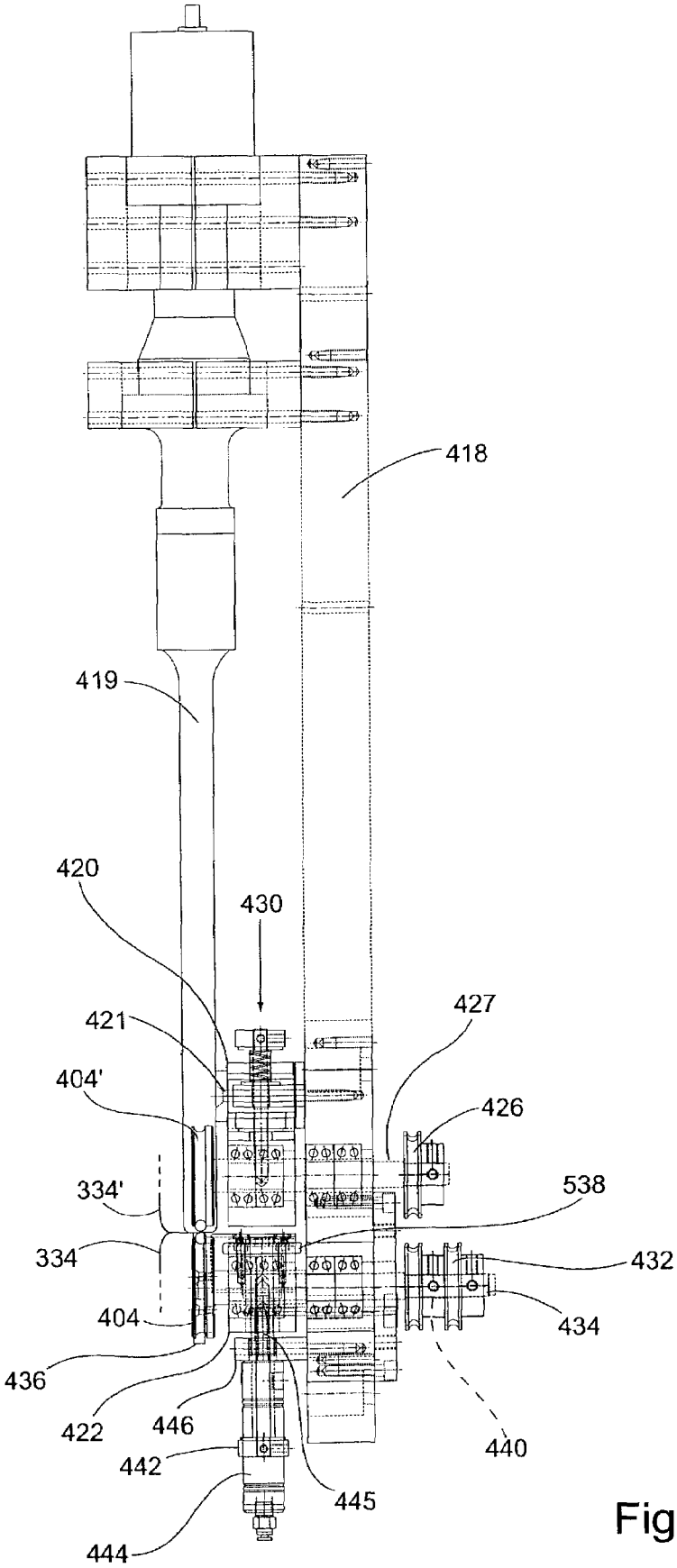
Figure 25:
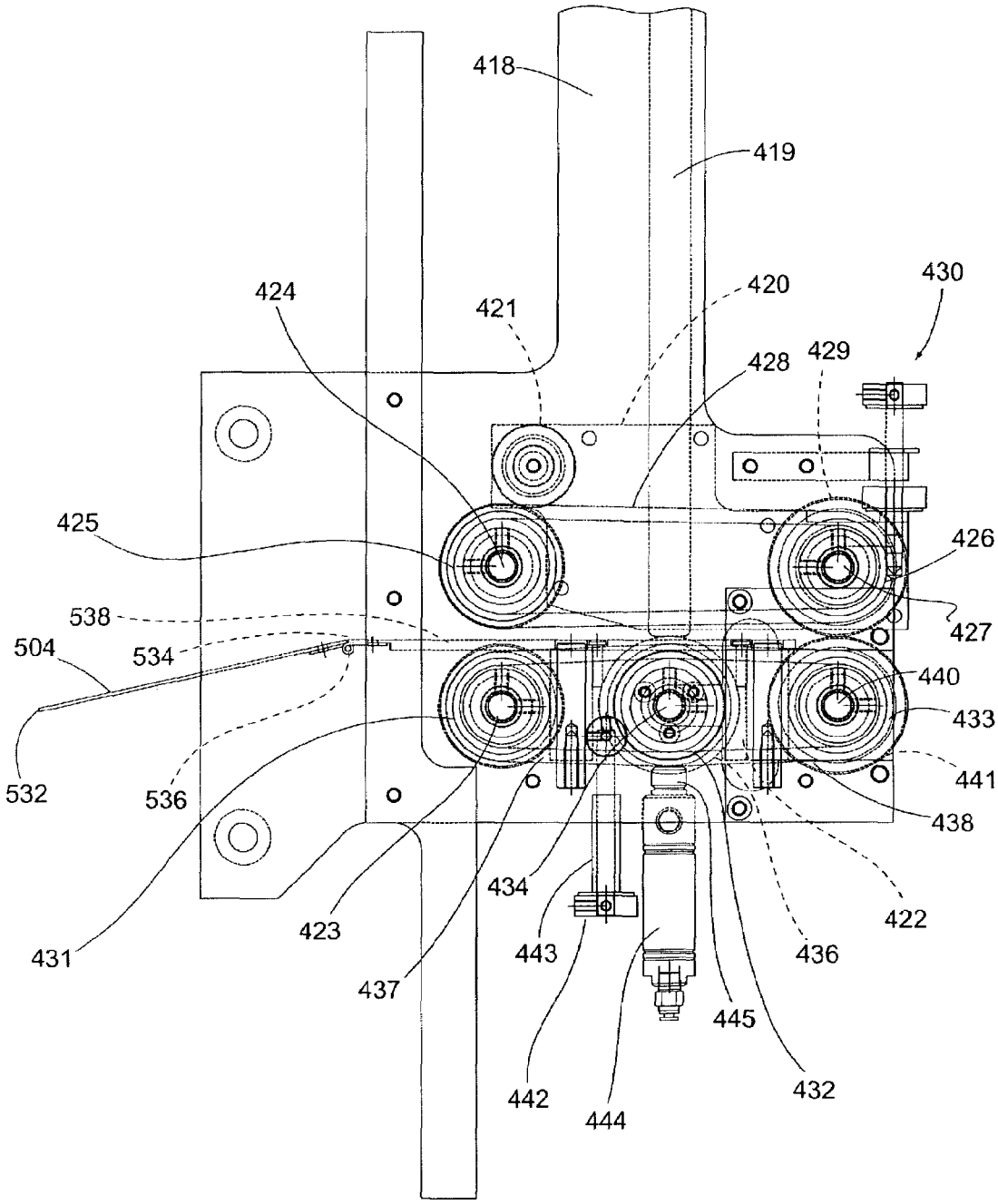
Figure 26:
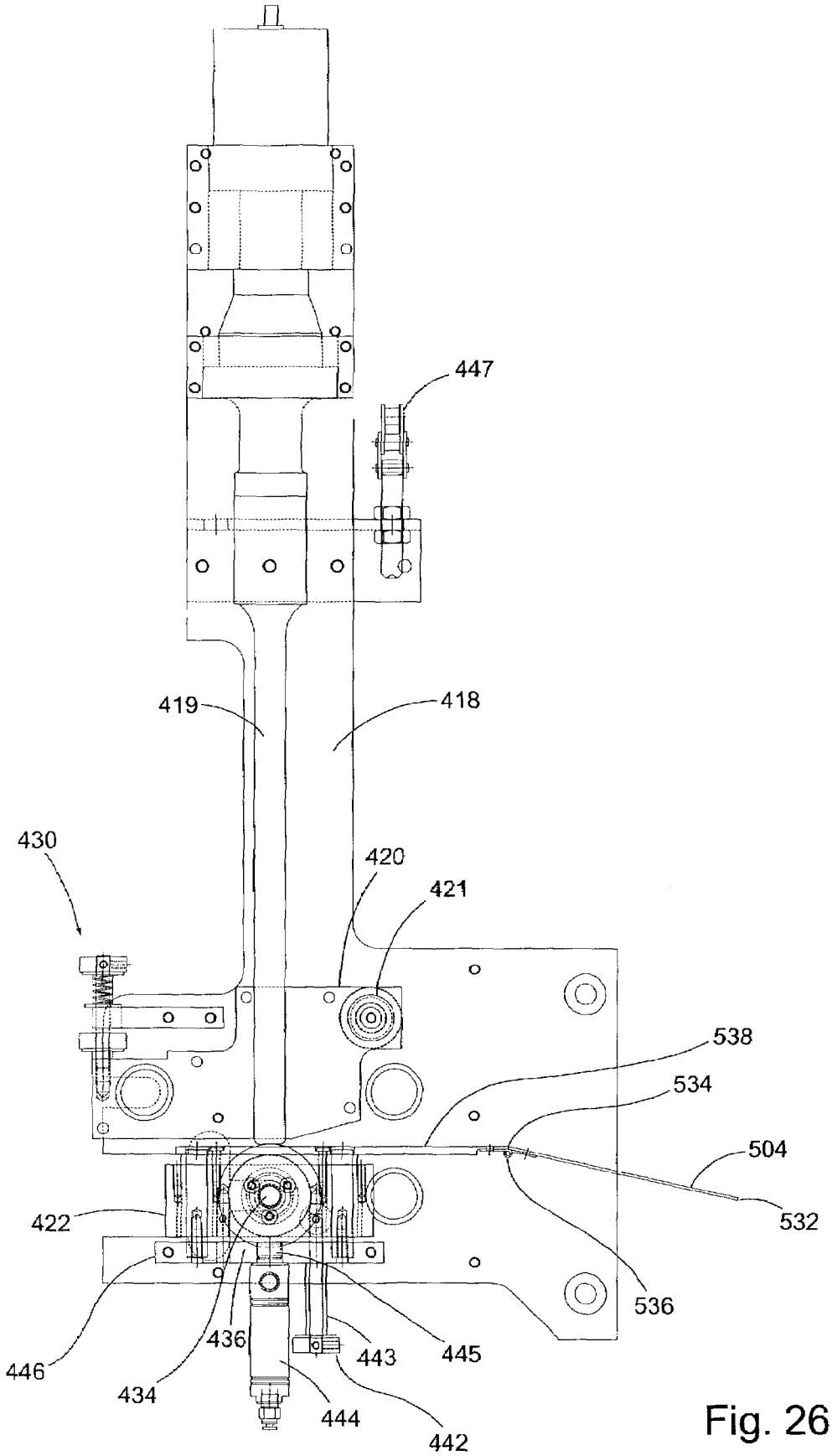
Figure 27:
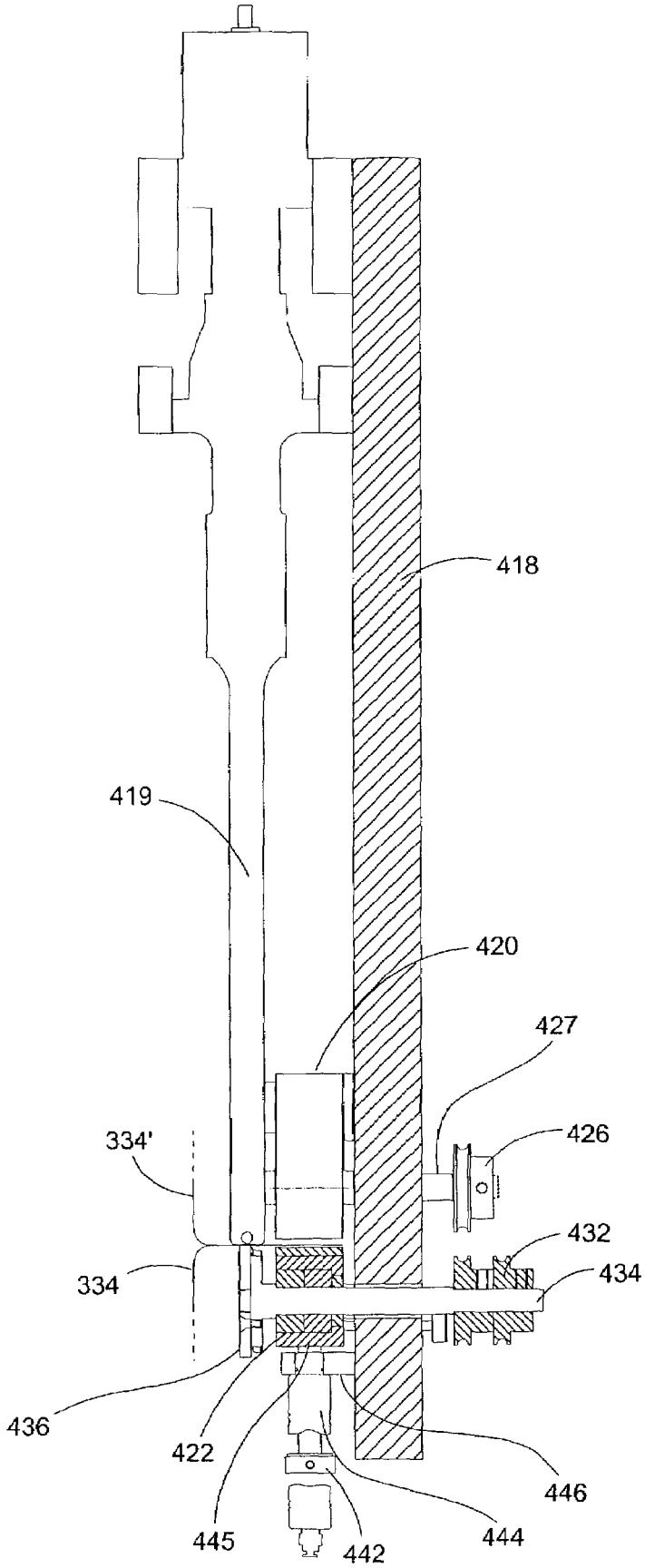
Figure 28:
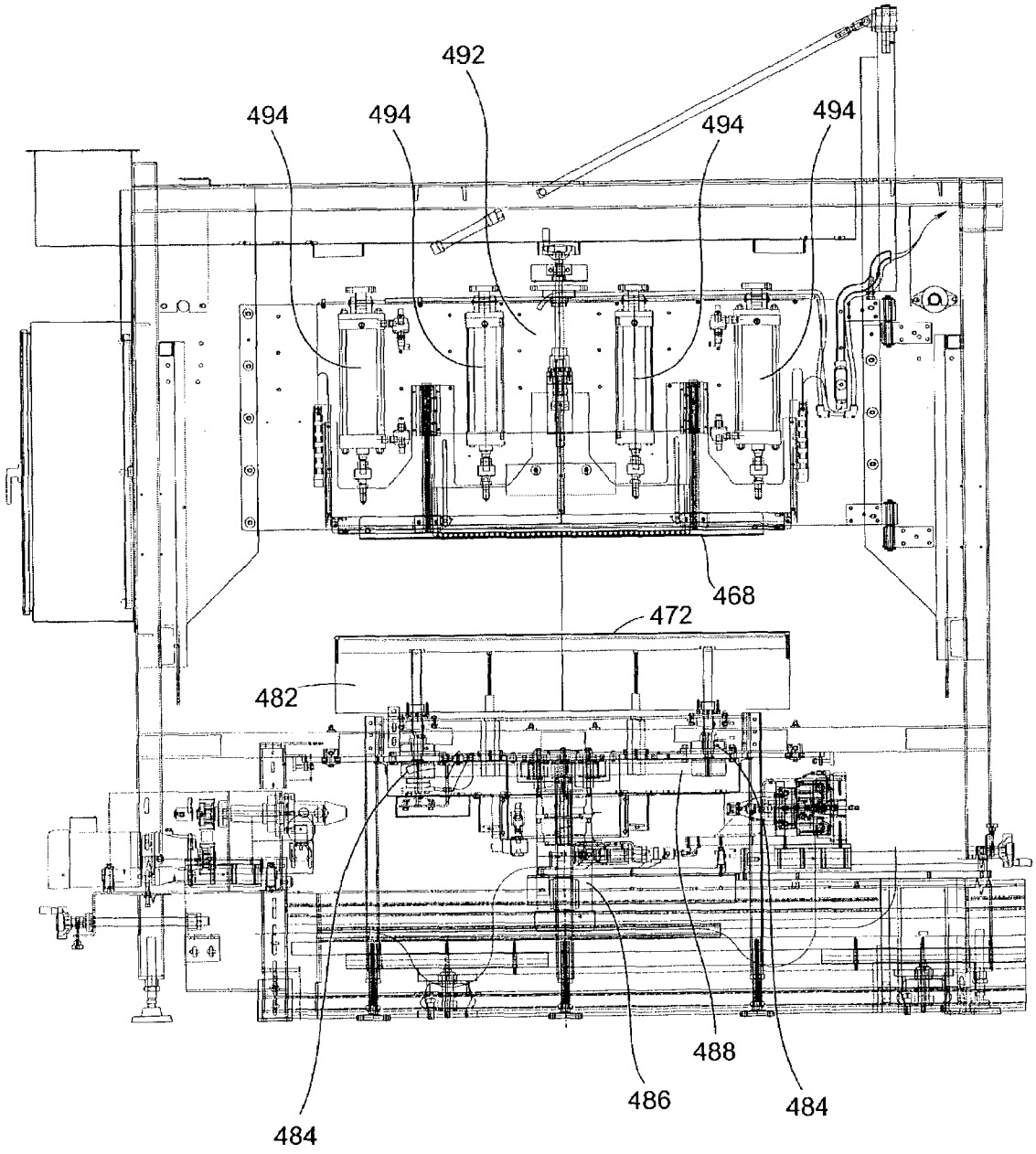
Figure 29:
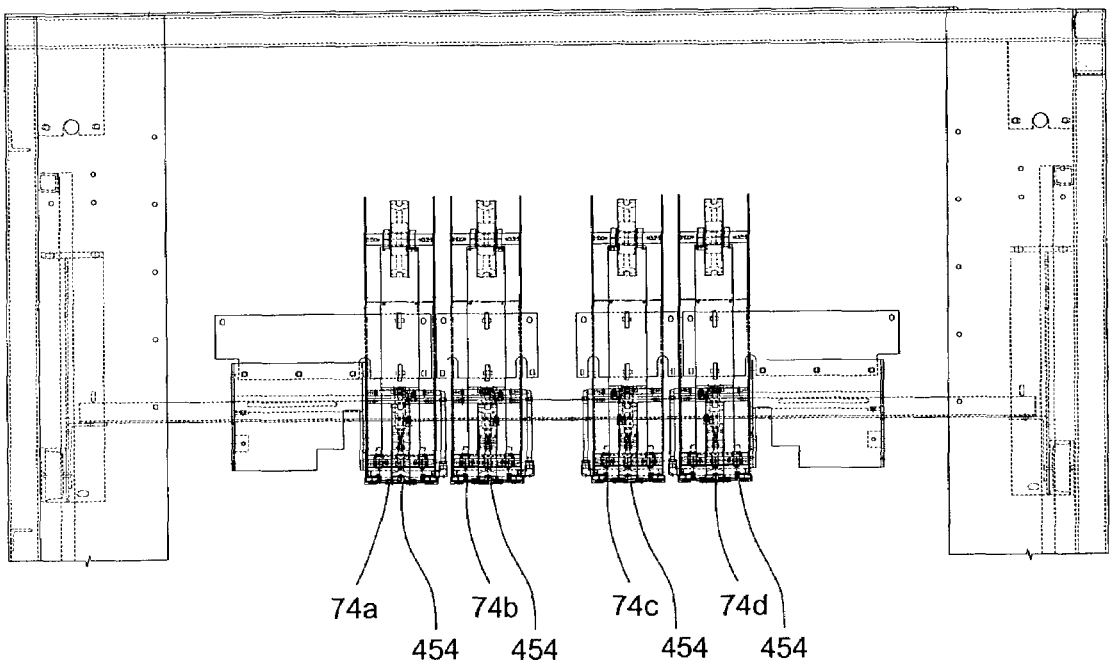
Figure 29:
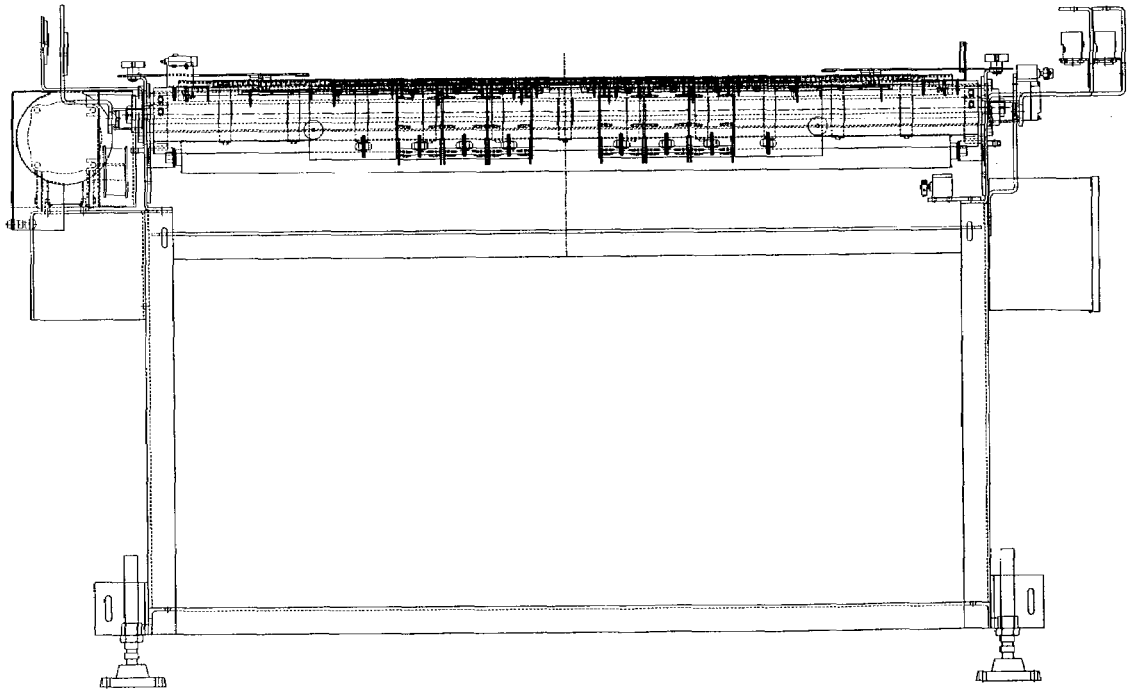
Figure 30:
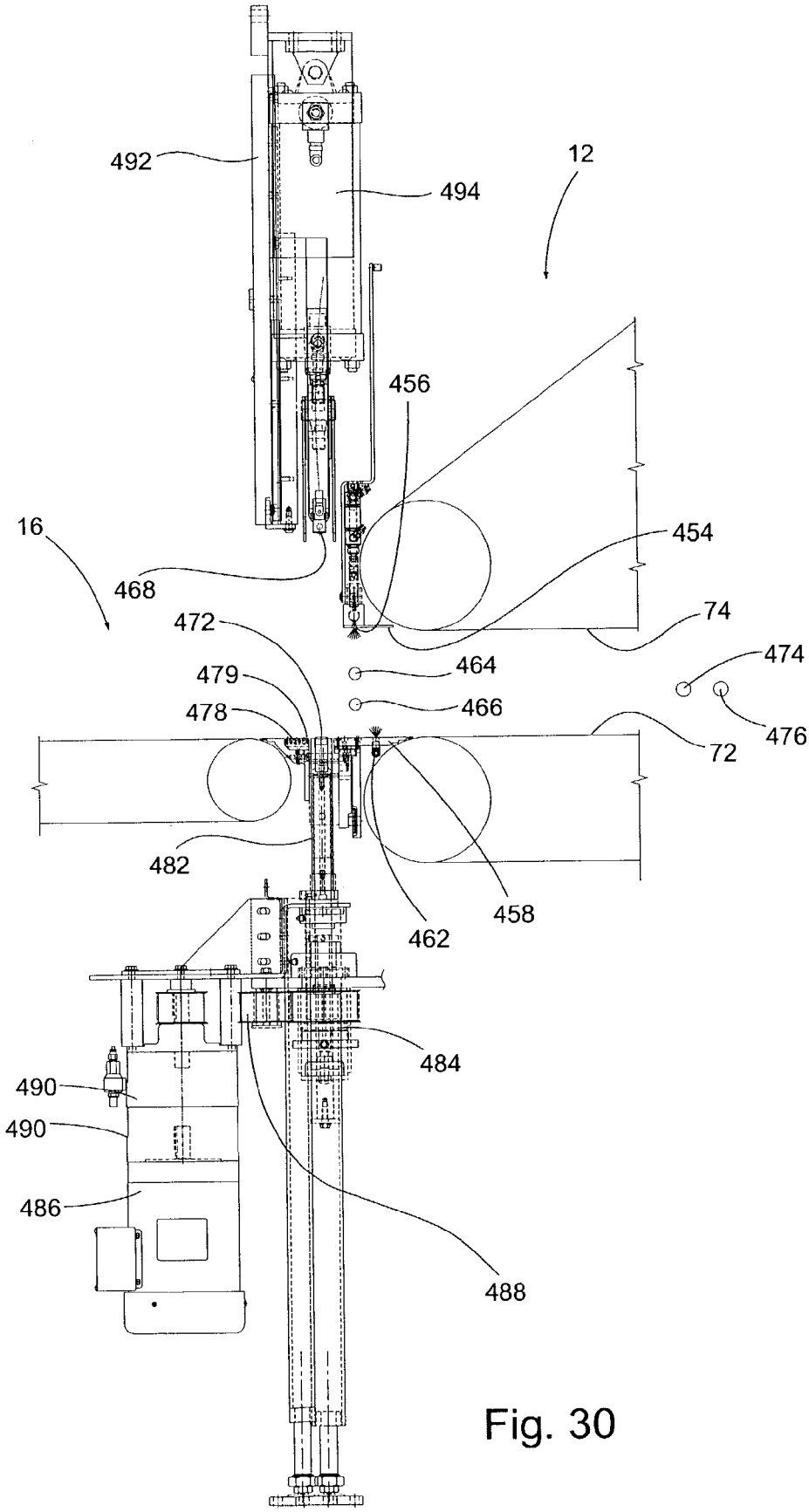
Figure 31:
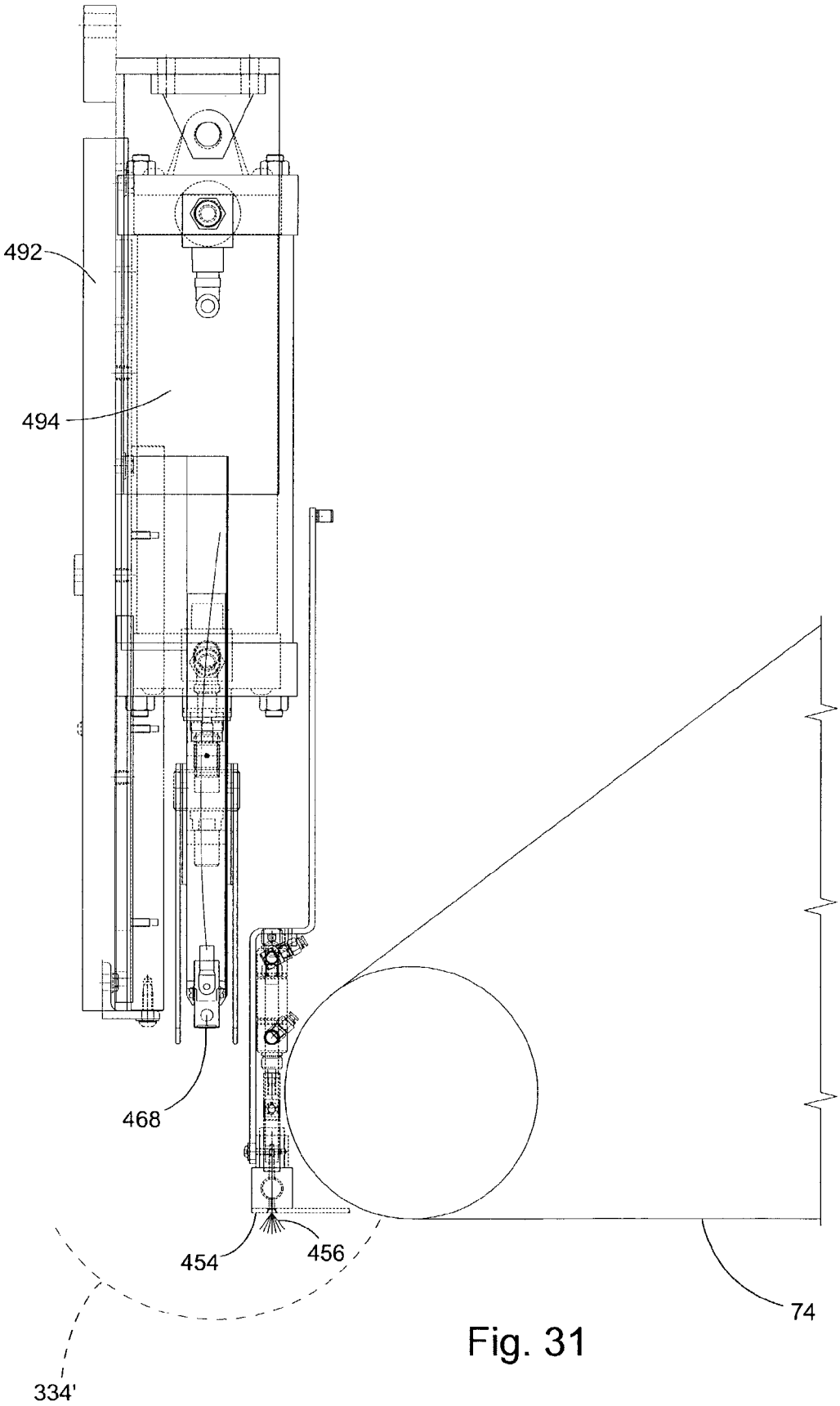
Figure 32:
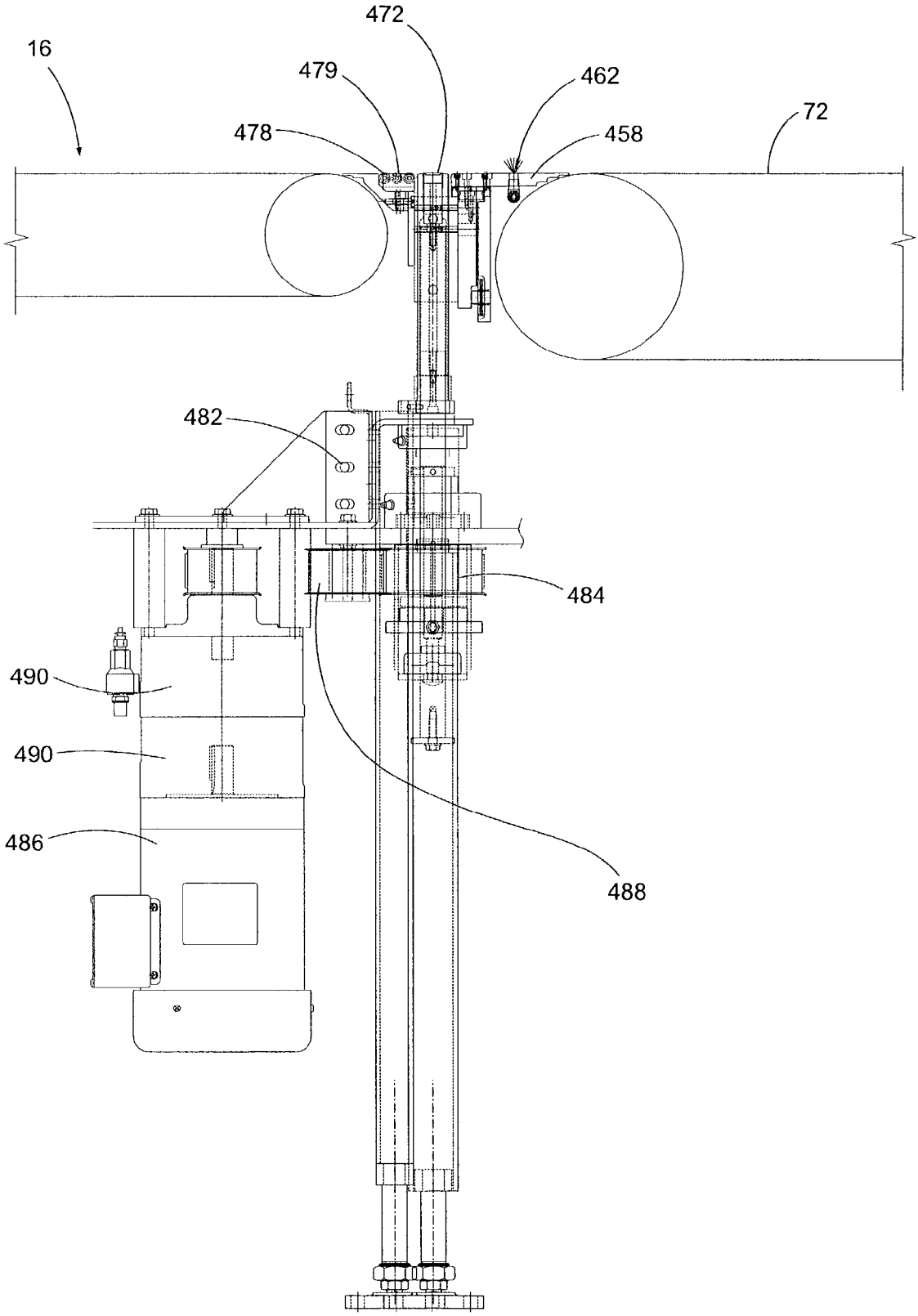

FIG. 15 is a partial side elevation view of the bottom packaging film dispenser showing several details of FIG. 14;

FIG. 16 is a side elevation view of the top packaging film roll dispenser;

FIG. 17 is a plan view of the bottom packaging film roll dispenser;

FIG. 17*a* is partial enlarged view of the portion of the bottom packaging film roll dispenser shown in the dashed line rectangle of FIG. 17;

FIG. 17*b* is an enlarged partial view of the portion of the bottom packaging film roll dispenser shown in the dashed line rectangle of FIG. 17;

FIG. 17*c* is an enlarged partial view of the portion of the bottom packaging film roll dispenser shown in the dashed line rectangle of FIG. 17;

FIG. 17*d* is an enlarged partial view of the section of the bottom packaging film roll dispenser shown in the dashed line rectangle of FIG. 17;

FIG. 18 is a partial side elevation view of the film side edge guides and a film side edge heat sealing devise of the bagging conveyor;

FIG. 18*a* is an enlarged partial sectioned view along the line 18*a* shown in FIG. 18;

FIG. 18*b* is an enlarged partial sectioned view along the line 18*b* shown in FIG. 18;

FIG. 19 is a side elevation view of one of the film side edge guides of FIG. 18;

FIG. 20 is a plan view of the film side edge guide of FIG. 19;

FIG. 21 is an end view of a vacuum level control valve used with the film side edge guide of FIG. 19;

FIG. 22 is a side elevation view of the valve of FIG. 21;

FIG. 23 is an enlarged side elevation view of the film side edge heat sealing device of FIG. 18;

FIG. 24 is a partial end elevation view of the film side edge heat sealing device of FIG. 23;

FIG. 25 is a view of the opposite side of the device shown in FIG. 23;

FIG. 26 is a view similar to FIG. 23 with several parts of the device removed;

FIG. 27 is an end sectional view of the device shown in FIG. 23;

FIG. 28 is a partial end elevation view of a transverse film heat/seal/cut/seal device of the bagging conveyor;

FIG. 29 is a partial end elevation view of the output end of the bagging conveyor;

FIG. 30 is an enlarged partial view of the heat/seal/cut/seal device of FIG. 28;

FIG. 31 is a partial enlarged view showing the details of the upper portion of FIG. 30; and FIG. 32 is a partial enlarged view showing the details of the lower portion of FIG. 30.

DETAILED DESCRIPTION OF THE PREFERRED EMBODIMENT

Figure 1:
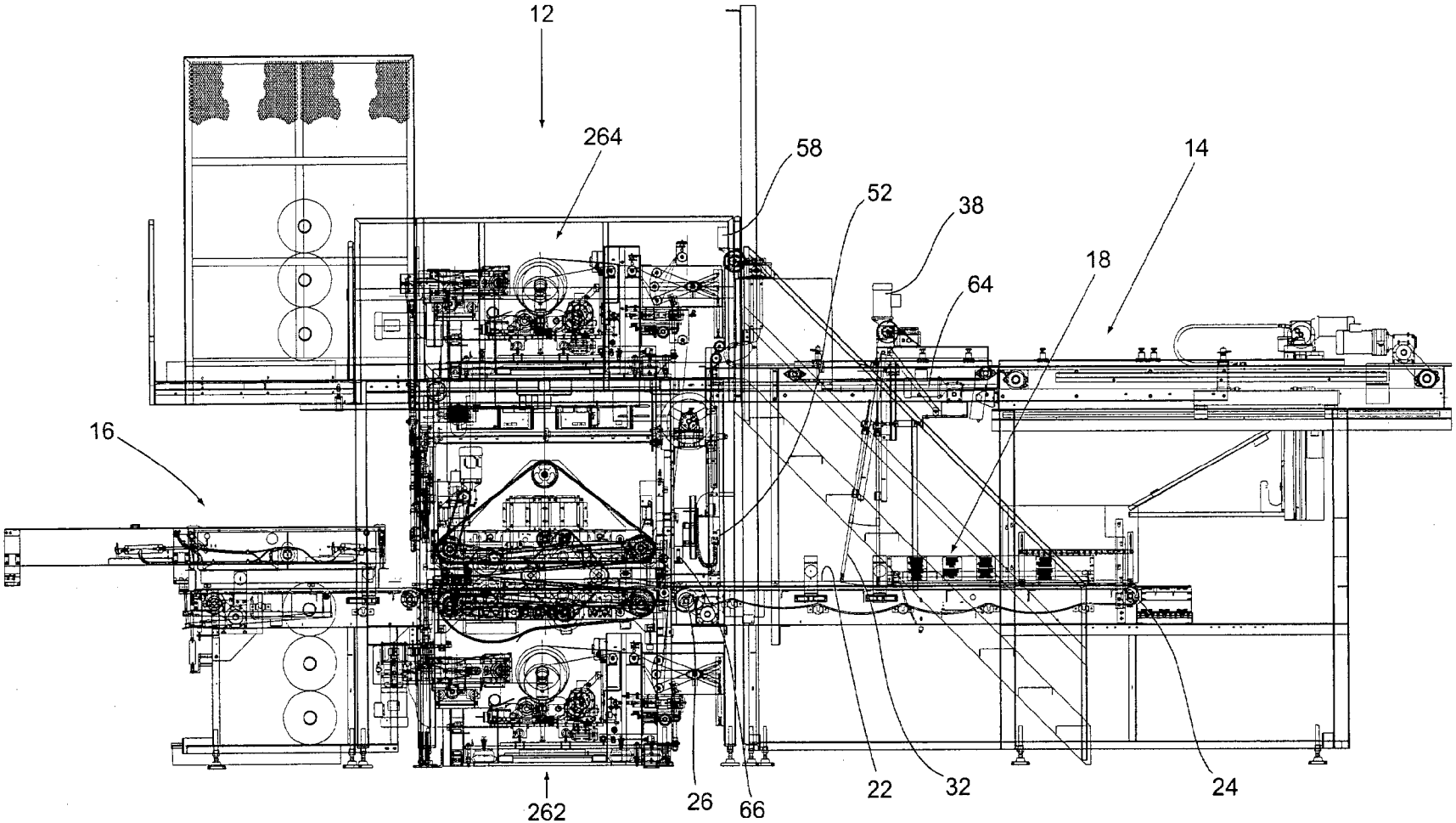
FIG. 1 is a side elevation view of the conveyor system of the invention.
Figure 2:
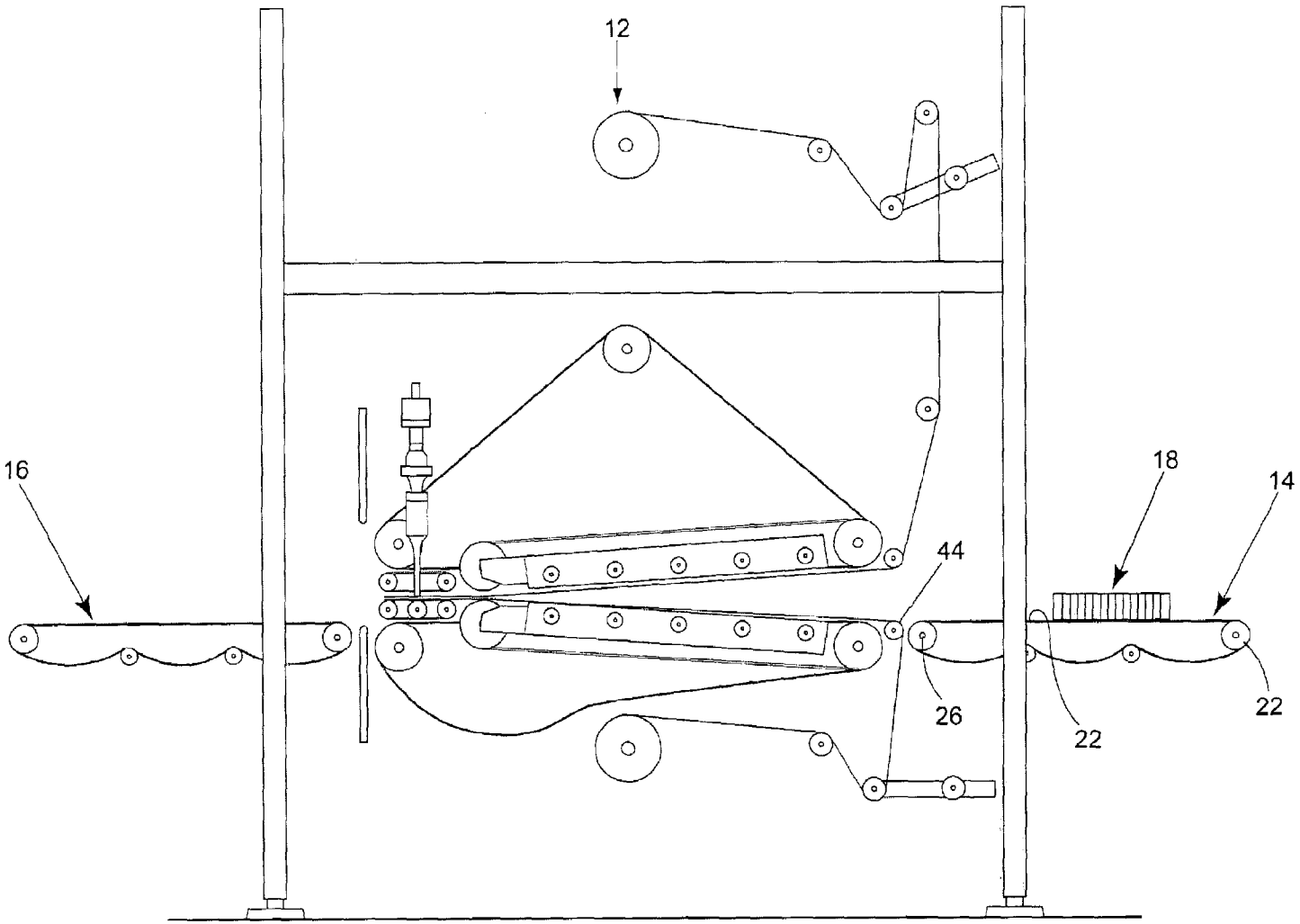
FIG. 2 is a schematic representation of the conveyor system of FIG. 1.

FIG. 1 shows a side elevation view of the conveyor system of the invention. The conveyor system is also shown schematically in FIG. 2. As will be explained, the present invention provides a conveyor system that encloses layers of objects arranged in two dimensional arrays in sealed bags that is more time efficient than bagging conveyors of the prior art. The conveyor system of the invention is shown in FIGS. 1 and 2 and is basically comprised of a bagging conveyor 12 that is positioned between an upstream infeed conveyor 14 and a downstream outfeed conveyor 16. A computerized control system (not shown) controls the operation of each of the conveyors relative to each other. The infeed conveyor 14 delivers the two dimensional arrayed layer of objects 18 to the bagging conveyor 12. The bagging conveyor 12 then forms a bag of packaging material film around the layer of objects prior to the layer of objects being delivered from the bagging conveyor 12 to the outfeed conveyor 16. The outfeed conveyor then delivers the bagged two dimensional array of objects to a palletizer. The infeed conveyor 14 is shown to the right in FIGS. 1 and 2; and the outfeed conveyor 16 is shown to the left of the bagging conveyor 12 in FIGS. 1 and 2. Thus, the conveyor system of the invention shown in FIGS. 1 and 2 conveys the two dimensional arrayed layers of objects 18 to be bagged from the right to the left as it conveys the layer of objects in the downstream direction through the conveyor system. The outfeed conveyor 16 that delivers the bagged two dimensional arrayed layers of objects to a palletizer is known in the prior art and will not be described in detail. The bagging conveyor 12 and the infeed conveyor 14 of the invention were designed to improve the time efficiency of bagging two dimensional arrayed layers of plastic blow molded bottles that are later palletized. However, the bagging conveyor 12 and infeed conveyor 14 may be employed in bagging two dimensional arrays of various different types of objects that are typically arranged in orderly two dimensional arrays of the objects that are stacked in layers on a pallet. Furthermore, while the description of the bagging conveyor refers to bagging two dimensional arrays of objects, it should be understood that the bagging conveyor can also be used for bagging other types of objects such as cartons, cases, trays, etc. In addition, in the description to follow, the infeed conveyor 14, the bagging conveyor 12 and the outfeed conveyor 16 are arranged longitudinally end to end with each of the conveyors having a longitudinal length and a lateral width.

The Infeed Conveyor

The details of the infeed conveyor 14 are shown in drawing FIGS. 3, 3*a*, 4, 4*a*, and 5. The infeed conveyor 14 is a belt type conveyor having a belt conveyor surface 22 that extends around a series of upstream pulleys or sprockets 24, and a series of downstream pulleys or sprockets 26. The conveyor top conveying surface 22 is fed with the two dimensional arrayed layers of object 18, such as empty blow molded plastic bottles, by a row former (not shown) adjacent the infeed conveyor upstream end. The infeed conveyor 14 operates generally continuously as the bagging conveyor is sequentially operated, which will be explained in more detail later.

Each two dimensionally arrayed layer of objects 18 is conveyed by the infeed conveyor surface 22 to a hold back bar mechanism. The hold back bar mechanism is comprised of a hold back bar 32 that extends laterally across the width of the infeed conveyor. The hold back bar 32 is attached to the bottom of an upwardly movable supporting frame 34 of the hold back bar mechanism. The frame 34 in turn is suspended by a chain 36 that is driven by a motor 38 to selectively raise and lower the hold back bar 32 and the hold back bar frame 34. In addition, an air piston/cylinder actuator 42 is connected between the hold back bar frame 34 and the framework of the infeed conveyor. Selective activation of the actuator 42 pushes the hold back bar 32 forwardly or in the downstream direction and pulls the bar rearwardly as represented in the two positions of the bar shown in FIGS. 3 and 3*a*.

The hold back bar 32 holds back the two dimensionally arrayed layer of objects 18 on the moving infeed conveyor surface 22 until they are ready to be conveyed to the bagging conveyor 12. When the layer of objects 18 is to be released from the hold back bar 32, the motor 38 is activated and through the chain 36 lifts the hold back bar 32 vertically from the infeed conveyor surface 22. At about the same time, the air actuator 42 is extended causing the frame 34 to move the hold back bar 32 in a downstream direction away from the layer of objects 18 simultaneously with the motor 38 pulling the hold back bar 32 upwardly. Thus, the hold back bar 32 moves through a generally curved path as it is raised. This separates the hold back bar 32 from the layer of objects 18 on the infeed conveyor surface 22 as the layer of objects is moved in the downstream direction by the infeed conveyor 14. Raising the hold back bar 32 in this manner prevents the hold back bar from disrupting or potentially knocking over any of the objects in the front row of objects moving downstream toward the bagging conveyor.

As the infeed conveyor 14 conveys the layer of objects toward the bagging conveyor 12, the conveying surfaces of the bagging conveyor which will be described later operate at substantially the same speed as the infeed conveyor conveying surface 22. Thus, the layer of objects 18 being conveyed on the infeed conveyor surface 22 will remain in their two dimensional arrayed positions as they are transferred from the infeed conveyor 14 to the bagging conveyor 12. However, there is a small gap between the end of the infeed conveyor 14 and the beginning of the bagging conveyor 12 over which the arrayed layer of objects 18 must pass. This gap is shown in FIG. 5. A set of rollers 44 is positioned in the middle of the gap. The rollers 44 extend laterally across the widths of both the infeed conveyor 14 and bagging conveyor 12 as shown in FIG. 6. The set of rollers 44 receive a continuous film of packaging material from beneath the bagging conveyor 12 and direct the film into the bagging conveyor to supply the bagging conveyor with the film which will be described in more detail later. A first dead plate 46 and a second dead plate 48 shown in FIG. 5 are positioned on longitudinally opposite sides of the rollers 44. The dead plates 46, 48 also extend across the lateral widths of the infeed conveyor 14 and bagging conveyor 12 and are positioned in the same planes as the conveying surfaces of the infeed conveyor 14 and the bagging conveyor 12. The movement of the layer of objects 18 by the infeed conveyor surface 22 will cause the first several rows of the layer to pass over the dead plate 46 and onto the film 334 passing over the rollers 44 and the dead plate 48 into the bagging conveyor 12. However, the last row or rows of the layer of objects 18 conveyed by the infeed conveying surface 22 onto the dead plate 46 and film 334 extending into the bagging conveyor 12 will have no objects behind them to push them across the dead plate and film into the bagging conveyor 12. To over come this problem, a pusher bar mechanism is provided.

The pusher bar mechanism is shown in FIGS. 3, 3*a*, 4, and 4*a*. The mechanism is comprised of a pusher bar 52 that extends laterally across the infeed conveying surface 22. The pusher bar 52 is suspended above the infeed conveying surface by a pusher bar frame 54 that in turn is suspended by a chain 56 driven by a motor 58. The motor 58 and chain 56 are selectively operated to move the pusher bar upwardly and downwardly relative to the infeed conveying surface 22. The pusher bar frame 54 is also operatively connected with a second chain 62 and motor 64 that is selectively operated to move the pusher bar 52 and the pusher bar frame 54 horizontally across the infeed conveying surface 22.

When the hold back bar 32 is initially raised from the infeed conveying surface 22 to allow the layer of objects 18 to be advanced by the infeed conveyor toward the bagging conveyor 12, the first pusher bar motor 58 raises the pusher bar 52 vertically from the conveying surface 22 while substantially simultaneously the second pusher bar motor 64 causes the pusher bar 52 to be moved horizontally toward the hold back bar 32. This positions the pusher bar 52 in a home position above the layer of objects 18 that have been released from the hold back bar 32 and are conveyed by the infeed conveying surface 22 downstream toward the bagging conveyor 12. The home position of the pusher bar 52 is represented by the dashed line rectangle 52 in FIG. 3*a*. When the layer of objects passes a photo sensor assembly 66 positioned adjacent the infeed conveying surface 22 just downstream from the hold back bar 32 and beneath the pusher bar 52 in its home position, the pusher bar mechanism motors 58, 64 then again operate to cause the pusher bar to move vertically downward toward the infeed conveying surface 22 and then downstream across the conveying surface toward the back of the layer of objects 18 conveyed by the infeed conveyor toward the bagging conveyor. The horizontal movement of the pusher bar 52 is adjusted so that at first it moves quickly to catch up to the back of the layer of objects 18 being conveyed toward the bagging conveyor 12, and then slows to relatively or approximately the same speed as the infeed conveying surface 22 when the pusher bar 52 reaches the back of the layer of objects 18. The pusher bar 52 continues to move horizontally at the same speed as the infeed conveying surface 22 in the downstream direction. As the layer of objects 18 is transferred from the infeed conveying surface 22 to the bagging conveyor 12, the pusher bar 52 pushes the last of the objects in the layer of objects 18 across the dead plate 46 and onto the film 334 extending over the rollers 44 and dead plate 48 shown in FIG. 5 and into the bagging conveyor 12. This ensures that the two dimensionally arrayed layer of objects 18 maintains its ordered arrangement as it is transferred across the dead plate 46 and onto the film extending over the rollers 44 and second dead plate 48 from the infeed conveyor 14 to the bagging conveyor 12.

A series of hold down pads or clamps 68 are arranged laterally across the downstream end of the infeed conveyor 14 just above the first dead plate 46 as shown in FIGS. 5 and 6. The hold down pads 68 have actuators that are selectively activated to extend the hold down pads 68 downwardly toward the infeed conveying surface 22 and the first dead plate 46. The hold down pads 68 are positioned to engage against the tops of a row of objects to hold the row of objects down on the first dead plate 46 when the pads 68 are activated. At times during the operation of the conveying system, the operating of the bagging conveyor 12 and the pusher bar 52 will be stopped while the infeed conveyor 14 generally continues to run in order for the infeed conveyor to continue to receive rows of objects that are formed in the two dimensional arrays. To prevent the infeed conveyor 14 from continuing to convey a layer of objects 18 across the first dead plate 46 and onto the film extending over the rollers 44 and second dead plate 48 and into the bagging conveyor 12 when the bagging conveyor and pusher bar are stopped in situations to be described later. The hold down pads 68 are activated causing the pads to extend downwardly and engage the tops of a row of objects of the layer of objects being conveyed over the dead plate 46 causing the downstream movement of this row of objects to stop. The hold down pads 68 hold the row of objects stationary on the dead plate 46 while the infeed conveyor 14 continues to operate. The held row of objects functions to hold back the remainder of the layer of objects 18 being conveyed by the infeed conveyor surface 22 preventing this layer of objects from being transferred from the infeed conveyor 14 into the bagging conveyor 12 when the bagging conveyor is stopped.

The Bagging Conveyor

The bagging conveyor 12 is shown in FIGS. 1, 2, 7, and 7*a* and is basically comprised of a longitudinally extending bottom conveyor with a bottom conveying surface 72 and a longitudinally extending top conveyor with a top conveying surface 74 that is spaced vertically above the bottom conveying surface. The vertical spacing between the bottom conveying surface 72 and the top conveying surface 74 corresponds to the height of the layer of objects 18 being conveyed through the bagging conveyor. The bottom and top conveying surfaces received the two dimensionally arrayed layer of objects 18 from the infeed conveyor 14 between the two conveying surfaces 72, 74 and convey the layer of objects in the downstream direction to the outfeed conveyor 16.

The bottom conveying surface 72 is shown in FIGS. 8, 9, 9*a*, 10, and 10*a*. FIGS. 9 and 9*a* are at the downstream end of the bottom conveyor 72 looking upstream. FIGS. 9*a* and 10*a* are enlargements of left-hand sections of the conveyor shown in FIGS. 9 and 10, respectively. Corresponding component parts of the conveyor on the right-hand side of FIGS. 9 and 10 are identified with the same reference number as those on the left-hand side followed by a prime (').

The bottom conveying surface is actually comprised of a plurality of belt type conveyors that are known in the industry as table top chain conveyors. These are conveyors that are comprised of a plurality of small plates that are connected together end to end by hinge pins to form the continuous belts. Each of the individual conveyor belts is wrapped around an upstream pulley or sprocket 76 and a downstream pulley or sprocket 78 with the belt extending longitudinally between the sprockets. The top surface of each belt section is taut between the upstream sprocket 76 and the downstream sprocket 78 and functions as a portion of the bottom conveying surface 72 of the bottom conveyor. In the embodiment of the invention shown in FIGS. 9, 9*a*, 10 and 10*a*, the bottom conveyor is comprised of nine individual conveying belts 72*a*, 72*b*, 72*c*, 72*d*, 72*e*, 72*f*, 72*g*, 72*h*, 72*i* that are arranged laterally side by side across the bottom conveying surface of the bagging conveyor. The intermediate or seven middle belts 72*b*, 72*c*, 72*d*, 72*e*, 72*f*, 72*g*, 72*h* of the bottom conveyor are all driven at the same speed by the same motor 82 as shown in FIG. 10. The motor 82 drives these intermediate belt sections at substantially the same speed as the infeed conveyor 14. The laterally outer two conveyor belt sections 72*a*, 72*i* of the bottom conveyor nine conveyor belt sections each are driven by their own dedicated motor 84, 86. These outer belt section motors 84, 86 usually drive the outer belt sections 72*a*, 72*i*, at the same speed as the seven intermediate belt sections and at substantially the same speed as the infeed conveyor. However, situations do occur where one of the outer conveyor belt section motors 84 or 86 will be individually incrementally increased in speed or incrementally decreased in speed to increase or decrease the speed of one of the outer bottom conveyor belt sections 72*a* or 72*i* relative to the seven intermediate belt sections to laterally adjustably position the film of packaging material being conveyed across the bottom conveying surface 72 as will be explained.

In addition, each of the laterally outer bottom two conveyor belt sections 72*a*, 72*i* has a vacuum air plenum structure within the loop of the conveyor belt section. The laterally outer two conveyor belt sections 72*a*, 72*i* have holes (not shown) through the conveyor belts. The holes communicate the vacuum from the vacuum plenum assembly to the bottom conveying surfaces of the laterally outer belts 72*a*, 72*i*. Referring to FIGS. 9*a*, 10 and 10*a*, the air plenum assembly of the left hand bottom conveyor section 72*a* will be described, with it being understood that the vacuum air plenum assembly of the right hand bottom conveyor belt section 72*i* is basically the same. Beneath the conveying belt section surface 72*a* is an elongate vacuum plenum box comprised of a pair of laterally spaced side walls 92, 94, a bottom wall 96 that extends between the side walls, and a pair of end walls 98, 102 positioned just inside of the upstream sprocket 76 and downstream sprocket 78 of the conveyor belt section. This vacuum plenum box is open at its top which is positioned just beneath the conveyor belt section 72*a*. The interior of the vacuum plenum box that extends beneath the belt section 72*a* also communicates with the interior of a laterally extending vacuum plenum box 104. The laterally extending box 104 has a vacuum hose collar 106 that is attached to a hose that communicates with the source of vacuum pressure. Thus, the vacuum pressure is supplied through the hose (not shown) to the collar 106, through the laterally extending box 104 to the interior of the vacuum box positioned beneath the conveying surface of the outer conveyor section 72*a*. The vacuum supplied to the bottom of the conveying surface is transmitted through the holes (not shown) in the outer belt section 72*a* to the conveying surface of the outer belt section where it holds the film of packaging material to the conveying surface. The vacuum supplied to the conveying surfaces of the two outer belt sections 72*a*, 72*i* assists in conveying the film of packaging material across the bottom conveying surface 72 and maintaining the film flat against the bottom conveying surface. Vacuum assisted conveyors are known in the art and therefore the vacuum assist of the laterally outer bottom conveyor surface sections 72*a*, 72*i* has only been generally described herein.

Each of the conveying belt sections 72*a*, 72*b*, 72*c* 72*d*, 72*e*, 72*f*, 72*g*, 72*h*, 72*i* of the bottom conveyor surface can also have their lateral positions relative to each other adjusted to either expand or decrease the lateral width of the bottom conveying surface. This enables the bagging conveyor to accommodate layers of objects having different lateral widths and bagging these layers of objects in packaging film having different lateral widths. Referring to FIGS. 10 and 10*a* and in particular FIG. 10*a*, the lateral adjusting movement of the left half of the bottom conveyor as viewed in FIG. 10 will be described with it being understood that the lateral adjusting movement of the right half of the conveyor shown in FIG. 10 is accomplished in the same manner. Component parts of the left-hand side of the conveyor shown in FIG. 10 to be described have corresponding parts on the right-hand side of the conveyor that are identified by the same reference numbers followed by a prime (').

In adjusting the relative lateral positions of the bottom conveying surface sections, the middle conveying surface section 72*e* of the nine separate sections remains stationary. Only the four conveyor sections on the opposite sides of the middle conveyor section, 72*e*, are adjusted outwardly and inwardly. The downstream sprockets 78 of each of the three belt sections 72*b*, 72*c*, 72*d* just to the left of the middle section 72*e* are all mounted on a drive shaft 112 that is driven by the intermediate conveyor section motor 82. The upstream pulleys or sprockets 76 of each of these three conveyor belt sections are mounted on an idler shaft 114. Each of the downstream sprockets 78 and upstream sprockets 76 of the three conveyor belt sections 72*b*, 72*c*, 72*d* are mounted on their respective shafts 112, 114 by splined connections that enable the pulleys or sprockets to move laterally across the shafts. As shown in FIG. 10*a*, the laterally outer end of the drive shaft 112 and the laterally outer end of the idler shaft 114 extend into an interior bore of a larger drive shaft 116 and an idler shaft 118. The downstream sprocket 78 and upstream sprocket 76 of the outer conveyor belt section 72*a* are mounted on the larger drive shaft 116 and larger idler shaft 118. The larger drive shaft 116 is driven by the bottom conveyor section outer motor 84 that is capable of driving the outer conveyor section 72*a* at different speeds from the remaining conveyor sections. The downstream sprocket 78 and upstream sprocket 76 of the outer section 72*a* are fixed to their respective shafts 116, 118.

Referring to FIG. 10*a*, each of the conveyor section 72*a*, 72*b*, 72*c*, 72*d* has a pair of plates 122, 124, 126, 128 that extend along the longitudinal length of the conveyor sections and are positioned on opposite sides of the downstream sprocket 78 and upstream sprocket 76 of each of the conveyor sections. Each of the pairs of plates have pairs of bushings 132, 134, 136, 138 connected between the plates. The bushings are supported on laterally extending rods 142, 144, 146, 148 for lateral sliding movement of the bushings over the rods. In addition, each of the pairs of plates, 122, 124, 126, 128 has an internally screw threaded nut 152, 154, 156, 158 secured between the pair of plates. The nuts 152, 154, 156, 158 are mounted on screw threaded rods 162, 164, 166, 168. The nuts and rods on the right hand side of the conveyor are inversely thread from those on the left hand side of the conveyor. Rotation of the rods in opposite directions causes the conveyor sections on opposite sides of the conveyor to move away from each other and toward each other. In addition, the bushings, rods and nuts are enclosed in channels (not shown) where they extend through the air plenum box of the outer conveyor section 72*a* with the channels sealing the vacuum of the air plenum box from the bushings, rods and nuts. Each of the rods 162, 164, 166, 168, are connected by chain and sprocket drives to a hand wheel 172 at one side of the bottom conveyor shown in FIG. 10. By providing different size sprockets in the chain and sprocket drive that connects the hand wheel 172 to the shafts 162, 164, 166, 168, rotation of the hand wheel will result in the different rates of rotation of each of the shafts 162, 164, 166, 168. The different rates of rotation of each of the shafts 162, 164, 166, 168 in their respective internally threaded nuts, 152, 154, 156, 158 will cause the nuts to move laterally across the shafts at different rates and result in each of the conveyor sections 72*a*, 72*b*, 72*c*, 72*d* moving laterally relative to each other at different rates. This enables each of the bottom conveyor sections 72*a*, 72*b*, 72*c*, 72*d* to be adjusted laterally outwardly or laterally inwardly relative to the center conveyor section 72*e* while maintaining an equal spacing between each of the adjacent conveyor sections. The dedicated motors 84, 86 and the vacuum air plenums 104 of the outer belt sections 72*a*, 72*i* move laterally with the belt sections.

Like the bottom conveyor, the top conveyor conveying surface 74 is also comprised of a plurality of individual belt conveyor sections. Each of the individual top conveyor sections is comprised of a continuous belt of flexible material or a continuous chain of plates connected together by hinge pins forming the continuous belt. The top conveyor differs from the bottom conveyor in that each of the belt sections have holes through the belt to provide a vacuum to each of the top conveyor belt sections and provide vacuum laterally across the top conveying surface sections 74*a*, 74*b*, 74*c*, 74*d* between their upstream 176 and downstream 178 pulleys. In addition, because the top conveying surface 74 is not supporting the array of objects conveyed through the bagging conveyor, it also differs from the bottom conveyor in that the top conveyor is comprised of only four conveyor belt sections arranged laterally side by side across the top conveyor. The top conveyor is shown in FIGS. 11, 12, 12*a*, 13, and 13*a*. FIGS. 12 and 12*a* are at the downstream end of the top conveyor 74 looking upstream. FIGS. 12*a* and 13*a* are enlargements of left-hand sections of the conveyor shown in FIGS. 12 and 13, respectively. Corresponding component parts of the conveyor on the right-hand sides of FIGS. 12 and 13 are identified with the same reference number as those on the left-hand side followed by a prime (′). Each of the four top conveyor belt sections 74*a*, 74*b*, 74*c*, 74*d* is wrapped around an upstream sprocket 176, a downstream sprocket 178 and an intermediate sprocket 182 that is vertically above the upstream and downstream sprockets. The spacing of the intermediate sprocket 182 vertically above the other two sprockets 176, 178 provides a void or opening inside the loops of the conveyor belt sections 74*a*, 74*b*, 74*c*, 74*d*. The void provides room for air plenums for each of the conveyor belt sections 74*a*, 74*b*, 74*c*, 74*d* that provide vacuum to the top conveying surface 74 of the top conveyor. Of the four top conveyor belt sections 74*a*, 74*b*, 74*c*, 74*d* the two middle sections 74*b*, 74*c* are driven at the same speed by a single motor 184. The two outer sections 74*a*, 74*d* have their own dedicated motors 186, 188 that can be operated to incrementally and individually increase or decrease the speeds of the outer conveyor sections 74*a*, 74*d* relative to the two intermediate conveyor sections 74*b*, 74*c*. The adjustments to the speeds of the outer conveyor sections 74*a*, 74*d* relative to the inner conveyor sections is for adjusting the orientation of the film of packaging material conveyed across the top conveying surface 74 in a manner explained later.

The two conveyor belt sections 74*a*, 74*b* to the left in FIG. 13 are substantially mirror images of the two conveyor belt sections 74*c*, 74*d* to the right in FIG. 13 and therefore only the left two conveyor sections will be described in detail. Referring to FIGS. 12*a* and 13*a*, the intermediate conveyor belt section 74*b* is supported between a pair of channels 190 at the bottom of a pair of side plates 192 that extend the longitudinal length of the conveyor section. The channels 190 hold the conveyor belt section 74*b* in a horizontal plane and prevent it from sagging downward from its own weight which would separate the belt section from its air plenum. A drive shaft 194 driven by the intermediate conveyor sections' motor 184 extends through the side plates 192. The downstream sprocket 178 of the conveyor section 74*b* is mounted on the drive shaft 194 by a spline connection that enables the sprocket to move laterally across the shaft. The upstream sprocket 176 of the intermediate conveyor belt section 74*b* is mounted on an idler shaft 196 that is supported between the pair of side plates 192. The intermediate sprocket 182 is also mounted on an idler shaft 198 supported between the pair of side plates, 192. The side plates 192 are part of an enclosed box that functions as an air plenum that delivers vacuum to holes (not shown) in the conveyor belt section 74*b* that provide the vacuum to the top conveying surface 74 of the top conveyor. The air plenum box has a pair of end walls 202 positioned just inside of the upstream sprocket 176 and downstream sprocket 178 and a top wall 204 that enclose the box. The bottom of the air plenum box is left open just above the top conveying surface 74 of the top conveyor. A laterally extending box 206 is attached to one side of the conveyor section air plenum box and communicates with the interior of the air plenum box. The laterally extending box 206 has a cylindrical collar 208 that is connected to a flexible tube (not shown) that provides the vacuum pressure from a blower to the interior air plenum box of the conveyor section 74*b*. Referring to FIG. 13*a*, connected between the pair of side plates 192 are bushings 212. The bushings 212 are mounted on lateral rods 214 for lateral sliding movement of the bushings 212 over the rods. The lateral rods 214 are supported by the framework of the conveyor system and thereby support each of the top conveyor sections 74*a*, 74*b*, 74*c*, 74*d* for lateral movement. A threaded nut 216 is also mounted between the pair of side plates 192. The nut 216 receives a threaded shaft 218. Thus, rotation of the shaft 218 in opposite directions causes the nut 216 to move laterally along the shaft which in turn causes the conveyor section 74*b* to move laterally relative to the bagging conveyor. By rotating the shaft 218 in different directions, the position of the conveyor section 74*b* can be laterally adjusted outwardly and inwardly relative to the center of the bagging conveyor. The nut and shaft of the conveyor section 74*c* on the right hand side are inversely threaded so that rotation of the shaft 218 in opposite directions causes the conveyor sections 74*b*, 74*c* to move away from each other and toward each other. Like the air plenums of the bottom conveyor, the bushings, rods, shafts and nuts of the top conveyor sections are sealed from their air plenums by channels (not shown) that cover over the bushings, rods, shafts and nuts in the air plenums.

The laterally outer conveyor section 74*a* is constructed in the same manner as its adjacent conveyor section 74*b*. It also is supported between a pair of channels 220 at the bottoms of a pair of side plates 222. The drive shaft 224 of the outer conveyor section downstream sprocket 178 extends into the interior between the side plates 222. However, the drive shaft 224 and motor 186 of the laterally outer conveyor section 74*a* is mounted to the conveyor section to move laterally with the conveyor section in the same manner as the laterally outer conveyor sections of the bottom conveyor. Thus, it is not necessary to connect the downstream sprocket 178 by a spline connect to the drive shaft 224. The upstream sprocket 176 is mounted on an idler shaft 226 and the intermediate sprocket 182 is mounted on an idler shaft 228 with both idler shafts being mounted between the pairs of side plates 222. The side plates 222 also function as part of an air plenum that is enclosed between the side plates and a pair of end plates 232 that are positioned just inside the upstream sprocket 176 and downstream sprocket 178. A top wall 234 encloses the air plenum positioned above the outer conveyor section 74*a*. A laterally extending plenum box 236 extends outwardly from one side of the air plenum of the conveyor section 74*a* and communicates with the interior of the plenum. A cylindrical collar 238 on the lateral box 236 is connected to a flexible hose (not shown) that communicates with a blower that produces the vacuum that is transferred through the hose, the lateral box 236 and to the interior of the air plenum positioned above the top conveying surface section 74*a*. In this manner, vacuum pressure is supplied through the holes (not shown) of the laterally outer conveyor section 74*a* to hold the film of packaging material to the top conveying surface 74 of the bagging conveyor. The laterally outer conveyor section 74*a* also has pairs of bushings 242 connected between its side plates 222 that are supported on the lateral rods 214 for lateral sliding movement of the bushings and the conveyor section over the rods. An internally threaded nut 246 is also mounted between the side plates 222. The nut 246 receives a screw threaded shaft 248. On rotation of the shaft, 248 in opposite directions, the nut 246 moves laterally across the shaft and in turn the laterally outer conveyor section 74*a* is caused to move laterally relative to the bagging conveyor. The nut in the conveyor section 74*d* on the right side of the conveyor is inversely threaded so that rotation of the shaft 248 in opposite directions causes the conveyor sections 74*a*, 74*d* to move away from and toward each other.

As with the bottom conveyor, the threaded shafts 218, 248 of the top conveyor sections 74*a*, 74*b* have different sized sprockets at their ends that cause the shafts to rotate at different speeds. This in turn causes the conveyor sections 74*a* 74*b* to be laterally adjusted at different rates just as was done with the bottom conveyor. Thus, the lateral positions between the top conveyor section 74*a*, 74*b*, 74*c*, 74*d* can be laterally adjusted outwardly and inwardly relative to the center of the top conveyor while maintaining an equal lateral spacing between the conveyor sections.

As shown in FIGS. 11 and 12, the top conveyor has a vertical height adjustment mechanism. The mechanism includes a hand wheel 258 connected by a sprocket and chain drive 260 to the top conveyor 74. Turning the hand wheel 258 in opposite directions raises and lowers the top conveyor.

Furthermore, the mechanisms that adjust the lateral spacing between the lower conveyor belt sections and the upper conveyor belt sections are interconnected so that the outward and inward adjustments of the lateral spacings between the lower conveyor belt sections 72*a*, 72*b*, 72*c*, 72*d*, 72*e*, 72*f*, 72*g*, 72*h*, 72*i* automatically adjusts outwardly and inwardly the lateral spacings between the upper conveyor belt sections 74*a*, 74*b*, 74*c*, 74*d*. The interconnection between the top and bottom conveyors is operated by turning the hand wheel 172 shown in FIGS. 7*a* and 10 in opposite directions. The interconnect provided between the top and bottom conveyor belt sections is provided by a parallelogram frame 252 shown in FIG. 7*a* that has four sprockets 254 mounted at pivot connections of the frame and a loop of chain 256 interconnecting the four sprockets as shown in FIG. 7*a*. Turning of the vertical adjustment hand wheel 258 adjusts the vertical position of the top conveyor 74 over the bottom conveyor 72. As the top conveyor is raised and lowered vertically relative to the bottom conveyor to adjust for objects of different heights being passed through the bagging conveyor, the parallelogram connection between the adjustment shafts of the top and bottom conveyors elongates vertically or elongates horizontally, maintaining a taut connection between the four sprockets 254 and their looped chain 256. The lateral adjustment shafts of the bottom and top conveyors are operatively connected to the upper and lower sprockets 254 of the parallelogram and these shafts are mechanically connected with the hand wheel 172 that adjusts the lateral spacings between the adjacent conveyor belt sections of the bottom and top conveyors. Thus, regardless of the vertically adjusted positions between the bottom conveyor and the top conveyor, the mechanical connections between the conveyor belt sections that adjust their lateral spacings is unchanged. Turning the hand wheel 172 in one direction adjusts sections of the top 74 and bottom 72 conveyors laterally apart and turning the hand wheel in the opposite direction adjusts the sections of the top 74 and bottom 72 conveyor laterally toward each other regardless of the adjusted vertical spacing between the top and bottom conveyors.

Bottom Packaging Film Dispenser

A bottom packaging film dispenser 262 is shown in FIG. 1 positioned below the bagging conveyor 12 and a top packaging film dispenser 264 is shown positioned above the bagging conveyor 12. The bottom packaging film dispenser supplies a film of packaging material from a roll of the material to the bottom conveying surface 72. The top packaging film dispenser supplies a film of packaging material from a roll of the material to the top conveying surface 74. Because the bottom and top packaging film dispensers are very similar in construction, the bottom packaging film dispenser 262 will be described first with the differences in the top packaging film dispenser 264 described later.

The bottom packaging film dispenser 262 is shown in FIGS. 14, 15, 17, 17*a*, 17*b*, 17*c* and 17*d*. First referring to FIGS. 14, 15, 17 and 17*a*, the bottom film dispenser 262 comprises a base 266 that is supported on a plurality of air cushions 268. The air cushions are selectively inflated and deflated to raise and lower the base. The base 266 has a lateral width that extends entirely beneath the bagging conveyor 12 and also extends laterally outwardly from one side of the bagging conveyor. A pair of rails 272 are positioned on the base and extend the lateral width of the base. A roll carrier 274 is mounted on the pair of rails 272 for lateral movement of the roll carrier between three positions where in the first two positions it is positioned on the rails laterally to one side of the bagging conveyor 12, and in the third position of the roll carrier it is positioned beneath the bagging conveyor. The lateral movement of the roll carrier across the rails is controlled by a motor 276 shown in FIGS. 14 and 17 that drives a sprocket 278 through a gear box. The drive sprocket 278 is positioned between a pair of idler sprockets 282 and a length of chain 283 partially shown in FIG. 17*a* extending from one end of the base 266 deflects around one idler sprocket 282, wraps around the drive sprocket 278, and then deflects around the other idler sprocket 282 and then extends along the lateral length of the base to the opposite end of the base positioned beneath the bagging conveyor.

The roll carrier 274 also supports sets of rollers shown in FIG. 14 with one set of rollers being drive rollers 284 and the other set of rollers being idler rollers 286. The drive rollers 284 are driven by a motor 288 mounted on the roll carriage. The pairs of drive rollers 284 and idler rollers 286 support a roll of the packaging material film 292 on the roll carrier 274 and rotate the roll of film on activation of their motor 288 as will be explained.

Positioned between the pairs of rollers 284, 286 in FIG. 14 is a roll tray 294 that is selectively raised and lowered relative to the carrier rollers by screw threaded actuators 296 and a chain drive 298 driven by a motor 302 shown in FIG. 17*a*. The movement of the tray 294 from its retracted position to its extended position raises the roll of film 292 supported on the rollers 284, 286 of the roll carrier above the rollers.

A vertical height sensing assembly 304 shown in FIGS. 15 and 17*a* is provided at one lateral end of the base 266. The assembly has a laterally projecting pin 306 that is used in sensing a vertically adjusted position of the film roll 292 as it is being elevated by the tray 294 for proper positioning of the film roll in the bottom film dispenser. A spent roll trough 308 is also mounted on the roll carriage 274 to one side of the tray 294 and a set of drape plates 312, 313 is mounted on the carrier on the opposite side of the tray as shown in FIGS. 14 and 14*a*. A vacuum cup 314 is provided on one of the drape plates for holding the film in position on the drape plates 312, 313 as the carrier is moved.

The bottom packaging film dispenser 262 also comprises a driving chuck 322 shown in FIGS. 17 and 17*d* positioned beneath the bagging conveyor where it receives one end of the roll of packaging material 292 supplied to the chuck by the roll carrier 274. The driving chuck 322 rotates the roll of film 292 so that the film is dispensed from the roll at a rate that is proportional to the rate that the bagging conveyor uses the film in bagging layers of objects conveyed through the conveyor. An idler chuck 324 shown in FIGS. 17 and 17*c* is also positioned beneath the bagging conveyor 12 for engagement in the opposite side of the roll of film 292 supplied to the driving chuck 322 by the roll carrier 274. The idler chuck 324 is mounted for rotation on an arm 326 that is mounted to a base 328 of the idler chuck for selective longitudinal movement of the arm and idler chuck relative to the idler chuck base. The idler chuck base 328 is mounted to a pair of rails 332 for selective lateral movement of the base, the idler chuck arm 326 and the idler chuck 324 relative to the drive chuck 322. The movement of the idler chuck relative to the drive chuck and the movement of the film roll carrier relative to the drive chuck are employed in replacing a roll of film that has been depleted from the bottom film dispenser with a new roll of packaging film. The procedure for replacing the spent roll of packaging film with a new roll of film is described later.

Referring to FIG. 14, the roll of packaging film 292 is supported in the bottom film dispenser 262 by the drive chuck 322 engaging in one end of the roll tube and the idler chuck 324 engaging in the opposite end of the roll tube. The free end 334 of the film is extended off the roll and passes across the top of two rollers 336, 338 supported on the framework of the dispenser with a spacing 342 between the rollers. A first set of hold-down pad actuators 344 is positioned along the length of the first roller 336 and a second set of hold-down pad actuators 346 is positioned along the length of the second roller 338. A series of air jets 348 extend laterally across the spacing 342 just above the pair of rollers 336, 338 as seen in FIG. 14. In addition, a bar 352 extends laterally across the spacing 342. The bar 352 is selectively moved upwardly and downwardly by a linear actuator (not shown) through the spacing 342 between the dispenser rollers 336, 338. A pair of heat seal/cut bars 354, 356 also extend laterally across the spacing 342 below the pair of dispenser rollers 336, 338. The heat seal/cut bars are known in the art and are operative to engage two overlapping pieces of the packaging material film against each other while applying heat to the film to form a heat sealed seam across the two overlapping pieces of film 335*b*, 337 while simultaneously forming a cut through the two pieces of film along the sealed seam. The heat bar 354 of the heat seal/cut bars is mounted stationary to the framework of the film dispenser and the opposing bar 356 is mounted on a series of actuators that selectively move the opposing bar 356 toward and away from the heat seal/cut bar 354. Just below the pair of heat seal/cut bars is a plurality of vacuum cups 358 that are spatially arranged laterally across one side of the spacing 342 between the dispenser rollers. The vacuum cups 358 are supported on a bar 362 that are in turn supported by a plurality of linear actuators that selectively move the vacuum cups 358 into and out of the spacing 342 between the pair of dispenser rollers.

The free end of packaging film 334 extends from the pair of dispenser rollers 336, 338 to a tensioning roller 368 that extends laterally across the dispenser and is supported by tensioning arms 372. As seen in FIGS. 14 and 17*b*, the tensioning arms 372 are in turn supported by a pivot shaft 374 intermediate to the lengths of the arms. The shaft 374 is operatively connected to a pivoting transducer 376 at one end of the shaft as shown in FIGS. 17 and 17*b*. The tensioning roller 368 is mounted at one end of the arms 372 and a linear actuator 378 is operatively connected to the opposite ends of the arms as shown in FIG. 14. The length of the film sheet 334 passes beneath the tensioning roller 368 and extends upwardly across the idler rollers 44 at the input of the bagging conveyor as shown in FIG. 5. From the idler rollers 44 the film of packaging material extends into the bagging conveyor 12 and across the bottom conveying surface 72 of the conveyor.

The tensioning roller shaft transducer 376 mounted on the end of the tensioning roller shaft 374 senses the pivoting movement of the shaft and controls the speed of the drive chuck 322 of the bottom film dispenser based on the pivoting movement. The speed of the drive chuck 322 is controlled so that the bottom film of packaging material is supplied to the bagging conveyor at a rate that is proportionate to the demand of the bagging conveyor or the rate at which the bagging conveyor is using the film material. When the speed of the drive chuck 322 supplies the film of packaging material to the bagging conveyor at a speed that maintains the tension arms 372 in a generally horizontal orientation as viewed in FIG. 14, the film of packaging material is being supplied to the bagging conveyor at the correct speed. If the weight of the tensioning roller 368 and the tension in the film of packaging material causes the roller 368 to move downwardly with a corresponding downward movement of the tensioning arms 372, the pivoting of the tension roller shaft 374 is sensed by the transducer 376. This indicates that the drive chuck 322 is supplying the film of packaging material to the bagging conveyor at too great a rate compared to the demand of the bagging conveyor or compared to the rate at which the film is being used by the bagging conveyor. This results in the motor of the drive chuck 322 being incrementally reduced in speed until the tensioning arms 372 are brought back to their general horizontal orientation which is sensed by the transducer 376 by the pivoting of the tensioning roller shaft 374. If the tension in the film of packaging material being supplied to the bagging conveyor causes the tensioning roller 368 and the tensioning arms 372 to raise above the general horizontal orientation, then the pivoting movement of the tensioning roller shaft 374 is sensed by the transducer 376. This indicates that the film of packaging material is being supplied by the drive chuck 322 at a slower rate than the rate at which the film is being used by the bagging conveyor. The motor of the drive chuck 322 is then controlled to incrementally increase the speed of the drive chuck so that the tensioning roller 368 and tensioning arms 372 return to their general horizontal orientation and the speed of the film material is supplied to the bagging conveyor at a rate that is proportional to the rate that the film is being used by the bagging conveyor.

The tensioning arms 372 also function as indicators of when the film of packaging material has been run off of the roll core tube at the end of the film. Referring to FIG. 14, when the end of the flim is reached, the free end of the film 335 causes the tension in the flim to be eliminated and the tensioning roller 368 and tensioning arms 372 immediately drop downwardly to their lowest position. This rotates the tensioning roller shaft 374 which is sensed by the transducer 376 which senses that the film has run off the roll. A proximity sensor 380 shown in FIG. 14*a* senses that the free end of the film 335 has parted from the roll tube and has dropped vertically downward away from the proximity sensor 380. The vertically fallen free end of the film 335*a* is shown in dashed lines in FIG. 14*a*. The signal of the transducer 376 that indicates that the tension roller 368 has dropped down to its lowest position, combined with the signal of the proximity sensor 380 that indicates that the end of the film 335*a* has fallen vertically downward causes the bagging conveyor to be stopped and the two hold-down pad actuators 344, 346 above the pair of dispenser rollers 336, 338 to activate and clamp down on the remaining portion of the flim that had not yet passed over the rollers. The end of the film of packaging material is then spliced to the beginning of a new roll of film loaded into the bottom film dispenser in a manner that is described later.

As shown in FIG. 14, the film of packaging material 334 extends from the roll supported in the bottom film dispenser 262 across the pair of dispenser rollers 336, 338 and then beneath the tensioning roller 368. The film 334 then extends upwardly and over the idler roller 44 at the input end of the bagging conveyor 12 shown in FIG. 5 and then extends across the bottom conveying surface 72 of the bagging conveyor. The film 334 is conveyed in the downstream direction by the movement of the separate conveyor belt sections 72*a*, 72*b*, 72*c*, 72*d*, 72*e*, 72*f*, 72*g*, 72*h*, 72*i* described earlier. FIGS. 10 and 10*a* show a pair of photo sensors 382 that are positioned at laterally opposite sides of the bagging conveyor adjacent the length of film that extends upwardly from the bottom tensioning roller 368 to the idler roller 44 leading into the bagging conveyor. The photo sensors 382 are positioned adjacent the opposite lateral edges of the film of material being fed into the bagging conveyor. If either of the photo sensors 382 on the laterally opposite sides of the bagging conveyor sense a side edge of the film of packaging material it indicates that the film has moved too far to that side and is slightly askew relative to the bottom conveying surface 72 of the bagging conveyor. This results in one of the motors 84, 86, each driving one of the laterally opposite conveyor sections 72*a*, 72*i* shown in FIG. 10 to incrementally increase its speed in order to straighten the film of packaging material passing over the bottom conveying surface 72. For example, if the photo sensor on the left side of the bagging conveyor looking in the upstream direction in FIG. 10 is obstructed, the motor 84 driving the bottom conveying surface section 72*a* on the left side is incrementally increased in speed to straighten the film of packaging material as it passes through the bagging conveyor. If the photo sensor on the right side of the bagging conveyor is obstructed, the motor 86 driving the right side conveying section 72*i* is incrementally increased in speed to straighten out the film of packaging material. In this way, the film of packaging material being supplied to the bottom conveying surface 72 is continuously monitored to ensure that it passes through the bagging conveyor in a substantially straight and centered orientation.

Top Packaging Film Dispenser

The top packaging film dispenser 264 shown in FIG. 16 is substantially the same as the bottom packaging film dispenser shown in FIG. 14 and therefore the reference numbers used in the description of the bottom packaging film dispenser 262 are also used in FIG. 16 in labeling the corresponding parts of the top packaging film dispenser 264. However, because the top packaging film dispenser 264 is positioned above the bagging conveyor, it does have some structural differences. The primary difference in the top packaging film dispenser 264 is the presence of an additional upper roller 386 and an additional set of hold-down pad actuators 388 arranged along the top of the additional roller. The film of packaging material 334' extends from the roll 292' across the spaced pair of dispenser rollers 336', 338' and then downwardly beneath the tensioning roller 368'. The film then extends upwardly as it does in the bottom packaging film dispenser 262. However, because the top packaging film dispenser 264 is positioned above the bagging conveyor, the film extends upwardly from the tensioning roller 368' and over the additional upper roller 386 and then extends downwardly, is deflected slightly by the roller 387 and extends to the bagging conveyor. The upper roller 386 functions in forming the V-shape in the film extending beneath the tensioning roller 368' so that the speed of the driving chuck of the top packaging film dispenser can be continuously adjusted in the same manner as that of the bottom packaging film dispenser. In addition, because the weight of the length of film extending downwardly from the upper roller 386 to the bagging conveyor would tend to pull the film downwardly when the film is run off the roll 292', the additional brake pad or hold-down actuators 388 are provided above the upper roll 386 to clamp down on the film when the end of the roll is sensed to prevent the weight of the free end of the film portion of the film hanging downwardly from the dispenser 264 from pulling it down out of the top packaging film dispenser 264 when the roll has run out and to maintain the V-shape in the film extending under the tension roller 368'. The top packaging film dispenser 264 also has a pair of laterally spaced photo sensors 382' shown in FIGS. 13, 13*a* and 16 that control the speeds of the laterally outer top conveying surface sections 74*a*, 74*d* to maintain a straight orientation of the flim being conveyed across the outer conveyor surface sections 74*a*, 74*d* of the top conveying surface 74 in the same manner as was done with the bottom packaging film dispenser 262 with the bottom conveying surface.

Packaging Film Side Edge Sealing Devices

The bottom film of packaging material 334 is conveyed beneath the layer of objects 18 supplied by the infeed conveyor 14 and conveyed through the bagging conveyor 12 with the film positioned on the bottom conveying surface 72 and under the layer of objects 18 positioned on the film. As the bottom film of packaging material is conveyed through the bagging conveyor, the opposite lateral side edges of the bottom film extend well beyond the opposite lateral edges of the laterally outermost bottom conveyor sections 72*a*, 72*i*. The laterally opposite side edge margins of the bottom film that extend beyond the laterally outer bottom conveyor sections 72*a*, 72*i* are folded upwardly by the bagging conveyor as the film is conveyed downstream through the bagging conveyor in a manner to be described. Additionally, the top packaging film dispenser 264 functions in the same manner as the bottom packaging film dispenser 262 to supply the film of packaging material to the top conveyor surface 74. The top film of packaging material is also conveyed through the bagging conveyor 12 by the top conveyor surface 74 with the vacuum transmitted through the holes in the top conveyor sections holding the top sheet of packaging material to the top conveying surface 74. The lateral width of the film of packaging material conveyed along the top conveyor surface is larger than the lateral width of the top conveying surface. This leaves side edge margins of the film that are folded downwardly along the laterally opposite sides of the layer of objects 18 being conveyed through the bagging conveyor in a manner to be described.

The bagging conveyor 12 also includes a pair of packaging film side edge sealing devices 392 that are positioned along the laterally opposite sides of the bottom conveying surface 72 and the top conveying surface 74. One of the film side edge sealing devices 392 is shown in FIGS. 18-24. The edge sealing device brings together and secures together the laterally opposite side edge margins of the bottom film of packaging material conveyed through the bagging conveyor and the laterally opposite side edge margins of the top film of packaging material conveyed through the bagging conveyor. There is one film side edge heat sealing device 392 positioned along each laterally opposite side of the bagging conveyor and because each device is a mirror image of the other, only one device is described.

Referring to FIG. 18, the film side edge sealing device 392 is comprised of a lower film edge guide 394 and an upper film edge guide 396. The two edge guides 394, 396 are positioned vertically opposite each other. The edge guides 394, 396 are positioned adjacent the lateral side edge of the bottom conveying surface 72 and top conveying surface 74 where the side edge margin of the bottom film of packaging material 334 and the side edge margin of the top film of packaging material 334' will be engaged by the respective lower edge guide 394 and upper edge guide 396 as they pass through the bagging conveyor in the downstream direction. The lower edge guide 394 guides the side edge margin of the bottom film 334 that extends beyond the lateral width of the bottom conveying surface 72 upwardly and the upper edge guide 396 guides the side edge margin of the top film 334' that extends beyond the lateral width of the top conveying surface 74 laterally downwardly, folding the two side edge margins of the films over the sides of the layer of objects 18 conveyed through the bagging conveyor 12.

The lower edge guide 394 has a guide surface 398 that guides the lateral side edge of the bottom film of packaging material 334 upwardly as the film is conveyed downstream by the bottom conveying surface 72. The lower guide surface 398 is provided by a continuous, narrow belt that is wrapped around an upstream pulley 402 and a downstream pulley 404 of the edge guide. The upper surface of the lower guide belt 398 functions as the lower guide surface that moves the side edge margin of the film of packaging material conveyed along the bottom conveying surface 72 upwardly across one side of the layer of objects conveyed through the bagging conveyor. It can be seen in FIG. 18 that as the upper surface of the lower edge guide belt 398 extends from the upstream pulley 402 to the downstream pulley 404, the guide surface also extends vertically upward until the guide surface reaches a larger idler pulley 406 adjacent to the downstream pulley 404. From the idler pulley 406 to the downstream pulley 404 the top surface of the lower guide belt 398 extends substantially horizontally. To assist in holding the side edge margin of the bottom film to the guide surface of the lower edge guide belt 398, a narrow air plenum shown in FIGS. 19 and 20 is constructed within the loop defined by the lower edge guide belt 398. The narrow air plenum 408 is basically a narrow elongate box that is closed at its opposite upstream and downstream ends and at its bottom and sides, but is open at the top where it is positioned adjacent the guide surface of the lower edge guide belt 398 as shown in FIGS. 18*a* and 18*b*. A vacuum port 409 is provided through the side of the plenum and is connected to a hose (not shown) that extends to a vacuum valve 410 shown in FIGS. 21 and 22. As shown in FIG. 18*a*, the opening at the top of the narrow air plenum 408 leaves narrow gaps 399 on the opposite sides of the lower edge guide belt 398 that are exposed to the vacuum within the air plenum. The vacuum in the gaps 399 on the opposite sides of the lower edge guide belt 398 holds the side edge margins of the packaging material 344 to the surface of the edge guide belt 398 and prevents the side edge margins of the packaging material from falling over the film edge guide 394 and into the bagging conveyor 12. The vacuum of the gaps 399 holding the side edge margins of the film 344 to the edge guide belt 398 also assists in the edge guide belt 398 moving the film edge margins along the bagging conveyor in the downstream direction as the bag is formed around the layer of objects. Still further, the vacuum at the gaps 399 holds the side edge margins of the film 334 to the guide belt 398 and keeps the lateral width of the film taut across the bottom of the layer of objects conveyed through the bagging conveyor and taut across the laterally opposite sides of the layer of objects in forming the bag around the layer of objects. However, the film 334 cannot be pulled too taut and must be able to slide laterally across the edge guide belt 398 to prevent the film from disrupting the two-dimensional array of objects in the layer conveyed through the bagging conveyor. Thus, the vacuum valve 410 is provided to regulate the vacuum in the gaps 399.

The bottom conveyor 72 is provided with a series of film edge margin guide plates that are arranged along the laterally opposite sides of the conveying surfaces. The guide plates are positioned adjacent and laterally outside the lower edge guide belts 394 at the laterally opposite sides of the conveyor. The series of guide plates arranged along the laterally opposite sides of the conveyor are the same and therefore only one series of guide plates on one side of the conveyor will be described.

The series of film edge guide plates includes a large guide plate 502 positioned adjacent the upstream end of the lower conveyor 72 and a narrow guide plate 504 positioned adjacent the downstream end of the bottom conveyor.

The large guide plate 502 can be seen in FIGS. 8, 9, 9*a*, 10, 10*a* and 18*a*. The upstream end of the plate is attached to the bagging conveyor by a pair of hinges 506 that can be seen in FIGS. 9, 9*a*, 10 and 10*a*. From the hinges 506 the large guide plate 502 extends in the downstream direction along the side of the edge guide belt 398 to a distal end 508 of the guide plate. The guide plate distal end 508 rests on top of the air plenum 408 of the edge guide belt 398 as shown in FIG. 18*a*. Because the downstream end of the large guide plate 502 rests on top of the air plenum and the upstream end of the large guide plate 502 is connected to the bagging conveyor by the hinges 506, the guide plate 502 will pivot about the hinges 506 upwardly and downwardly as the lower film edge guide 394 is moved upwardly and downwardly to accommodate layers of objects having different heights.

A small spacer 512 is attached to the top of the guide plate adjacent its distal end 508 as shown in FIGS. 10, 10*a*, and 18*a*. An angle iron bar 514 is attached on the spacer 512. As shown in FIG. 18*a*, the spacer 512 spaces the angle iron bar 514 a small distance above the top of the guide plate 502 defining a horizontal slot 516 between the top surface of the guide plate 502 and the angle iron bar 514. The slot 516 opens toward the edge guide belt 398.

The guide plate 502 supports the side edge margin of the film in a generally horizontal orientation adjacent the edge guide belt 398 as the film slides along the top surface of the guide plate 502. The film 334 side edge margin is positioned in the slot 516 between the top surface of the plate 502 and the bar 514. As the film is conveyed through the bagging conveyor, the side edge margin of the film on the guide plate 502 is pulled into the bagging conveyor. As the film edge margin is pulled into the bagging conveyor it has a tendency to roll up. The engagement of the film edge margin in the slot 516 between the top of the guide plate 502 and the bar 514 keeps the film edge margin generally horizontal relative to the edge guide belt 398 and prevents the film from rolling up.

The large guide plate 502 supports the film side edge margin sliding over the plate in a generally horizontal position adjacent the edge guide belt 398.

The level of vacuum in the gaps 399' on the opposite sides of the upper edge guide belt 398' shown in FIG. 18*b* function to keep the film tight across the lateral width of the top of the layer of objects and downwardly across the laterally opposite sides of the layer of objects as the layer of objects is conveyed through the bagging conveyor. The upper film edge guide 396 is also provided with a guide plate 522 that functions in the same manner as the guide plate 502 of the lower edge guide. However, the upper guide plate 522 differs from the lower guide plate 502 in that the upper guide plate is securely attached to the air plenum 408' of the upper film edge guide 396 by flanges 524 and bolt assemblies 526 shown in FIG. 18*b*. The upper guide plate 522 is attached to the air plenum 408' in a position adjacent to and just above the edge guide belt 398' of the upper film edge guide. The upper guide plate 522 functions in the same manner as the lower guide plate 502 in keeping the side edge margin of the film 334' adjacent the edge guide belt 398' generally horizontal as it is conveyed through the bagging conveyor 12.

The narrow film edge guide plate 504 of the bottom conveyor 72 is positioned adjacent the downstream end or distal end 508 of the large guide plate 502. The narrow film edge guide plate 504 is shown in FIGS. 23, 25 and 26. The narrow plate 504 has a length with an upstream distal end 532 with its opposite downstream end 534 connected to a hinge 536. The hinge 536 connects the narrow plate downstream end 534 to a sonic welder guide plate 538. The narrow plate upstream end 532 rests on the air plenum 408 of the lower film edge guide 394 and is positioned just slightly below and slightly away from the distal end 508 of the large guide plate 502. The film 334 edge margin that passes over the large guide plate 502 is passed on to the top surface of the narrow plate 532 as the film is conveyed through the bagging conveyor. As the upper film edge margin 334' exits its supporting guide plate 522, the upper film edge margin 334' comes to rest on the lower film edge margin 334. Hence, the upper film edge margin 334' and the lower film edge margin 334 become supported by the narrow film edge guide plate 504 and the sonic welder guide plate 538 as the two film edge margins pass through the sonic welder 419. The hinge 536 of the narrow guide plate 532 allows the plate to pivot about the hinge as the lower film edge guide 394 and the upper film edge guide 396 pivot relative to each other as the edge guides are raised and lowered to accommodate layers of objects having different heights.

As layers of objects with greater or larger heights are conveyed through the bagging conveyor the lower film edge guide 394 and upper film edge guide 396 will be moved upwardly to accommodate the layer of objects having the increased height. The upward movement of the edge guide 394, 396 causes the downstream ends of the edge guides to pivot about the pivot axes of their large idler pulleys 406, 406' and remain vertically adjacent to each other at the downstream ends. The upstream ends of the edge guides pivot about the pivot axes of the large drive pulleys 402, 402' as the large drive pulleys 402, 402' are spread vertically apart. This causes the angle between the lower film edge guide 394 and the upper film edge guide 396 to increase. Conversely, as layers of objects having smaller heights are conveyed through the bagging conveyor, the lower film edge guide 394 and upper film edge guide 396 are lowered while the pivotable downstream ends of the edge guides remain vertically adjacent each other. This causes the angle between the lower film edge guide 394 and upper film edge guide 396 to decrease. Through the increasing and decreasing angles of the lower film edge guide 394, the large film guide plate distal end 508 and the narrow film guide plate upstream end 532 remain in engagement with the top of the lower film edge guide vacuum plenum 408. This provides a substantially continuous surface for supporting the side edge margin of the film as the film is conveyed through the bagging conveyor to the sonic welder guide plate 538 at the downstream end of the edge guides 394, 396.

The vacuum valve 410 is mounted to the main vacuum pressure plenum (not shown) that is the same vacuum source that supplies vacuum to the bottom conveying surface 72 and top conveying surface 74. However, the vacuum valve 410 reduces this vacuum pressure for use in the film edge guide 394. The vacuum valve 410 has a valve housing with a large input orifice 411 that supplies vacuum pressure to the interior of the housing of the vacuum valve 410 and a smaller output orifice 412 that communicates the housing of the vacuum valve 410 with the lower flim edge guide 394. A pressure relief opening 413 is also provided in the housing of the vacuum valve 410. A valve stopper 414 is biased against the pressure relief opening 413 by a spring 415 on the exterior of the vacuum valve housing 410 that biases a stem 416 of the valve away from the housing. This also biases the stopper 414 in engagement over the pressure relief opening 413 in the interior of the vacuum valve housing 410. The biasing force of the spring 415 is adjusted by turning a nut 417 on the end of the stem 416. When the vacuum pressure inside the vacuum housing 410 becomes too great it pulls the stopper 414 away from the relief opening 413 against the bias of the spring 415. In this manner, the vacuum valve 410 regulates the vacuum pressure supplied to the lower film edge guide 394. The vacuum pressure in the lower film edge guide 394 is exposed to the exterior of the edge guide plenum 408 through the openings or gaps 399 at opposite sides of the edge guide belt 398 which allows passage of the vacuum on each side of the guide belt 398 as shown in FIG. 18*a* and draws the side edge margins of the packaging film being drawn through the edge guide 394 into contact with the guide surface of the belt 398. By adjusting the vacuum valve 410 to control the level of the vacuum pressure in the gaps 399 on opposite sides of the edge guide belt 398, the friction contact between the edge guide belt 398 and the side edge margins of the packaging film 334 can be adjusted and the lateral tension in the packaging material film of the bag being formed around the layer of objects being conveyed through the bagging conveyor 12 can be controlled. Adjusting the vacuum valve 410 to increase the vacuum level at the gaps 399 on the opposite sides of the edge guide belt 398 increases the lateral tension in the packaging material film of the bag being formed around the layer of objects conveyed through the bagging conveyor 12. Likewise, adjusting the vacuum valve 410 to decrease the vacuum at the gaps 399 on opposite sides of the edge guide belt 398 decreases the lateral tension in the packaging material film and decreases the firmness of the bag being formed around the layer of objects being conveyed through the bagging conveyor 12.

The upper film edge guide 396 is constructed in the same manner as the lower film edge guide 394 and component parts of the upper guide are identified using the same reference numbers as the lower guide but followed by a prime (').The upper edge guide 396 is basically a mirror image of the lower edge guide 394 positioned above the lower edge guide. The guide surface of the upper edge guide belt 398' directs the side edge margin of the upper film of packaging material 334' vertically downward across the side of the layer of objects as the layer of objects is conveyed through the bagging conveyor. The belts 398, 398' of the lower and upper edge guides are driven at a rate that is proportional to the rate at which the film of packaging material moves through the bagging conveyor and bring the laterally opposite side edges of the film together across the laterally opposite sides of the layer of objects conveyed through the bagging conveyor. As the lower and upper packaging films and the layer of objects reach the downstream pulleys 404, 404' of the lower and upper edge guides, the laterally opposite side edges of the bottom sheet and the laterally opposite edges of the top sheet have been brought together over the laterally opposite sides of the layer of objects and are positioned side by side with lateral edge margins of the two films projecting laterally outwardly from opposite sides of the layer of objects. To compensate for the angle formed in the side edge of the film as it is moved through the edge guides, the laterally outer most rollers of the bottom conveyor input rollers 44 and top conveyor input rollers 44', shown in FIGS. 2, 3, 3*a*, 5, and 6, are tapered outwardly. This prevents the film side edges from wrinkling as they pass through the edge guides. The laterally opposite side edge margins of the two films are then delivered to film edge sealing devices positioned just downstream of the lower film edge guide 394 and upper edge film guide 396.

The film edge sealing devices on the laterally opposite sides of the bagging conveyor are basically the same and therefore only one will be described in detail. Referring to FIGS. 23-27, the film edge sealing device on the right-hand side of the bagging conveyor looking in the downstream direction is shown. The device includes a support plate for a 418 mounted to the bagging conveyor, a sonic welder 419 mounted to the support plate, a pivot block 420 mounted by a pivot connection 421 to the support plate and a welder guide wheel block 422 mounted for free vertical sliding relative to the support plate. In FIGS. 23-27, the two films of packaging material 334, 334' to be joined along their side edge margins move from right to left in FIGS. 18, 23 and 26, from left to right in FIG. 25 which is a view of the opposite side of the device shown in FIG. 23, and move into the Figures of 24 and 27.

The downstream pulleys 404, 404' of the side edge guides are mounted on the support plate 418 by a pair of shafts 423, 424. The shafts 423, 424 extend through the support plate 418 to the opposite side of the support plate shown in FIG. 25. Lower and upper pulley drives are provided on the opposite side of the support plate. The upper pulley drive includes an upper upstream pulley 425 that is mounted on the same shaft 424 as the downstream pulley 404' of the upper side edge guide 394'. The upper pulley transmission also includes a downstream pulley 426 mounted on a shaft 427 that is mounted for rotation in the pivot block 420. The downstream pulley 426 is slightly smaller than the upstream pulley 425 so the shaft 427 of the downstream pulley will rotate slightly faster than the shaft 424 of the upstream pulley. A belt 428 connects the upstream pulley 425 with the downstream pulley 426. An upper slip roller or slip wheel 429 is mounted on the upper downstream shaft 427 on the opposite side of the pivot block 420 from the upper downstream pulley 426. Thus, due to the difference in size between the upper upstream pulley 425 and the upper downstream pulley 426, the upper slip roller 429 will rotate slightly faster than the upper downstream pulley 404' of the side edge guide. The elasticity of the belt 428 looped around the upstream pulley 425 and the downstream pulley 426 causes the pivot block 420 to pivot on the axis of the pivot shaft 421 downwardly The elasticity of the belt 428 causes the upper slip roller 429 to apply and maintain pressure against the lower slip roller 441. A spring biased adjustment 430 is provided on the support plate 418 and engages with the pivot block 420 to bias the pivot block and the upper slip roller 429 upwardly under the bias of the spring of the adjustment.

The lower pulley transmission includes a lower upstream pulley 431 that is mounted on the same shaft 423 as the downstream pulley 404 of the side edge guide. The lower transmission also includes an intermediate pulley 432 and a downstream pulley 433. As seen in FIGS. 24 and 27, the lower intermediate pulley 432 is a double pulley that is mounted on a shaft 434 that extends through an opening in the support plate 418 that is slightly larger than the shaft and through the welder guide wheel block 422. A welder guide wheel 436 is mounted on the intermediate pulley shaft 434 adjacent the welder guide wheel block 422 and the sonic welder guide plate 538 and just below the lower end of the horn of the sonic welder 419. A first lower pulley belt 437 connects the upstream lower pulley 431 with the intermediate pulley 432. The lower upstream pulley 431 and the lower intermediate pulley 432 are of the same size and therefore the welder guide wheel 436 will rotate at the same speed as the lower downstream pulley 404 of the edge guide. A second lower belt 438 extends between the intermediate pulley 432 to the lower downstream pulley 433. The lower downstream pulley 433 is mounted on the support plate 418 by a shaft 440 that passes through the support plate to the opposite side of the support plate where a lower slip roller or slip wheel 441 is mounted on the shaft. The lower downstream pulley 433 is of the same size as the upper downstream pulley 426 and is smaller than the intermediate pulleys 432 and the lower upstream pulley 431. This causes the lower downstream pulley 433 to rotate faster than the lower upstream pulley 431 and in turn causes the lower slip roller 441 to rotate faster than the lower upstream pulley 431 and the downstream pulley 404 of the lower edge guide.

The welder guide wheel block 422 is mounted to the support bar 446 for a limited vertical movement of the block relative to the support plate 418. A screw threaded knob 442 mounted over a sleeve 443 extends through the bottom of a support bar 446 mounted on the support plate 418 and is screw threaded into the welder guide wheel block 422 as shown in FIGS. 23, 24, 26 and 27. The engagement of the sleeve 443 between the head of the screw threaded knob 442 and the bottom of the support bar 446 limits the vertical upward movement of the welder guide wheel block 422. An air cylinder 444 is mounted on the support bar 446 below the welder guide wheel block 422. The air cylinder 444 has a piston rod 445 that extends from the cylinder and contacts the underside of the welder guide wheel block 422. Providing air pressure to the cylinder 444 biases the rod 445 and the welder guide wheel block 422 upwardly. The upward movement of the block 422 is limited by the adjustment of the screw threaded knob 442. The air pressure in the cylinder 444 is employed to bias the welder guide wheel 436 toward the bottom of the sonic welder 419 to hold the side edge margins of the film 334, 334' in a predetermined gap between the guide wheel 436 and the bottom of the sonic welder 419. The air pressure applied to the air cylinder 444 is controlled by an air regulator (not shown) to exert an upwardly biasing force on the welder guide wheel 436 and control the upward biasing force while the guide wheel 436 is at its upper-most position with a desired gap between the guide wheel 436 and the bottom of the horn of the sonic welder 419. The controlled upwardly biasing force exerted by the air cylinder 444 on the welder guide wheel 436 in the upper most position of the wheel gapped below the sonic welder 419 allows the welder guide wheel 436 to generally float in the gapped position beneath the sonic welder 419 and deflect downwardly. This allows the welder guide wheel 436 to move downwardly in the event that a pleat or pleats are formed in either of the film side edge margins 334, 334' or both of the margins that would require a greater gap between the welder guide wheel 436 and the bottom of the sonic welder 419 to pass the extra thickness of the film side edge margins. In addition, the air pressure supplied to the air cylinder 444 of the welder guide wheel 436 can be selectively cut off. This causes the welder guide wheel 436 to drop downwardly a set distance below the sonic welder 419 providing a large gap between the welder guide wheel 436 and the bottom of the sonic welder 419 that provides adequate access for feeding the side edge margins of the packaging film 334, 334' between the sonic welder 419 and the welder guide wheel 436 on initial set up of the bagging conveyor 12. The screw threaded knob 442 provides an adjustable limit to the upward movement of the welder guide wheel block 422 to provide a gap (air space) between the sonic welder 419 and the welder guide wheel 436. The gap (air space) between the welder 419 and the guide wheel 436 is necessary for proper fusing (welding) of the side edges of the films 334, 334' together. Further, the gap is necessary to prevent damage to the sonic welder 419 by its coming into contact with the welder guide wheel 436.

In operation of the side edge margin sealing device, the two edge margins of the film 334, 334' exiting the side edge guide downstream pulleys 404, 404' are routed between the welder guide wheel 436 and the bottom of the sonic welder 419 and then between the lower slip roller 441 and the upper slip roller 429. On operation of the bagging conveyor, because the upper downstream pulley 426 and the lower downstream pulley 433 of the upper and lower pulley transmissions are smaller than their respective upper upstream pulley 425 and lower upstream pulley 431, the upper and lower slip rollers 429, 441 will rotate slightly faster than the output pulleys, 404, 404' of the lower and upper side edge guides. This causes the slip rollers 429, 441 to pull the two edge margins of the film 334, 334' taut as the edge margins are pulled between the welder guide wheel 436 and the sonic welder 419. This insures a smooth seam welded along the side edge margins of the films 334, 334' and prevents the side edge margins from bunching up in front of the welder guide wheel 346 and the sonic welder 419.

The position of the welder guide wheel 436 relative to the sonic welder 419 can be adjusted by the screw threaded knob 442 to the desired gap (air space) for different thicknesses of packaging film. In addition, the force of engagement of the slip rollers 429, 441 pinching the two film side edge margins between the rollers can be adjusted by the upper spring biased adjustment 430 on the pivot block 422.

The support plate 418 of the sonic welder 419 is suspended by a chain 447. The chain 447 extends upwardly and wraps over a sprocket that is operatively connected with the driving connection that raises and lowers the top conveyor 74 by rotating the hand wheel 258 in opposite directions. Because the bottom end of the sonic welder 419 and its opposing welder guide wheel 436 are generally positioned in the middle of the height of the layer of objects being conveyed through the bagging conveyor 12, rotating the hand wheel 258 to raise the top conveyor 74 a set distance to accommodate the height of the layer of objects being conveyed through the bagging conveyor 12 will only elevate the sonic welder support plate 418 one half of that set distance. This will position the bottom of the sonic welder 419 and its opposing guide wheel 436 as well as the other sonic welder components approximately at the middle of the height of the layer of objects being conveyed through the bagging conveyor to form the side seams in the films of packaging material around the layer of objects.

The lower film edge guide downstream pulley 404 and idler pulley 406 and the upper film edge guide downstream pulley 404' and idler pulley 406' are also supported on the sonic welder support plate 418. As the support plate 418 is raised and lowered, the downstream pullies 404, 404' and idler pullies 406, 406' of the respective lower film edge guide 394 and upper film edge guide 396 are raised and lowered. This results in changing the angle between the lower edge guide belt 398 and the upper edge guide belt 398' discussed earlier when describing the film edge guide plates 502, 504 of the lower edge guide 394 and the film edge guide plate 522 of the upper edge guide 396. To maintain the vertical orientation of the sonic welder 419, the top of the support plate 418 is provided with an elongated u-shaped notch 448 that extends downwardly through the top of the support plate. The notch 448 is received in sliding engagement on a spool 449 shown in FIG. 7 that maintains the support plate 418 in its vertically oriented position as the support plate is elevated and lowered. In addition, the spool 449 is mounted on a square cross-sectioned shaft (not shown) that enables the spool to move laterally across the width of the bagging conveyor 12 when adjusting the lateral widths of the sections of the top conveyor 74 and bottom conveyor 76 to accommodate two-dimensional arrayed layers of objects having different lateral widths.

Transverse Heat Seal/Cut/Seal Device

Referring to FIGS. 28-32, just downstream of the bagging conveyor 12 is a plurality of brake pads or hold-down pads 454 similar to the hold-down pads 68 at the upstream end of the bagging conveyor. Through each hold down pad is a set of air jet ports 456 that are directed downwardly. The hold down pad actuators 454 and the air jet ports 456 are each operatively connected with one of the top conveyor sections 74*a*, 74*b*, 74*c*, 74*d* so that they are adjusted laterally when the top conveyor sections are adjusted laterally and move up and down when the top conveyor sections are moved up and down. Just below these hold-down pad actuators 454 is a plurality of dead plate sections 458 that are each associated with a conveyor section of the bottom conveying surface 72. Each of the individual dead plates 458 is operatively connected with one of the bottom conveying surface sections 72*a*, 72*b*, 72*c*, 72*d*, 72*e*, 72*f*, 72*g*, 72*h*, 72*i* so that the dead plate sections move laterally relative to each other as the bottom conveying surface sections are laterally moved relative to each other. In addition, each of the dead plate sections 458 has a set of air jet ports 462 through the dead plate section in a position to eject a jet of air upwardly from the dead plate section. These air jet ports 462 eject air to reduce the drag of the film and layer of objects sliding across the dead plate. Just above the dead plates and positioned to one lateral side of the bagging conveyor 12 is a first photo sensor 464 that determines when a layer of objects conveyed by the bagging conveyor has reached this point in the bagging conveyor. Just below that photo sensor is a second photo sensor 466 that determines if an object in a layer of objects just transferred out of the bagging conveyor 12 has fallen over into the gap between sequential layers of objects discharged from the bagging conveyor or if an object in the front row of the next sequential layer of objects has fallen into the gap. Further downstream from the dead plate sections 458 and the photo sensors 464, 466 as shown in FIG. 30 is a heat seal/cut/seal bar 468 and its vertically spaced opposing bar 472. The two bars 468, 472 extend laterally across the width of the bagging conveyor and across the width of the bottom film 334 and top film 334' conveyed through the bagging conveyor.

The heat seal/cut/seal bars 468, 472 between the bagging conveyor 12 and the outfeed conveyor 16 are known in the art. They connect the bottom film of packaging material 334 to the top film of packaging material 334' along sealed seams between the two films and cut the seams formed in the films in the middle of the seams as sequential layers of objects are conveyed through the bagging conveyor 12 to the outfeed conveyor 16. Thus, a seam is sealed across the films at the end of the bagged layer of objects that has just left the bagging conveyor and across the films at the beginning of the next layer of objects being conveyed by the bagging conveyor with a transverse cut separating the seams.

In order to ensure that there is a sufficient gap between sequential layers of objects conveyed through the bagging conveyor 12 to provide adequate lengths of the bottom film of packaging material 334 and top film of packaging material 334' to form the lateral seam across the material, the bagging conveyor is provided with a pair of side by side photo sensors 474, 476 along the longitudinal length of the conveyor shown in FIGS. 7, 7*a*, and 8. These double photo sensors 474, 476 sense the positioning of a layer of objects in the bagging conveyor to produce the preferred gap, typically 6-7 inches, between sequential layers of objects conveyed through the conveyor that will provide adequate lengths of the top and bottom films of packaging material at the output end of the bagging conveyor for forming the laterally transverse sealed seam in the films of packaging material. The preferred gap size would change depending on the size of the objects being conveyed and on the thickness and flexibility of the packaging film.

In the desired positioning of sequential layers of objects conveyed though the bagging conveyor to provide adequate lengths of the upper and lower sheets of packaging material between sequential layers to form the transverse seam across the upper and lower sheets of material, when the bagging conveyor is stopped while a transverse seam is being formed across the two sheets of packaging material by the pairs of heat seal/cut/seal bars 468, 472, which is later explained, the rearward end of the next layer of objects conveyed through the bagging conveyor would straddle the double photo sensors 474, 476. The layer of objects would block the forward most photo sensor 474 and the rearward most photo sensor 476 would sense a light signal across the bagging conveyor. This indicates to the control system of the conveyor that the next sequential layer of object is in the desired position in the conveyor. With the double photo sensors 474, 476 indicating that the back of the layer of objects in the bagging conveyor straddles the double photo sensors, the next sequential layer of objects to be pushed into the bagging conveyor by the pusher bar 52 would be pushed past the photo sensor 477 shown in FIGS. 7, 7*a* and 8 for a predetermined time whereby the pusher bar 52 positions the layer of objects being pushed into the bagging conveyor at the desired spacing relative to the layer of objects already in the bagging conveyor and straddling the double photo sensors 474, 476. If both of the double photo sensors 474, 476 are uncovered indicating that the layer of objects in the bagging conveyor is further downstream in the bagging conveyor from the double photo sensors, then the pusher bar 52 will push the next subsequent layer of objects into the bagging conveyor past the input photo sensor 477 for a slightly greater period of time in order to position that subsequent layer of objects closer to the layer of objects already in the bagging conveyor. If the double photo sensors 477, 476 are both covered by the layer of objects in the bagging conveyor, then the pusher bar 52 will push the next subsequent layer of objects into the bagging conveyor and past the input photo sensor 477 for an incrementally shorter period of time so as to enlarge the gap between the layer of objects already in the bagging conveyor and the subsequent layer of objects being pushed into the bagging conveyor by the pusher bar 52.

The bagging conveyor 12 continues to operate so long as there is room on the outfeed conveyor 16 to receive bagged layers of objects from the bagging conveyor 12. The time involved in forming the transverse seals across the ends of subsequent layers of objects bagged by the bagging conveyor 12 is only a few seconds, therefore the bagging conveyor 12 and the infeed conveyor 14 is generally operated continuously except for short periods during the heat seal/cut/seal operation. However, if there is a backup caused on the outfeed conveyor 16 so that the outfeed conveyor could not receive any further bagged layers of objects from the bagging conveyor 12, the bagging conveyor would be stopped until the back up on the outfeed conveyor 16 is cleared. Depending on the condition sensed by the double photo sensors 477, 476, and the downstream photo sensor 464 it may be necessary to subsequently stop the pusher bar 52 from pushing any additional layers of objects from the infeed conveyor 14 into the bagging conveyor 12 while the bagging conveyor is stopped. In this situation, the pusher bar 52 will be stopped following a predetermined incremental time period that corresponds to the status of the photo sensors 476, 477 discussed earlier. As the particular predetermined time period elapses and the pusher bar 52 stops, the hold down pads 68 are activated to extend downwardly and hold a row of objects of a layer of objects entering the bagging conveyor between the hold down pads 68 and the dead plates 46 below the pads shown in FIG. 5. This allows the infeed conveyor 14 to continue to operate in forming two dimensional arrayed layers of objects on the infeed conveyor 14 while the bagging conveyor 12 is stopped.

The heat seal/cut/seal bars 468, 472 that extend laterally across the bottom and top sheets 334, 334' of packaging material at the downstream end of the bagging conveyor 12 are similar to the heat seal/cut bars 354, 356 of the packaging material dispenser 262 described earlier and are known in the art. Basically, these bars move vertically toward and away from each other bringing the bottom sheet 334 and top sheet 334' of packaging material together forming a seam across the material while simultaneously cutting across the material at the middle of the seam forming two separate seams. Thus, the heat seal/cut/seal bars 468, 472 at the downstream end of the bagging conveyor 12 complete enclosing each layer of objects transferred through the conveyor in a bag of the packaging material with the bottom sheet 334 and top sheet 334' of the material passed through the conveyor being seamed along opposite lateral sides of the layer of objects and along opposite longitudinal ends of the layer of objects and separates each bagged layer of object as they are discharged from the bagging conveyor 12 to the outfeed conveyor 16 that supplies the bagged layers of objects to a palletizer.

Referring to FIGS. 30, 31 and 32, as the bagging conveyor 12 transfers a layer of objects to the outfeed conveyor 16 the air jets 462 of the downstream dead plates 458 eject jets of air upwardly from the dead plates against the bottom sheet of packaging material 334 crossing over between the bagging conveyor 12 and the infeed conveyor 14. These jets of air decrease the friction of the packaging material passing over the dead plates between the two conveyors. There are also rollers 478 on the dead plate 479 shown in FIGS. 30 and 32 that assist in the movement of the film 334 and objects over the dead plate 479.

The gap between sequential layers of objects transferred from the bagging conveyor 12 to the outfeed conveyor 16 is sensed by the first photo sensor 464 positioned between these two conveyors. When the gap is sensed by the photo sensor the bottom air jets 462 are deactivated and the air jets 456 of the brake pads 454 positioned laterally across and above the gap are activated. This causes the top sheet of packaging material 334' extending across the top of the gap to bow downwardly which prevents objects in the last row of the layer of objects discharged from the bagging conveyor and objects in the front row of the layer of objects next to be discharged from the bagging conveyor from falling over into the gap. These top air jets continue to blow air above the gap maintaining a downward bow of the top film 334' for a short period following the beginning of the next sequential laterally transverse heat seal/cut/seal operation.

At this point the bagging conveyor 12 is stopped and the hold down pad actuators 454 that extend laterally across the dead plates 458 at the downstream end of the bagging conveyor are activated. This causes the hold down pads 454 to move downwardly holding the forward row of objects of the layer of objects in the bagging conveyor down against the dead plates 458 and prevents the objects in the forward row from falling over into the gap between subsequent layers of objects. The pads also prevent the objects of the layer in the bagging conveyor from moving rearwardly or upstream disturbing the two dimensional array when the laterally transverse sealing and cutting operation takes place. The second photo sensors 466 in the gap between subsequent layers of objects senses whether a bottle(s) of the previously discharged layer or the layer to be discharged from the bagging conveyor 12 has fallen over into the gap. If a downed object(s) is detected the bagging conveyor is stopped at the next lateral seal/cut/seal procedure just before the procedure starts. If no object is detected, the transverse seam and cutting operation begins.

Prior to initiating the transverse sealing and cutting operation, the bagging conveyor 12 is stopped, the hold down pads 454 are then activated downwardly and then the top air jets 456 at the downstream end of the conveyor are stopped. The upper heat seal/cut/seal bar 468 and lower opposing bar 472 both extend completely across the bottom sheet 334 and top sheet 334' of packaging material conveyed through the bagging conveyor. The lower bar 472 is supported on a support base 482 that is selectively moved vertically upward and downward by a pair of screw threaded linear actuators 484. The actuators 484 are selectively moved upwardly and downwardly by a motor 486 that drives the actuators through a gear belt drive 488. The brakes 490 are applied to lock the movement of the opposing bar 472 in place at a predetermined height that is about the middle of the height of the objects. The upper seal bar 468 is mounted on a support base 492 that is suspended from the conveyor framework by a plurality of pneumatic actuators 494. By selective activation of the lower bar actuators 484 and the upper bar actuators 494, the upper heat seal/cut/seal bar 468 and the lower opposing bar 472 are brought vertically together pinching the bottom film 334 and top film 334' of packaging material together between the bars and adjacent the leading edge of the layer of objects emerging from the bagging conveyor. The engagement of the two bars 468, 472 together forms a sealed seam laterally across the films of packaging material and simultaneously cuts across the films of packaging material intermediate the formed seam. In this manner, an end seam is formed between the bottom film 334 and top film 334' of the packaging material as the layer of objects is stopped adjacent the downstream end of the bagging conveyer. In addition to forming the seam between the two films of the packaging material enveloping the layer of objects in the bagging conveyor, the two heat seal/cut/seal bars 468, 472 also form the seam at the end of the layer of objects just discharged from the bagging conveyor to the outfeed conveyor 16. Thus, as the bottom film 334 and the top film 334' are brought together by the heat seal/cut/seal bars 468, 472 in forming a seam in the packaging material laterally across the downstream end of the layer of objects conveyed by the bagging conveyor 12, they are simultaneously forming a lateral seam across the bottom film and top film of packaging material that envelopes a preceding layer of objects that has just been fed to the outfeed conveyor 16 and forming a lateral seam across the bottom film and top film at the front of the layer of objects emerging from the bagging conveyor while also separating the bagged layer of objects fed to the outfeed conveyor 16 from the bagged layer of objects in the bagging conveyor 12. On completion of the lateral sealing and cutting operation by the heat seal/cut/seal bars 468, 472 the bars are vertically separated from each other, the bottom air jets 462 at the downstream dead plates 458 are activated, the hold down pads 454 at the upstream end of the bagging conveyor are deactivated, if the hold down pads 68 at the upstream end of the conveyor are activated they are then deactivated and the bagging conveyor 12 and pusher bar 52 are again set into operation.

Film Splicing Apparatus

Both the bottom film dispenser 262 and the top film dispenser 264 comprise a splicer apparatus that connects the end of one roll of packaging material to the beginning of a subsequent role of packaging material loaded into the dispenser. Because the splicer apparatus for both dispensers is basically the same, the splicer apparatus will be described with reference to the bottom film dispenser 262.

Referring to FIG. 14, when the end of the film of packaging material 334 runs off the roll the tension is lost in the film and the tensioning roller 368 and arms 372 move downwardly to their extreme downward position. Also, when the free end of the packaging film 334 runs off the roll, the film free end falls downwardly while resting over the dispenser roller 336 to hang in a vertical position of the film free end **335*a* as shown in FIGS. 14 and 14*a*. When the free end of the packaging material 335*a* falls to the vertical position shown in FIGS. 14 and 14*a* it is sensed by the proximity sensor 380 which indicates that the film free end 335*a* has run off of the roll. The downward pivoting movement of the tension arm shaft 374 sensed by the shaft transducer 376 which indicates that the tension arm has fallen to its lowest position, and the sensing of the proximity sensor 380 that the film free end 335***a* has fallen to a vertical position draped over the roller 336 indicates that the film free end has run off of the roll. The bagging conveyor is stopped and the hold down pad actuators 344, 346 arranged across the spaced pair of dispenser rollers 336, 338 are activated engaging the free end of the film 334 between the actuators 344, 346 and the rollers 336, 338. The tension roller actuator 378 is then activated to move the tension roller 368 upwardly and produce some slack in the end of the film. The second hold down pads 338 are then released and the hold down pads 344 remain engaged with the dispenser roller 336. The film end vertical positioning bar 352 is then activated and caused to move downwardly through the spacing 342 between the spaced pair of dispenser rollers 336, 338. This causes the end of the film 334 to move downwardly through the spacing 342 taking up the slack in the film. The second hold down pads 346 are then again activated and the first hold down pads 344 are released causing the free end of the film 335*a* to move downward into the roller spacing 342. The lateral bar 352 is a hollow bar with an air hose fitting (not shown) connected at one end of the bar providing air under pressure to the interior of the bar. A series of air jets 353 are provided along the bottom of the bar 352 and communicate with the air pressure in the bar hollow interior. The lateral bar 352 is first moved downwardly to its furthest extent in the spacing 342 moving the film free end 335 at least partially into the spacing. Then air is ejected from the series of air jets 353 in the bottom of the lateral bar 352. The air ejected from the air ports 353 blows downwardly into the unshaped loop that may exist in the film free end 335*a* which blows the film downwardly so that the film free end 335*a* will hang vertically downwardly over the dispenser roller 338 and in the spacing 342. The positioning bar 352 is then removed from the spacing. The bar supporting the series of vacuum cups 358 is then extended into the spacing 342 and vacuum applied to the cups holds the end of the film 335*b* against the vacuum cups. The vacuum bar is then retracted providing adequate access in the spacing 342 for the free end 337 of the new role of film to be loaded into the dispenser 262.

While the above is occurring, the role dispenser driving chuck 322 shown in FIGS. 17 and 17*d* disengages from the tube of the spent role of the packaging material while the idler chuck 324 shown in FIGS. 17 and 17*c* still holds its end of the empty tube. The base 328 of the idler chuck 324 moves the idler chuck laterally away from the driving chuck 322 removing the tube from the driving chuck. The arm 326 of the idler chuck then moves longitudinally away from the driving chuck. At this position of the idler chuck 324 it is out of the way of the roll carrier 274 of the film dispenser that will move the new role of packaging material toward the driving chuck 322.

While the bagging conveyor 12 and the bottom film and top film dispensers 262, 264 are operating, ample time is available for loading a new role of packaging material onto the roll carrier 274 of the dispenser. The new roll is manually lifted by a hoist crane onto the rollers 284, 286 of the roll carrier 274 shown in FIG. 14. Manual controls for the motor 288 that rotate the rollers 284, 286 are activated to cause a short length of packaging material at the free end of the new roll to be dispensed from the role. This short length of packaging material is draped over the drape plates 312, 313. The drape plate has a tab projecting upwardly from one end (not shown) and the film end is draped over the drape plates 312, 313 against the tab to accurately position the film free end for splicing. After the film end is positioned over the drape plates an acknowledgement control is activated by the person loading the new roll. This causes the air cushions 268 of the base to inflate raising the base, and causes the motor 302 to elevate the roll tray 294 between the rollers 284, 286 to raise the roll to an initial elevated position of the roll over the carrier 274. This initial elevation of the roll positions the tube of the roll adjacent the vertical height sensing assembly 304 shown in FIG. 15. The pin 306 of the vertical height sensing assembly 304 projects outwardly toward the opening at the end of the roll tube. The roll tray 294 is then moved by the carrier 274 toward the vertical height sensing assembly 304 until a photo control 496 shown in FIG. 17*a* senses the new roll 292 being carried by the carrier 274 and causes the carrier movement to stop. At this point the pin 306 is inserted into the opening at the end of the roll tube. The roll tray 294 is then again slowly raised upwardly until the pin 306 engages with the bottom of the interior surface of the roll tube. The engagement of the pin 306 with the bottom interior surface of the roll tube raises a block supporting the pin which is sensed by a proximity sensor 307 shown in FIGS. 15 and 17*a* which indicates that the roll of packaging material has been raised to its proper position for loading the roll onto the driving chuck 322 of the dispenser 262. The pin is then retracted.

When a roll of film being used is depleted and the empty roll tube is removed from the drive chuck and moved to the side by the movement of the idler chuck described earlier, then the carrier motor 276 is next actuated causing the roll carrier 274 with the loaded new roll of packaging material supported on the elevated tray 294 to move laterally beneath the bagging conveyor and toward the driving chuck 322. The movement of the carrier 274 causes the driving chuck 322 to be inserted in one end of the tube of the packaging material roll. A photo sensor 267 shown in FIGS. 17 and 17*d* is positioned adjacent the drive chuck to sense when the roll carrier is properly positioned relative to the drive chuck and the carrier is then stopped. The drive chuck 322 is a torque chuck that has a plurality of air plungers 332*a* that extend radially outward when activated to engage with the interior surface of the tube and lock the drive chuck 322 to the interior surface of the tube. As the carrier 274 starts to move toward the driving chuck 322 the vacuum cup 314 shown in FIGS. 17 and 17*a* is activated to ensure that the draped free end 337 of the new roll will remain in its position over the drape plates. The free end 337 of the packaging material draped over the drape plates 312, 313 is passed through the spacing 342 between the spaced dispenser rollers 336, 338 shown in FIG. 14 and is positioned adjacent the free end 335*b* of the previously emptied roll. The proper positioning of the film is sensed by the proximity sensor 381 positioned over the dispenser roller 336 as shown in FIG. 14*a*. The movement of the roll carrier 274 to this position also positions the spent roll trough 308 beneath the idler chuck 324 that has been displaced to one side of the driving chuck 322 and still holds the empty tube from the previously spent roll of packaging material. As shown in FIG. 17*c*, the grip plungers 324*a* of the idler chuck 324 are released and the empty tube eject mechanism 325 is activated laterally to discard the empty tube and the idler chuck drops the empty tube into the spent roll trough 308. The empty tube eject mechanism 327 is then retracted back to its home position shown in FIG. 17*c*. The arm 326 of the idler chuck is then extended positioning the idler chuck 324 in an axially aligned position with the drive chuck 322 and the center of the tube of the packaging material roll. The base 328 of the idler chuck then moves axially toward the driving chuck 322 causing the idler chuck 324 to be inserted into the interior of the roll tube. The idler chuck 324 is then locked in place against the interior surface of the roll tube. A slip ring 327 is mounted by bearings to the idler chuck arm 326 and engages against the end of the tube of the packing film material roll mounted on the idler chuck. The slip ring 327 rotates freely around the idler chuck 324 and its engagement with the end of the tube of the roll of packaging film material enables the free spinning movement of the roll when it is clamped between the idler chuck 324 and the drive chuck 322.

With the new roll of packaging material securely clamped between the driving chuck 322 and the idler chuck 324 and the free end 337 of the material draped in the spacing 342 between the spaced dispenser rollers 336, 338, the roll carrier 274 is then lowered by deflating the air cushions 268 of the dispenser base 262. This causes the drape plates 312, 313 to also lower and disengage from the free end of the packaging film material leaving the free end 337 resting on the dispenser roller 336 and suspended in the spacing 342 between the spaced dispenser rollers 336, 338 as shown in FIG. 14. The tray 294 is also lowered on the carrier 274 disengaging the tray from the roll of packaging material. The lowered carrier 274 is then moved laterally along the rails 272 out from beneath the bagging conveyor 12 where the carrier can be reloaded with a new roll of packaging material to be used next in replacing a depleted roll. The vacuum bar 362 is then extended into the spacing 342 to position the film end 335 in the spacing adjacent the new film end 337 as shown in FIG. 14.

With the free film end 337 of packaging material suspended over the roller 336 and the free end 335 of packaging material suspended over the roller 338 in the spacing 342 between the rollers and between the pair of heat seal/cut bars 354, 356, the movable bar 356 is moved toward the stationary bar 354 to form the spliced seam between the two film ends 335, 337. This secures the two film ends together while also cutting away any excess packaging material below the spliced seam from the spliced films. The vacuum bar 362 is still activated and holds to the excess material cut away from the spliced seam of the two films of material. The tension roller actuator 378 is then deactivated causing the tension roller 368 to move downwardly. The drive chuck 322 is then driven in reverse to roll any slack in the film onto the roll and to move the tension arms 372 upwardly back to a generally horizontal position indicating the conveyor operation can proceed. While this is occurring the vacuum bar 362 is retracted to pull away the remaining excess material adjacent the spliced seam and the vacuum to the vacuum cups 358 are deactivated dropping the excess film material downwardly. The bagging conveyor is then again ready for operation. The bagging conveyor 12 is actuated and the driving chuck 322 is activated to again dispense the film of packaging material to the bagging conveyor.

Basically the same operations described above take place when replacing rolls of packaging film and splicing the film in the top film dispenser 264 shown in FIG. 16. However, the top film dispenser has the additional upper roller 386 over which the packaging film extends. Also, the top dispenser has the additional hold-down pads 388 positioned above the upper roller 386. When the end of the packaging film runs off of the roll in the top dispenser 264 it is sensed by the downward movement of the tensioning roller 368' and the downward fall of the film free end 335*a* sensed by the proximity sensor 380'. Also, when the film of packaging material 334' runs off of the roll, the film free end falls downwardly while resting over the dispenser roller 336' to hang in a vertically downward position of the film free end 335*a*' as shown in FIG. 16. When the film free end 335*a*' falls in the vertical position as shown in FIG. 16 it is sensed by the proximity sensor 380'. The downward pivoting movement of the tension arm shaft 374' sensed by the shaft transducer 376' which indicates that the tension arm has fallen to its lowest position and the sensing of the proximity photo sensor 380' that the film free end 335*a*' has fallen to a vertical position over the dispenser roller 336' indicates that the film free end has run off of the roll. This causes the bagging conveyor 12 to stop and the upper roller hold-down pad actuators 388 to engage the film against the roller 386 at the same time as the hold-down pad actuators 344', 346' over the pair of film dispenser rollers 336', 338'. The upper hold-down pad actuators 388 remain engaged against the upper roller 386 holding the end of the packaging film and preventing it from falling from the top packaging film dispenser 264 downward to the bagging conveyor. The upper hold-down pad actuators 388 remain engaged for the entire splicing process which is basically the same as that of the bottom packaging film dispenser 262. When the splicing process is completed as described above and the tension roller 368' has been moved to its generally horizontal position, the upper hold-down pad actuators 388 are released and operation of the bagging conveyor continues.

Because the bagging conveyor of the invention forms bags of the packaging material around the layers of objects conveyed by the conveyor, it can operate substantially continuously as it receives layers of objects from an infeed conveyor, bags the layers of objects and then supplies the bagged layers of objects to the outfeed conveyor that supplies the bagged layers of objects to a palletizer, thus significantly increasing the time efficiently of supplying bagged layers of objects to a palletizer than that achievable by prior art bagging conveyors.

Although the bagging conveyor of the invention has been described above by reference to a specific embodiment, it should be understood that various modifications and alterations could be made to the structure of the bagging conveyor without departing from the scope of protection provided by the following claims.

What is claimed is:

1. A conveyor that bags objects conveyed by the conveyor, the conveyor comprising:

a bottom conveying surface having laterally opposite side edges and a longitudinal length between an upstream end of the bottom conveying surface and an opposite, downstream end of the bottom conveying surface;

a top conveying surface having laterally opposite side edges and a longitudinal length between an upstream end of the top conveying surface and an opposite, downstream end of the top conveying surface, the top conveying surface being positioned vertically above and opposing the bottom conveying surface with a vertical spacing therebetween, whereby the bottom conveying surface and the top conveying surface convey objects longitudinally downstream through the spacing;

a bottom film dispenser that dispenses a bottom film of packaging material to the spacing between the bottom conveying surface and the top conveying surface with the bottom film positioned between the bottom conveying surface and the objects conveyed through the spacing;

a top film dispenser that dispenses a top film of packaging material to the spacing between the bottom conveying surface and the top conveying surface with the top film positioned between the top conveying surface and the objects conveyed through the spacing;

a plurality of connecting devices positioned adjacent the laterally opposite side edges of the bottom conveying surface and the laterally opposite side edges of the top conveying surface, the connecting devices each including a lower guide surface that slopes upwardly as it extends downstream and an upper guide surface that slopes downwardly as it extends downstream where the upper and lower guide surfaces of the connecting devices receive laterally opposite edges of the bottom film and top film and connect the laterally opposite edges of the bottom film and top film with the objects conveyed through the spacing between the connected bottom film and top film;

the bottom film dispenser having means for supporting and dispensing a roll of the bottom film of packaging material;

the top film dispenser having means for supporting and dispensing a roll of the top film of packaging material;

the bottom film dispenser having means for splicing together consecutive rolls of the bottom films of packaging material for splicing the bottom film positioned between the bottom conveying surface and the objects conveyed through the spacing with bottom film on the means for supporting and dispensing a roll of bottom film;

the top film dispenser having means for splicing together consecutive rolls of the top films of packaging material for splicing the top film positioned between the top conveying surface and the objects conveyed through the spacing with top film on the means for supporting and dispensing a roll of top film; and, the top conveying surface having a plurality of longitudinally extending top conveying surfaces that are arranged laterally side by side and having means for moving the plurality of top conveying surfaces at different speeds relative to each other.

2. The conveyor of claim 1, further comprising:

each lower guide surface being on a lower belt that is wrapped around an upstream pulley and a downstream pulley and each upper guide surface being on an upper belt that is wrapped around an upstream pulley and a downstream pulley.

3. The conveyor of claim 1, further comprising:

the plurality of connecting devices including an end connecting device that traverses the conveying surface and connects the bottom film to the top film laterally across the bottom film and the top film.

4. The conveyor of claim 3, further comprising:

the end connecting device having a pair of opposed bars that extend laterally across the conveying surface with the bottom film and the top film being between the bars, the pair of bars being operable to move vertically toward and away from each other, with the bottom film and top film being brought together by the pair of bars moving toward each other to connect the bottom film and top film together laterally across the bottom film and the top film.

5. The conveyor of claim 1, further comprising:

the connecting devices adjacent the laterally opposite side edges of the bottom conveying surface and the top conveying surface each including a pair of longitudinal spaced pulleys, each lower guide surface being on a lower belt that is wrapped around one of the pairs of longitudinally spaced pulleys and each upper guide surface being on an upper belt that is wrapped around one of the pairs of longitudinally spaced pulleys.

6. The conveyor of claim 1, further comprising:

an end connecting device positioned adjacent the bottom conveying surface and the top conveying surface downstream ends, the end connecting device extending laterally across the spacing and having means for connecting the bottom film to the top film laterally across the bottom film and the top film.

7. The conveyor of claim 6, further comprising:

the end connecting device having a pair of opposed bars that extend laterally across the spacing with the bottom film and the top film being conveyed between the pair of bars, the pair of bars having means for moving vertically toward and away from each other with the bottom film and the top film being brought together by the pair of bars being moved toward each other, and the pair of bars having means for connecting the bottom film and the top film together laterally across the bottom film and the top film.

8. The conveyor of claim 7, further comprising:

the pair of bars having means for cutting laterally through the bottom film and the top film.

* * * * *